US007674575B2

(12) United States Patent
Oshima et al.

(10) Patent No.: US 7,674,575 B2
(45) **Date of Patent: *Mar. 9, 2010**

(54) SILVER HALIDE PHOTOSENSITIVE MATERIAL FOR COLOR-PHOTOGRAPHY AND IMAGE FORMATION METHOD USING THE SAME

(75) Inventors: Naoto Oshima, Kanagawa (JP); Tadanobu Sato, Kanagawa (JP); Akito Yokozawa, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/871,389

(22) Filed: Jun. 21, 2004

(65) Prior Publication Data

US 2004/0234907 A1 Nov. 25, 2004

Related U.S. Application Data

(62) Division of application No. 10/608,234, filed on Jun. 30, 2003, now Pat. No. 6,830,880.

(30) Foreign Application Priority Data

Jun. 28, 2002 (JP) ..... 2002-191096
Jun. 28, 2002 (JP) ..... 2002-191097
Jun. 28, 2002 (JP) ..... 2002-191098

(51) Int. Cl.
*G03C 1/46* (2006.01)

(52) U.S. Cl. ..... 430/604; 430/567; 430/569; 430/605

(58) Field of Classification Search ..... 430/604, 430/605, 567, 569
See application file for complete search history.

(56) References Cited

U.S. PATENT DOCUMENTS 5,047,317 A 9/1991 Shibayama et al.
6,255,045 B1 * 7/2001 Chen et al. ..... 430/629
6,420,103 B1 * 7/2002 Honan et al. ..... 430/546
6,696,236 B2 * 2/2004 Nakahira et al. ..... 430/567
6,902,879 B2 * 6/2005 Inaba et al. ..... 430/567
7,238,468 B2 * 7/2007 Ohshima et al. ..... 430/599
2002/0051949 A1 * 5/2002 Kuroda ..... 430/567
2002/0102505 A1 * 8/2002 Nakahira et al. ..... 430/567

FOREIGN PATENT DOCUMENTS

JP 4-264547 A 9/1992
JP 5-307249 A 11/1993
JP 8-160581 A 6/1996
JP 2000-10224 A 1/2000
JP 2000-356844 A 12/2000
JP 2001-100345 A 4/2001
JP 2001-154304 A 6/2001
JP 2001-281786 A 10/2001
JP 2002-107860 A 4/2002
JP 2002-107865 A 4/2002
JP 2002-162708 * 6/2002
JP 2002-174870 A 6/2002

OTHER PUBLICATIONS

Partial Engllish language machine translation of JP 2002-162708.*
Partial Engllish language machine translation of JP 2002-174872.*

* cited by examiner

*Primary Examiner*—Hoa V Le
(74) *Attorney, Agent, or Firm*—Sughrue Mion, PLLC

(57) ABSTRACT

A silver halide color photosensitive material for being subjected to a color development within nine seconds of being imagewise exposed, and comprising a support and a photograph constitution layer provided on the support, the photograph constitution layer containing at least one layer that comprises a yellow dye-forming coupler, at least one layer that comprises a magenta dye-forming coupler, at least one layer that comprises a cyan dye-forming coupler, and at least one non-photosensitive hydrophilic colloid layer. The coupler-comprising layers respectively include silver halide emulsions, and at least one of the silver halide emulsions has the characteristics of: (i) a silver chloride content of 90 mol % or more; and (ii) containing at least one specific metal complexes. The color development is preferably completed within 28 seconds.

16 Claims, No Drawings

SILVER HALIDE PHOTOSENSITIVE MATERIAL FOR COLOR-PHOTOGRAPHY AND IMAGE FORMATION METHOD USING THE SAME

This is a divisional of application Ser. No. 10/608,234 filed Jun. 30, 2003, now U.S. Pat. No. 6,830,880 issued Dec. 14, 2004.

CROSS-REFERENCE TO RELATED APPLICATIONS

This application claims benefit of and priority to Japanese Patent Applications Nos. 2002-191096, 2002-191097 and 2002-191098 filed on Jun. 28, 2002, which are incorporated herein by reference in their entirety for all purposes.

BACKGROUND OF THE INVENTION

1. Field of the Invention

The present invention relates to a silver halide photosensitive material for color-photography and an image formation method using the same. Specifically, the present invention relates to a silver halide photosensitive material for color-photography, which is suitably used in a cost reductive laser luminous source and an image formation method using the same, and in particular, to a silver halide photosensitive material for color-photography capable of attaining stable characteristics when scan exposure is performed using a cost reductive laser luminous source and image processing is performed after a short latent image period.

2. Description of the Related Art

Recently, impact of digitization has been remarkable in the field of color-printing using color-printing paper. For instance, a digital exposure system using a laser scan exposure shows the elongation of a fast diffusion rate as compared with a conventional analog exposure system which directly prints images by a color printer using a processed negative color film. Such a digital exposure method has a characteristic of providing a high image quality by processing an image, and thus it plays a very important role in improvement of color-print qualities using color-printing paper. In addition, since a high image-quality color print can be easily obtained from these electrographic recording medium, the use of digital cameras is rapidly spreading, thus the digital exposure system is expected to become more popular.

On the other hand, as a color print method, techniques such as an ink jet method, a sublimated type method, and color xerography have each progressed and are recognized for their ability of providing good photographic image qualities. Among these techniques, the characteristics of the digital exposure method using color-printing paper include a high image quality, a high throughput, and a high solidity of an image. It is desired to further develop these characteristics and to provide high image quality photographs more easily and with lower cost. If so-called one stop service of a color print becomes possible (i.e., one shop receives a recording medium of a digital camera from a customer and finishes processing to return a high image-quality print to the customer in a short time such as a few minutes), the predominance of the color print using color-printing paper will further increase. If a rapid processivity of color-printing paper is raised, a printing apparatus, which is smaller in size and lower in costs while having high productivity, can be used, and thus the one-stop service of a color print is expected to further spread. From these points, in particular, it is important to raise the rapid processivity of color-printing paper.

In order to make the one-stop service of the color print using color-printing paper possible, analyses from various viewpoints such as shortening of exposure time, shortening of the so-called latent image time from the exposure to the initiation of the processing, and shortening of time period from the processing to the drying are required. Thus, conventionally, various kinds of proposals have been proposed based on such viewpoints.

The time required for exposing one sheet of prints is dramatically shorter compared with other processes, thus there is no substantial problem in uses of printers generally used in shops. The latent image time has been designed to be shortened as much as possible. Shortening the time from processing to drying has been also performed. Furthermore, there are several proposals for performing the process rapidly by appropriately designing a processing liquid composition, a processing temperature, conditions for stirring a processing liquid, cover printing of photosensitive material, drying method, and so on.

On the other hand, forming a digital image in color-printing paper by laser scan exposure is performed. Conventionally, in order to provide a blue laser, a SHG component has been used in order to convert a laser beam emitted from a gas laser or a semiconductor laser having a longer oscillation wave length than gas lasers into a laser having a shorter wavelength. In the case of using the gas laser, the sizes of an exposure device should be enlarged, while the semiconductor laser may be miniaturized to some extent. However, in the case of using the semiconductor laser, there are limits to cost reductive and miniaturization of a printer.

Recently, a blue semiconductor laser (announced by Nichia Corporation on the 48th Spring Meeting of the Japan Society of Applied Physics and Related Societies, March, 2001) with a wave length of 430 to 460 nm which does not use an SHG component has been developed, thus the possibility to provide a more inexpensive printer is increasing.

For the above-mentioned purpose, we conducted a scan exposure on color-printing paper with a blue semiconductor laser and performed analyses under conditions of a short latent image time of less than 9 seconds and a color development in a short time of less than 28 seconds. However, the obtained prints did not provide stability in color. Even when we repeatedly printed one image, every print obtained differed in color.

We conducted various analyses in order to solve the above problem, and we finally found out that preparing a silver halide emulsion used for color-printing paper with adding a specific metal complex therein is effective.

As a silver halide emulsion used for color-printing paper, a silver halide emulsion with high silver chloride content is used to meet requirements of the rapid processing. Attempts to include various kinds of metal complexes into a silver halide emulsion with high silver chloride content have been disclosed. In order to improve failure in high exposure and to obtain a hard tone wedge at high exposure intensity, doping of Ir complex has been well known in the art. For instance, Japanese Patent Application Publication (JP-B) No. 7-34103 discloses that a localized phase having higher silver chloride content is provided and an Ir complex is doped in such a phase to solve the problem of latent image sensitization. U.S. Pat. No. 4,933,272, discloses that low exposure failure can be reduced by including a metal complex which contains NO or NS in a ligand. U.S. Pat. Nos. 5,360,712, 5,457,021, and 5,462,849 disclose that reciprocity failure can be reduced by including a metal complex which contains a specific organic ligand in a ligand. U.S. Pat. Nos. 5,372,926, 5,255,630, 5,255,451, 5,597,686, 5,480,771, 5,474,888, 5,500,335, 5,783,373, and 5,783,378 discloses that performances, such as reciprocity law characteristics of a high silver chloride emulsion, are improvable in combinations of the metal complex, which contains Ir complex and NO in a ligand. Japanese Patent Application Laid-Open (JP-A) Nos. 2000-250156, 2001-92066, and 2002-31866 disclose the emulsion technique, which is excellent in the latent image stability after exposure with uses of combinations of Ir complex and Rh complex or the like.

Furthermore, JP-A Nos. 58-95736, 58-108533, 60-222844, 60-222845, 62-253143, 62-253144, 62-253166, 62-254139, 63-46440, 63-46441, and 63-89840, and U.S. Pat. Nos. 4,820,624, 4,865,962, 5,399,475, and 5,284,743 disclose that high sensitivity can be obtained by making a localized phase having a higher content of silver bromide with various forms in an emulsion with high silver chloride content.

U.S. Pat. Nos. 5,726,005 and 5,736,310 disclose that the emulsion containing I having a maximum concentration in the sub surface of a high silver chloride emulsion allows a high-sensitivity emulsion with little high luminance failure to be obtained. In the example in European Patent (EP) No. 928,988A, it is indicated that the emulsion excellent in reciprocity failure, temperature dependency and pressure property at the time of exposure is obtained by including a specific compound in particles that form I band at the time of 93% particle formation.

However, the prior art neither discloses nor teaches about instabilities of photographic characteristics and improvements thereof at the time of performing a scan exposure on color-printing paper by a blue laser, and carrying out the color development processing with a short latent image period of 9 or less seconds.

SUMMARY OF THE INVENTION

The present invention provides an image-forming method capable of providing a stable photograph quality even if a color development is performed in a short latent image time, and a silver halide photosensitive material for color-photography which is applicable in the image-forming method. Specifically, the present invention provides a silver halide photosensitive material for color-photography suitable for color print and an image-forming method using the silver halide photosensitive material for color-photography.

The present inventors found out that the above object was solvable with the following means as a result of their intensive studies.

Namely, the present invention provides a silver halide color photosensitive material and an image forming method, wherein the method comprises the steps of:

exposing the silver halide color photosensitive material; and beginning to subject the exposed silver halide color photosensitive material to a color development within nine seconds of the exposure, wherein the silver halide color photosensitive material comprises:

a support; and a photograph constitution layer provided on the support, and including at least one layer that comprises a yellow dye-forming coupler, at least one layer that comprises a magenta dye-forming coupler, at least one layer that comprises a cyan dye-forming coupler, and at least one non-photosensitive hydrophilic colloid layer, wherein the coupler-comprising layers respectively include silver halide emulsions, and at least one of the silver halide emulsions has the following characteristics:

(i) a silver chloride content of 90 mol % or more; and (ii) contains at least one metal complex represented by general formulae (I) or (II):

$$[IrX^{I}_{n}L^{I}_{(6-n)}]^{m} \quad (I)$$

wherein $X^{I}$ represents a halogen ion or a pseudo-halogen ion; $L^{I}$ represents an arbitrary ligand which is different from $X^{I}$; n represents 3, 4, or 5; and m represents 5−, 4−, 3−, 2−, 1−, 0, or 1+:

$$[MX^{II}_{n}L^{II}_{(6-n)}]^{m} \quad (II)$$

wherein M represents Cr, Mo, Re, Fe, Ru, Os, Co, Rh, Pd, or Pt; $X^{II}$ represents a halogen ion; and $L^{II}$ represents an arbitrary ligand which is different from $X^{II}$; n represents 3, 4, 5, or 6; and m represents 4−, 3−, 2−, 1−, 0, or 1+.

As one aspect (a) of the present invention, the present invention provides the image forming method and the silver halide color photosensitive material, wherein the color development is completed within 28 seconds.

As one aspect (b) of the present invention, the present invention provides the image forming method and the silver halide color photosensitive material, wherein the exposing step is a scanning exposure step conducted by using exposure sources including at least one blue laser having a wavelength from 420 nm to 460 nm, and at least one of the silver halide emulsions contained in the at least one layer containing the yellow dye-forming coupler has the features (i) and (ii).

Further, as one aspect (c) of the present invention, the present invention provides the image forming method and the silver halide color photosensitive material, wherein the color development is completed within 28 seconds, and an average spherical equivalent diameter of the silver halide particles in the silver halide emulsion layer that contains the yellow dye-forming coupler is from 0.30 μm to 0.70 μm.

DETAILED DESCRIPTION OF THE INVENTION

Hereinafter, the present invention is described in detail.

One aspect of the present invention is an image-forming method in which silver halide photosensitive material for color-photography described later is used to initiate a color development within 9 seconds from a development. Further, another aspect of the present invention is a silver halide photosensitive material for color-photography applicable to such the method of rapid processing. The invention provides a stable photograph quality when scan exposure of the silver halide photosensitive material for color-photography described later is carries out using a blue laser as mentioned above and color development processing is performed in a short latent image time.

Hereinafter, the silver halide photosensitive material for color-photography which can be applied in the invention (hereafter, each of these materials will be also simply referred to as "a photosensitive material") will be described in addition to the image-forming method using such a photosensitive material.

A photosensitive material is silver halide color photosensitive material for color-photography comprising a photograph constitution layer comprising a support and a photograph constitution layer provided on the support, that contains at least one layer that comprises a yellow dye-forming coupler, at least one layer that comprises a magenta dye-forming coupler, at least one layer that comprises a cyan dye-forming coupler, and at least one non-photosensitive hydrophilic colloid layer. The coupler-comprising layers respectively include silver halide emulsions. Preferably, at least one of the silver halide emulsions have the characteristics of (i) a silver chloride content of 90 mol % or more; and (ii) containing at least one of metal complexes represented by general formulae (I) or (II) described below.

The silver halide emulsion layer that contains a yellow dye-forming coupler functions as a yellow coloring layer, the silver halide emulsion layer that contains a magenta dye-forming coupler functions as a magenta coloring layer, and the silver halide emulsion layer that contains a cyan dye-forming coupler functions as a cyan coloring layer. The silver halide emulsions respectively contained in the yellow coloring layer, magenta coloring layer, and cyan coloring layer may preferably have their own photosensitivities to the respective light rays of different wave length regions (for example, light rays of blue region, green region, and red region), respectively.

The photosensitive material may include an anti-halation layer, an intermediate layer, and a coloring layer as hydrophilic colloid layer described later if desired, in addition to the above yellow coloring layers of magenta coloring layer, and cyan coloring layer.

Hereinafter, metal complexes represented by general formula (I) or (II) will be described. First, the metal complex represented by general formula (I) is explained.

$$[IrX^1{}_nL^1{}_{(6-n)}]^m \qquad \text{General formula (I)}$$

wherein $X^1$ represents a halogen ion or a pseudo-halogen ion, except for a cyanate ion, $L^1$ represents an arbitrary ligand which is different from $X^1$, n represents 3, 4, or 5, and m represents 5−, 4−, 3−, 2−, 1−, 0, or 1+.

In the above, pseudo-halogen (halogenoid) ion is an ion which has a property similar to a halogen ion, such as cyanide ion ($CN^-$), thiocyanate ion ($SCN^-$), selenocyanate ion ($SeCN^-$), tellurocyanate ion ($TeCN^-$), azide dithio carbonate ion ($SCSN_3^-$) cyanate ion ($OCN^-$), fulminic acid ion ($ONC^-$), azide ion ($N_3^-$) or the like.

Preferable ions to be used as $X^1$ may include fluoride ion, chloride ion, bromide ion, iodide ion, cyanide ion, isocyanate ion, thiocyanate ion, nitrate ion, nitrite ion, and azide ion. Among these ions, chloride ion and bromide ion are particularly preferable. $L^1$ is not specifically limited, and it may be an inorganic compound or an organic compound, and it may have a charge or no charge. Preferably, it may be a non-charged inorganic compound or organic compound.

Among the metal complexes which can be represented by general formula (I), metal complexes represented by the following general formula (IA) or (IB) are preferable. Among them, furthermore, metal complexes represented by general formula (IB) are more preferable.

$$[IrX^{1A}{}_nL^{1A}{}_{(6-n)}]^m \qquad \text{General formula (IA)}$$

wherein $X^{1A}$ represents a halogen ion or a pseudo-halogen ion, except for a cyanate ion, $L^{1A}$ represents an arbitrary inorganic ligand which is different from $X^{1A}$, n represents 3, 4, or 5, and m represents 5−, 4−, 3−, 2−, 1−, 0, or 1+.

$X^{1A}$ is synonymous with $X^1$ of the general formula (I), and its desirable range is also the same.

As $L^{1A}$, water, OCN, ammonia, phosphine, and carbonyl are preferable, and water is particularly preferable as $L^{1A}$.

$$[IrX^{1B}{}_nL^{1B}{}_{(6-n)}]^m \qquad \text{General formula (IB)}$$

wherein $X^{1B}$ represents a halogen ion or a pseudo-halogen ion, except for a cyanate ion, $L^{1B}$ represents a ligand having a main structure formed of a chain or cyclic hydrocarbons, or one in which one or more of a carbon atoms and/or hydrogen atoms of the main structure is substituted with other atoms or atomic groups. In addition, n represents 3, 4, or 5, and m represents 5−, 4−, 3−, 2−, 1−, 0, or 1+.

$X^{1B}$ is synonymous with $X^1$ of the general formula (I), and its desirable range is also the same.

$L^{1B}$ represents a ligand having a main structure formed of a chain or cyclic hydrocarbons, or one in which one or more of a carbon atoms and/or hydrogen atoms of the main structure is substituted with other atoms or atomic groups, except for cyanide ions. Preferably, $L^{1B}$ is a heterocyclic compound. More preferably, $L^{1B}$ is a complex having a five-membered ring compound as a ligand. Still more preferably, $L^{1B}$ is a compound having at least one nitrogen atom and at least one sulfur atom incorporated in its five-membered ring skeleton.

Among the metal complexes represented by general formula (IB), metal complexes represented by the following general formula (IC) are more preferable.

$$[IrX^{1C}{}_nL^{1C}{}_{(6-n)}]^m \qquad \text{General formula (IC)}$$

wherein $X^{1C}$ represents a halogen ion or a pseudo-halogen ion, except for a cyanate ion, $L^{1C}$ represents a five-membered ring ligand comprising at least one nitrogen atom and at least one sulfur atom in the ring skeleton, and may have an arbitrary substituent on the carbon atom in the ring skeleton in $L^{1C}$. In addition, n represents 3, 4, or 5, and m represents 5−, 4−, 3−, 2−, 1−, 0, or 1+.

$X^{1C}$ is synonymous with $X^1$ of the general formula (I), and its desirable range is also the same.

As the substituent on the carbon atom in the ring skeleton in $L^{1C}$, a substituent having a volume smaller than that of n-propyl group is preferable. As the substituent, a methyl group, an ethyl group, a methoxy group, an ethoxy group, a cyano group, an isocyano group, a cyanate group, an isocyanato group, a thiocyanate group, an isothiocyanate group, a formyl group, a thioformyl group, a hydroxy group, a mercapto group, an amino group, a hydrazino group, an azido group, a nitro group, a nitroso group, a hydroxyamino group, a carboxyl group, a carbamoyl group, a fluoro group, a chloro group, a bromo group, and an iodine group are preferred.

Among the metal complexes represented by general formula (IC), the metallic complexes represented by the following formula (ID) are further preferable.

$$[IrX^{1D}{}_nL^{1D}{}_{(6-n)}]^m \qquad \text{General formula (ID)}$$

wherein $X^{1D}$ represents a halogen ion or a pseudo-halogen ion, except for a cyanate ion, $L^{1D}$ is a five-membered ligand, representing a ligand that comprises at least two nitrogen atoms and at least one sulfur atom in its ring skeleton, and may have an arbitrary substituent on the carbon atom in the ring skeleton. In addition, n represents 3, 4, or 5, and m represents 5−, 4−, 3−, 2−, 1−, 0, or 1+.

$X^{1D}$ is synonymous with $X^1$ of the general formula (I), and its desirable range is also the same.

As $L^{1D}$, a compound having thiadiazole as a skeleton is preferable, and it is preferable that respective carbon atoms in the compound have at least one substituent which is other than a hydrogen atom. Preferable substituents may include a halogen atom (fluorine, chlorine, bromine, and iodine), a methoxy group, an ethoxy group, a carboxyl group, a methoxy carboxyl group, an acyl group, an acetyl group, a chloroformyl group, a mercapto group, a methylthio group, a thioformyl group, a thiocarboxy group, a dithiocarboxy group, a sulfino group, a sulfo group, sulfamoyl group, a methylamino group, a cyano group, an isocyano group, a cyanate group, an isocyanato group, a thiocyanate group, an isothiocyanate group, a hydroxyamino group, a hydroxyimino group, a carbamoyl group, a nitroso group, a nitro group, a hydrazino group, a hydrazono group, and an azido group, and more preferably, a halogen atom (fluorine, chlorine, bromine, and iodine), a chloroformyl group, a sulfino group, a sulfo group, a sulfamoyl group, an isocyano group, a cyanato group, an isocyanato group a thiocyanate group, an isothiocyanate group, a hydroxyimino group, a nitroso group, a nitro grop, and an azide group. Among them, chlorine, bromine, a chloroformyl group, an isocyano group, an isocyano group, a cyanate group, an isocyanato group, a thiocyanate group, and isothiocyanate group are particularly preferred.

In the general formulae (I) and (IA) to (ID), n is preferably 4 or 5. m is preferably 4−, 3−, 2−, 1−, 0, or 1+, and more preferably 2− or 1−.

Hereinafter, preferable concrete examples of the metal complex represented by general formula (I) are listed. However, the present invention is not limited to these compounds.

$[IrCl_5(H_2O)]^{2-}$
$[IrCl_4(H_2O)_2]^{-}$
$[IrCl_4(H_2O)]^{-}$
$[IrCl_4(H_2O)_2]^{0}$
$[IrCl_5(OH)]^{3-}$
$[IrCl_4(OH)_2]^{2-}$
$[IrCl_5(OH)]^{2-}$
$[IrCl_4(OH)_2]^{2-}$
$[IrCl_5(O)]^{4-}$
$[IrCl_4(O)_2]^{5-}$
$[IrCl_5(O)]^{3-}$
$[IrCl_4(O)_2]^{4-}$
$[IrBr_5(H_2O)]^{2-}$
$[IrBr_4(H_2O)_2]^{-}$
$[IrBr_5(H_2O)]^{-}$
$[IrBr_4(H_2O)_2]^{0}$
$[IrBr_5(OH)_2]^{3-}$
$[IrBr_4(OH)_2]^{2-}$
$[IrBr_5(OH)]^{2-}$
$[IrBr_4(OH)_2]^{2-}$
$[IrBr_5(O)]^{4-}$
$[IrBr_4(O)_2]^{5-}$
$[IrBr_5(O)]^{3-}$
$[IrBr_4(O)_2]^{4-}$
$[IrCl_5(OCN)]^{3-}$
$[IrBr_5(OCN)]^{3-}$
$[IrCl_5(\text{thiazole})]^{2-}$
$[IrCl_4(\text{thiazole})_2]^{-}$
$[IrCl_3(\text{thiazole})_3]^{0}$
$[IrBr_5(\text{thiazole})]^{2-}$
$[IrBr_4(\text{thiazole})_2]^{-}$
$[IrBr_3(\text{thiazole})_3]^{0}$
$[IrCl_5(\text{5-methylthiazole})]^{2-}$
$[IrCl_4(\text{5-methylthiazole})_2]^{-}$
$[IrBr_5(\text{5-methylthiazole})]^{2-}$
$[IrBr_4(\text{5-methylthiazole})_2]^{-}$
$[IrCl_5(\text{5-chlorothiadizole})]^{2-}$
$[IrCl_4(\text{5-chlorothiadizole})_2]^{-}$
$[IrBr_5(\text{5-chlorothiadizole})]^{2-}$
$[IrBr_4(\text{5-chlorothiadizole})_2]^{-}$
$[IrCl_5(\text{2-chloro-5-fluorothiadiazole})]^{2-}$
$[IrCl_4(\text{2-chloro-5-fluorothiadiazole})_2]^{-}$
$[IrBr_5(\text{2-chloro-5-fluorothiadiazole})]^{2-}$
$[IrBr_4(\text{2-chlroro-5-fluorothiadiazole})_2]^{-}$
$[IrCl_5(\text{2-Bromo-5-chlorothiadiazole})]^{2-}$
$[IrCl_4(\text{2-Bromo-5-chlorothiadiazole})_2]^{-}$
$[IrBr_5(\text{2-Bromo-5-chlorothiadiazole})]^{2-}$
$[IrBr_4(\text{2-Bromo-5-chlorothiadiazole})_2]^{-}$ Among them, $[IrCl_5(\text{5-methylthiazole})]^{2-}$ and $[IrCl_5(\text{2-chloro-5-fluorothiadiazole})]^{2-}$ are preferable.

Next, metal complexes represented by general formula (II) are described.

$$[MX^{11}_{n}L^{11}_{(6-n)}]^{m} \qquad \text{General formula (II)}$$

wherein M represents Cr, Mo, Re, Fe, Ru, Os, Co, Rh, Pd, or Pt, $X^{11}$ represents a halogen ion, and $L^{11}$ represents an arbitrary ligand which is different from $X^{11}$. In addition, n represents 3, 4, 5, or 6 and m represents 4−, 3−, 2−, 1−, 0, or 1+.

It is preferable that $X^{11}$ is a fluoride ion, a chloride ion, a bromide ion, or an iodide ion and among them, a chloride ion and bromide ion are particularly preferable. $L^{11}$ is not specifically limited. $L^{11}$ may be an inorganic compound or an organic compound, and $L^{11}$ may have a charge or no charge. Preferably, $L^{11}$ is a non-charged inorganic compound. Among them, preferably, $L^{11}$ is $H_2O$, NO, or NS.

Among the metal complexes represented by general formula (II), metal complexes represented by the following formula (IIA) are preferable.

$$[M^{11A}X^{11A}_{n}L^{11A}_{(6-n)}]^{m} \qquad \text{General formula (IIA)}$$

In the general formula (IIA), $M^{11A}$ represents Re, Ru, Os, or Rh. $X^{11A}$ represents a halogen ion. If $M^{11A}$ is Re, Ru, or Os, $L^{11A}$ represents NO or NS. If $M^{11A}$ is Rh, $L^{11A}$ represents $H_2O$, OH or O. In addition, n represents 3, 4, 5, or 6 and m represents 4−, 3−, 2−, 1−, 0, or 1+.

$X^{11A}$ is synonymous with $X^{11}$ of the general formula (II), and its desirable range is also the same.

Hereinafter, preferable concrete examples of the metal complex represented by general formula (II) are listed. However, the present invention is not limited to these compounds.

$[ReCl_6]^{2-}$
$[ReCl_5(NO)]^{2-}$
$[RuCl_6]^{2-}$
$[RuCl_6]^{3-}$
$[RuCl_5(NO)]^{2-}$
$[RuCl_5(NS)]^{2-}$
$[RuBr_5(NS)]^{2-}$
$[OsCl_6]^{4-}$
$[OsCl_5(NO)]^{2-}$
$[OsBr_5(NS)]^{2-}$
$[RhCl_6]^{3-}$
$[RhCl_5(H_2O)]^{2-}$
$[RhCl_4(H_2O)_2]^{-}$
$[RhBr_6]^{3-}$
$[RhBr_5(H_2O)]^{2-}$
$[RhBr_4(H_2O)_2]^{-}$
$[PdCl_6]^{2-}$
$[PtCl_6]^{2-}$

Among them, $[OsCl_5(NO)]^{2-}$ and $[RhBr_6]^{3-}$ are particularly preferable.

The metal complexes listed above are anions. As a counter cation thereof, a cation that forms a salt consisted of the anion and the cation which can easily dissolves in water when is preferable. Concretely, an ammonium ion, alkyl ammonium ion, and alkali metal ions such as a sodium ion, a potassium ion, a rubidium ion, a cesium ion, and a lithium ion are preferable. These metal complexes can be used such that each of them is dissolved in water or a mixture solvent of water and one or more of appropriate water-soluble organic solvents (e.g., alcohols, ethers, glycols, ketones, esters, and amides). The metal complex represented by general formula (I) is preferably added such that a content thereof might become $1\times10^{-10}$ moles to $1\times10^{-3}$ moles per mole of silver, most preferably $1\times10^{-8}$ to $1\times10^{-5}$ moles per mole of silver, during the silver halide particles are formed. The metal complex represented by general formula (II) is preferably added such that a content thereof might become $1\times10^{-11}$ moles to $1\times10^{-6}$ moles, most preferably $1\times10^{-9}$ to $1\times10^{-7}$, during the silver halide particles are formed.

It is preferable that the above metal complex in silver halide particles are incorporated into the silver halide particles at the time of forming the silver halide particles by directly adding it in a reaction solution or by adding it in a halide aqueous solution used for the formation of silver halide particles or other solution. Further, it is also preferred to carry out physical maturing of the metal complex contained in fine particles in advance and then incorporate the metal complex into the silver halide particles. Furthermore, the metal complex may be incorporated in the silver halide particles by a combination of these methods.

In the case of incorporating these metal complexes into silver halide particles, respectively, each kind of the metal complex may be provided uniformly in the particles. Alternatively, it may be provided only in the particle surface layers just as in the cases disclosed in JP-A Nos. 4-208936, 2-125245, and 3-188437. It is also preferable to allow the existence of the complex only in the inside of the particle, while providing a layer without containing a complex on the surface of the particle. Furthermore, as disclosed in U.S. Pat. Nos. 5,252,451 and 5,256,530, it is preferable to modify the surface of layer of the particles by carrying out physical maturing with fine particles in which the complex is incorporated. Furthermore, these methods may be combined with each other to allow a plurality of complexes into one silver halide particle.

Hereinafter, a silver halide emulsion used in the present invention is described.

A silver halide emulsion contains specific silver halide particles. Although the shape of particle is not limited in particular, it is preferred to be composed of a crystal grain of tetradodecahedron, which is substantially a cubic having the [100] plane (they may have rounded particle peaks and the high-ordered surfaces), a crystal grain of octahedron, and tabular grain having an aspect ratio of three or more, in which the main surface thereof is of the [100] plane or [111] plane. Here, the term "aspect ratio" represents a value obtained by dividing the diameter of a circle corresponding to the area of projection with the thickness of particles.

In the silver halide emulsion, it is preferred that silver chloride content is more than 90 mol % or more (when it is the silver halide emulsion of a silver halide emulsion layer that contains a yellow dye-forming coupler, the silver chloride content should be more than 90 mol %). From a viewpoint of rapid processivity, the content of the silver chloride is preferably 93 mol % or more, more preferably 95 mol %. The content of silver bromide is preferably 0.1 to 7 mol %, more preferably 0.5 to 5 mol %, because of its excellent properties with respect to high contrast and latent image stability. The content of silver iodide is preferably 0.02 to 1 mol %, more preferably 0.05 to 0.50 mol %, most preferably 0.07 to 0.40 mol %, because of its excellent properties with respect to high exposure exposure, high sensibility and high contrast. The specific silver halide particles of this invention are preferably iodine silver chloride particles, more preferably iodine silver chloride particles having the above halogen composition.

The specific silver halide particle in the silver halide emulsion is preferably having a silver bromide-containing phase and/or a silver iodide-containing phase. Here, the silver bromide-containing phase or the silver iodide-containing phase means a portion where the concentration of silver bromide or silver iodide is higher than the areas around such a portion. The halogen composition may be continuously changed from the silver bromide-containing layer or the silver iodide-containing phase to the adjacent areas thereof. In addition, such a change may be steeply occurred. Such a silver bromide or silver iodide phase may form a layer in which the concentration thereof is almost constant at a certain point in the particle, or may have the maximum point without being broadened. The local content of the silver bromide of the silver bromide-containing phase is preferably 5 mol % or more, more preferably 10 to 80 mol %, most preferably 15 to 50 mol %. The local content of the silver iodide of the silver iodide-containing phase is preferably 0.3 mol % or more, more preferably 0.5 to 8 mol %, and most preferably 1 to 5 mol %. Furthermore, each of such a silver bromide or silver iodide-containing phase may be provided such that a plurality of the phases are provided in the particle in layers. In addition, the content of silver bromide or silver iodide in each of the phases in the layer may be different from the others while at least one silver bromide or silver iodide-containing layer should be provided.

It is important that silver bromide-containing phases or silver iodide-containing phases of the silver halide emulsion are formed in layers to surround a particle, respectively. In one of preferable embodiments, silver bromide-containing phases or silver iodide-containing phases being formed in layers so as to surround the particle have uniform concentration distribution in the circumference direction of the particle in the phases. However, in the silver bromide-containing phases or silver iodide-containing phrases in layers, the maximum point or the minimum point of the concentration of silver bromide or silver iodide is present in the circumference direction of the particle, so that it may have the concentration distribution thereof. For instance, in the case of having the silver bromide-containing phase or sliver iodide-containing phase in layers so as to surround the particle in the vicinity of the surface of the particle, the concentration of silver bromide or silver iodide in the corner or edge of the particle may be different from that of the primary surface. Furthermore, in addition to the silver bromide-containing phases and the silver iodide-containing phases in layers so as to surround the particle, the silver bromide-containing phase or silver iodide-containing phase may be provided so as to be completely isolated on the specific portion of the surface of the particle without surrounding the particle. In the case that the silver halide emulsion contains silver bromide-containing layer, preferably, the silver halide-containing phase may be formed in layers so as to have the maximum point of the silver bromide concentration in the particle. In addition, preferably, when the silver halide emulsion has a silver iodide-containing phase, the silver iodide-containing phase may be formed in layers so as to have the maximum concentration of the silver iodide on the surface of the particle. It is desirable that such silver bromide-containing phase or silver iodide-containing phase is constructed such that the silver content thereof is preferably 3% or more to 30% or less, more preferably 3% or more to 15% or less with respect the volume of the particle, in terms of increasing the local concentration by a smaller content of silver bromide or silver iodide.

The silver halide emulsion preferably contain both the silver bromide-containing phase and the silver iodide-containing phase. In this case, even if the silver bromide-containing phase and the silver iodide-containing phase are in the same part of particle or they may be located in different positions. Preferably they may be located in different positions in that the formation of particles may be easily controlled. Furthermore, silver iodide may be contained in the silver bromide-containing phase. On the other hand, silver bromide may be contained in the silver iodide-containing phase. As the iodide to be added during the process of forming high silver chloride particles may generally tend to ooze out on the particle surface, compared with bromide, the silver iodide-containing phase tends to be formed in the vicinity of the particle surface. Therefore, when the silver bromide-containing phase and the silver-iodide containing phase are located in the different places in the particle, the silver bromide-containing phase may be preferably formed within the inside of the particle, compared with the silver iodide containing phase. In this case, another silver bromide-containing phase may be formed on the outside from the silver iodide-containing phase in the vicinity of the particle surface.

A silver-bromide content or a silver-iodide content required for generating the effects of the invention, such as an increase in sensibility and high contrast, increases enough to generate the silver bromide-containing phase or silver iodine-containing phase in the inside of a particle. There is a possibility of dropping the silver chloride content beyond necessity and spoiling rapid processivity. Therefore, it is preferable that the silver bromide-containing phase and the silver iodide-containing phase are preferably in contact with each other to collect these facilities that control a photograph action near the surface in the particle. From these points, the silver bromide-containing phase is measured from the inside of the particle, and is formed in 50 to 100% of locations of the particle volume, while the silver iodide-containing phase is preferably formed in 85 to 100% of locations of the particle volume. Furthermore, the silver bromide-containing phase is formed in 70 to 95% of locations of the particle volume, while the silver iodide-containing phase is still more preferably formed in 90 to 100% of locations of particle volume.

The introduction of a bromide or iodide ion for making a silver halide emulsion containing silver bromide or silver iodide is carried out by adding the solution of bromide salt or iodide salt, independently. Alternatively, in combine with the addition of a silver salt solution and a high chloride salt solution, a bromide salt or iodide salt solution may be added. In the case of the latter, the bromide salt or iodide salt solution, and the high chloride salt solution may be independently added as a mixed solution of bromide salt or iodide salt, and high chloride salt. Bromide salt or iodide salt is added in the form of soluble salt like alkali, alkaline earth bromide salt, or iodide salt. Alternatively, it can be also introduced by making bromide ion or iodide ion by cleaving from the organic molecule, as disclosed in U.S. Pat. No. 5,389,508. As an ion source of bromide or iodide ions, a minute silver bromide particle or a minute silver iodide particle can be also used.

The addition of solution of bromide sat or iodide salt may be performed by concentrating on one time of particle formation, and may be performed by applying during a certain fixed period. The introductory location of the iodide ion to a high chloride emulsion is restricted when obtaining a low-suffering emulsion with high sensibility. The increment in sensibility is smaller as the introduction of iodide ion is performed more inside of an emulsion particle. Therefore, it is preferred that an iodide salt solution is added to more outside from 50% of particle volume, preferably, to more outside from 70%, most preferably, to more outside from 85%. Furthermore, the addition of an iodide salt solution is terminated preferably more inside from 98% of the particle volume, most preferably more inside from 96%. The addition of the iodide salt solution can obtain a more low suffering emulsion with high sensibility, by terminating the addition a slightly inside the surface of the particle.

On the other hand, the addition of a bromide salt solution, is preferably outside from 50% of particle volume, more preferably outside from 70%.

Distribution of the concentration of bromide or iodide ion to the depth direction in a particle can be measured by the etching/TOF-SIMS (Time of Flight-Secondary Ion Mass Spectrometry) method, for example, using TRIFTII type TOF-SIMS manufactured by PhiEvans Co., Ltd. The TOF-SIMS method is specifically described in "The Surface Analysis Technical Selected-Books: Secondary-Ion-Mass-Spectroscopy" edited by the Surface Science Society of Japan, Maruzen Co., Ltd. (issued in 1999). If an emulsion particle is analyzed by the etching/TOF-SIMS method, even if it ends the addition of an iodide salt solution in the inside of a particle, it can analyze that iodide ion has oozed out towards the particle surface. In the analysis using the etching/TOF-SIMS method, it is preferable that the emulsion of the present invention has the concentration maximum on the particle surface, the iodide ion concentration decreases toward the inside, and the bromide ion has the concentration maximum inside the particle. The local concentration of the silver bromide can be measured also with X-ray diffractometry when the content of silver bromide is high to some extent.

In the present specification, a spherical equivalent diameter is represented with the diameter of the ball which has a volume equal to that of each particle. It is preferable that the emulsion of the invention has a particle size distribution comprised of mono dispersion particles. The variation coefficient of the spherical equivalent diameter of the whole particles is preferably 20% or less, more preferably 15% or less, most preferably 10% or less. The term "the variation coefficient of the spherical equivalent diameter" is represented by the percentage to the average of a spherical equivalent diameter of the standard deviation of the spherical equivalent diameter of each particle. At this time, for obtaining a large latitude, it is preferably performed to use the above mono dispersion emulsion by blending with the same layer or multi-layer coating.

In the silver halide emulsion, the spherical equivalent diameter of silver halide emulsion of a silver halide emulsion layer that contains a yellow dye-forming coupler is preferably 0.7 μm or less (here, preferably from 0.7 μm to 0.10 μm), more preferably 0.6 μm or less (here, preferably from 0.5 μm to 0.15 μm), most preferably 5 μm or less (here, preferably from 0.5 μm to 0.15 μm). Particularly preferable is 0.4 μm or less (here, preferably from 0.4 to 0.20 μm) in the aspect (a) of the present invention. In the aspect (c) of the present invention, it is preferably in the range from 0.7 μm to 0.30 μm, particularly in the range from 0.68 to 0.32 μm.

The spherical equivalent diameter of silver halide emulsion of a magenta dye-forming coupler-containing silver halide emulsion layer and a cyano dye-forming coupler-containing silver halide emulsion layer is 0.5 μm or less (preferably 0.5 μm to 0.1 μm), more preferably 0.4 μm or less (preferably in the range from 0.4 μm to 0.1 μm), further preferably 0.3 μm or less (preferably 0.3 μm to 0.1 μm). In the present specification, a spherical equivalent diameter is represented with the diameter of the ball which has a, volume equal to that of each particle. A particle with a spherical equivalent diameter of 0.6 μm is equivalent to the cube particle of about 0.48 μm in side length, a particle with a spherical equivalent diameter of 0.5 μm is equivalent to the cube particle of about 0.40 μm in side length, the particle with a spherical equivalent diameter of 0.4 μm is equivalent to the cube particle of about 0.32 μm in side length, and a particle with a spherical equivalent diameter of 0.3 μm is equivalent to the cube particle of 0.24 μm in side length. Silver halide particles other than those (namely, specific silver halide particles) contained in the silver halide emulsion defined in the invention may be included in the silver halide emulsion of the invention. However, silver halide emulsion defined by the invention needs to be the silver halide particle where 50% or more of the total projected area of all particles is defined by the invention, preferably 80% or more, more preferably 90% or more.

The specific silver halide particle in silver halide emulsion further includes an iridium complex in which all of six ligands consist of Cl, Br, or I, in addition to the iridium complex represented by general formula (I) and/or the general formula (II). In this case, Cl, Br, or I may be intermingled in 6 coordinated complexes. It is particularly preferable that the silver bromide-containing phase includes the iridium complex which has Cl, Br, or I as ligand in order to obtain a high contrast at a high exposure exposure. In these iridium metal complexes, it is preferred to use together with the iridium metal complex represented with the general formula (I).

The concrete examples of all six ligands consisting of Cl, Br, or I will be listed below. However, the present invention is not limited to the follows.

$[IrCl_6]^{2-}$
$[IrCl_6]^{3-}$
$[IrBr_6]^{2-}$
$[IrBr_6]^{3-}$
$[IrI_6]^{3-}$

Although other metal ions can be doped in the inside and/or on the surface of the silver halide particles in addition to the metal complexes described above in the silver halide emulsion. As a metal ion to be used, one selected from transition-metal ions is preferable. Among them, iron, ruthenium, osmium, lead, cadmium, or zinc is preferable. As for these metal ions, it is still more preferred to use as a 6 coordinated octahedron type complex with ligand. When using an inorganic compound as ligand, it is preferred to use cyanide ion, halide ion, thiocyan, a hydroxide ion, peroxide ion, azide ion, nitrite ion, water, ammonia, nitrosyl ion, or thio nitrosyl ion. It is also preferred to carry out a coordination to a metal ion selected from iron, ruthenium, osmium, lead, cadmium, and zic described above, and it is also preferred to use two or more kinds of ligands into one complex molecule. An organic compound can also be used as ligand and the carbon number of a main chain cable can mention the heterocyclic compound of five or less open chain compound and/or 5 membered rings, or 6 membered rings as a desirable organic compound. A still more preferable organic compound is a compound which has a nitrogen atom, a phosphorus atom, an oxygen atom, or a sulfur atom as a donor atom of ligand to a metal in the molecule. Particularly preferable are franc, thiophene, oxazole, isoxazole, thiazole, iso thiazole, imidazole, pyrazole, triazole, a furazan, pyran, pyridine, pyridazine, pyrimidine, and pyrazine. Furthermore, compounds in which the above compounds are provided as basic skeletons thereof and substituents are introduced in these skeletons are also preferably.

As a combination of a metal ion and a ligand, a combination of an iron ion and a ruthenium ion with a cyanide ion is preferable. In this invention, it is preferred to use together the metal complexes mentioned above and these compounds.

As for cyanide ion, in these compounds, it is preferred to get a majority among the coordination numbers to the iron or ruthenium which is a central metal As for the remaining coordination parts, it is preferred to be occupied by thiocyan, ammonia, water, nitrosyl ion, dimethyl sulfoxide, pyridine, pyrazine or 4,4-bipyridine. Most preferable is that all of six coordination parts of a central metal are occupied with cyanide ion, and they form a hexa cyano iron complex or a hexa cyano ruthenium complex. The complex which makes these cyanide ion ligand is preferably added such that a content thereof might become $1\times10^{-8}$ moles to $1\times10^{-2}$ moles, most preferably $1\times10^{-6}$ moles to $5\times10^{-4}$ moles per mole of silver.

It is preferable that the silver halide emulsion is subjected to a gold sensitization well known in the art. The gold sensitization allows to the emulsion to become high sensitive. Thus, the fluctuation of the photographic performance can be minimized when a scan exposure is performed using a laser beam or the like. In order to give gold sensitization, the gold (1) compound which has the gold (1) complex and the organic ligand which have various inorganic gold compounds and inorganic ligands can be used. As an inorganic gold compound, chloroauric acid or its salt can be used, for example. As a gold (1) complex which has inorganic ligand, compounds, such as dithio sulfuric acid gold compounds, such as dithiocyanate gold compounds, such as dithiocyanate gold (1) potassium, and Au(I)trisodium dithiosulfate, can be used, for example.

As the Au(I) compound which has an organic ligand (organic compound), one of the following compounds may be used. That is, bis-Au (I) meso-ion heterocycles described in JP-A No. 4-267249, for example, bis(1,4,5-trimethyl-1,2,4-triazolium-3-thiorate)aurate (I) tetrafluoroborate, organic mercapto gold (I) complexes described in JP-A No. 11-218870, for example, potassium bis(1-[3-(2-sulfonate benzamide) phenyl]-5-mercaptotetrazole potassium salt)aurate (I) 5-hydrate, gold (I) compound in which a nitrogen compound described in JP-A-No. 4-268550, such as sodium bis(1-methylhydantoinate)aurate (I) 4-hydrate. These Au(I) compounds having organic ligands may use those previously prepared and isolated. In addition, they may be added to an emulsion without genation and isolation, by mixing Au compound (for example, chloroauric acid and salts thereof) with organic ligand. Organic ligand and Au compound (for example, chloroauric acid and its salt) may be independently added to an emulsion, and the Au(I) compound which has organic ligand in an emulsion may be generated.

In addition, the following compounds may be used. That is, the Au(I) thiolate compound described in U.S. Pat. No. 3,503,749, and gold compounds described in JP-A Nos. 8-69074, 8-69075, and 9-269554, and compounds described in U.S. Pat. Nos. 5,620,841, 5,912, 112, 5,620,841, 5,939,245, and 5,912,111.

The addition amount of these compounds is in the range from $5\times10^{-7}$ to $5\times10^{-3}$ moles, preferably $5\times10^{-6}$ to $5\times10^{-4}$ moles per mole of silver halide, although it may change broadly according to cases.

It is also possible to use a colloid-like gold sulfide, the manufacture method is described in Research Disclosure, 37154, Solid State Ionics, vol. 79, pages 60 to 66, issued in 1995, and Compt. Rend. Hebt. Seacens Acad. Sci. Sect. B. vol. 263, page 1328, issued in 1966. Although the method of using thiocyanate ion is described in the above Research Disclosure in the case of manufacture of a colloid-like gold sulfide, thioether compounds, a thioether compound such as methionine and thio diethanol, can be used instead.

It is preferred to be able to use each of those having various sizes as a colloid-like gold sulfide, preferably with an average particle diameter of 50 nm or less, more preferably 10 nm or less, still more preferably 3 nm or less. This particle diameter can be measured from a TEM photograph. $Au_2S_1$ may be provided as the composition of colloid-like gold sulfide. It may be of the composition with superfluous sulfur like $Au_2S_1$ to $Au_2S_2$, preferably the composition with superfluous sulfur, more preferably $Au_2S_{1.1}$ to $Au_2S_{1.8}$.

The chemical composition analysis of this colloid-like gold sulfide can take out for example, a gold sulfide particle, and can calculate a gold content and a sulphuric content using analysis methods, such as ICP and iodometry, respectively.

If the gold ion and sulfur ion (hydrogen sulfide and its salt are included) which are dissolving in the liquid phase exist in gold sulfide colloid, the chemical composition analysis of a gold sulfide colloidal particle will be influenced.

Therefore, analysis is performed after ultrafiltration or the like to separate a gold sulfide particle. Although the addition of gold sulfide colloid may change broadly according to a case, the amount of the total atoms is in the range from $5\times10^{-7}$ to $5\times10^{-3}$ moles, preferably $5\times10^{-6}$ to $5\times10^{-4}$ moles per silver halide.

In combination with gold sensitization, chalcogen sensitization can also be carried out on the same molecule. In this case, the molecule which can emit AuCh may be used.

Here, Au represents Au(I) and Ch represents a sulfur atom, a selenium atom, and a tellurium atom. The molecule which can emit $AuCh^-$ may be a gold compound represented in AuCh-L. Here, L represents the atom group who combines with AuCh and constitutes a molecule. One or more other ligands may configurate with Ch-L to Au. The gold compound represented with AuCh-L has the feature which is easy to make AgAuS generate, if Ch is S, AgAuS if Ch is Se and AgAuTe if Ch is Te when it is made to react under silver ion coexistence and in a solvent. Although the compound in which L is an acyl group is mentioned as such a compound, the compounds represented by general formulae (AuCh 1), (AuCh 2), and (AuCh 3) can be exemplified $R_1$—X-M-ChAu General formula (AuCh1)

wherein, Au represents Au(I), Ch represents a sulfur atom, a selenium atom, or a tellurium atom, M represents a methylene group which is substituted or not substituted, X represents an oxygen atom, a sulfur atom, a selenium atom, or $NR_2$, and $R_1$ represents an atom group (for example, an organic group, such as an alkyl group, an aryl group, or a heterocycle group) which combines with X and constitutes a molecule. Here, $R_2$ represents a hydrogen atom or a substituent (for example, an organic group, such as an alkyl group, an aryl group, or a heterocycle group). $R_1$ and M may join together mutually and may form a ring.

In the compound represented with a general formula (AuCh 1), Ch is a sulfur atom or a selenium atom, X is an oxygen atom or the sulfur atom, and $R_1$ has an alkyl group, preferably alkyl group, and an aryl group. As a concrete example of the compound, it may be Au(I) salt (gold thioglucose such as alpha gold thioglucose, gold par acetyl thio glucose, gold thio mannose, gold thio galactose, gold thio arabinose, etc.) of thiosugar, Au(I) salt (a gold par acetyl seleno glucourse, gold par acetyl seleno mannose, etc.) of seleno sugar, Au(I) salt of telluro sugar, or the like. Here, thiosugar, seleno sugar, and telluro sugar represent the compounds in which their anomer position hydroxyl group of the sugars are replaced with a SH group, a SeH group, and a TeH group, respectively.

$W_1W_2C{=}CR_3ChAu$ General formula (AuCH 2)

wherein Au represents Au(I), ch represents a sulfur atom, a serene atom, and a tellurium atom, $R_3$ and $W_2$ represent substitute (e.g., a hydrogen atom, a halogen atom, and an organic group such as an alkyl group, aryl group, a hetero cycle group. $W_1$ represents an electron-accepting group having a positive value of Hammett's substituent constant $\sigma_p$. $R_3$ and $W_1$, $R_3$ and $W_2$, and $W_1$ and $W_2$ may form rings, respectively.

In the compound represented by general formula (AuCh 2), Ch is preferably a sulfur atom or a selenium atom, $R_3$ is preferably a hydrogen atom or an alkyl group, and $W_1$ and $W_2$ are preferably electron-accepting groups having a Hammett's substituent constant $\sigma_p$ value of 0.2 or more. A more concrete examples of the compounds include $(NC)_2{=}CHSAu$, $(CH_3OCO)_2C{=}CHSAu$, $CH_3CO(CH_3OCO)C{=}CHSAu$, and so on.

$W_3$-E-ChAu General formula (AuCh 3)

wherein, Au represents Au(I), Ch represents a sulfur atom, a selenium atom, or a tellurium atom, E represents ethylene group which is substituted or not substituted and $W_3$ represents the electron-attracting group in which a substituent constant $\sigma_p$ value of Hammett is a positive value.

In the compound expressed with a general formula (AuCh 3), it is preferred that Ch is a sulfur atom or a selenium atom. In addition, As for E, it is preferred that a Hammett's substituent constant $\sigma_p$ value is ethylene group which has the electron-accepting group which is a positive value. $W_3$ has a preferred electron-accepting group in which a Hammett's substituent constant $\sigma_p$ value is 0.2 or more. Even though the addition of these compounds may change broadly according to the case, it is in the range from $5\times10^{-7}$ to $5\times10^{-3}$ moles per mole of silver halides, preferably $3\times10^{-6}$ to $3\times10^{-4}$ moles.

The above-mentioned gold sensitization may be combined with any of other sensitization methods for silver halide emulsion, such as sulfur sensitization, selenium sensitization, tellurium sensitization, and reduction sensitization, or noble-metals sensitization which uses except the gold compound may be used. In particular, it may be preferably combined with sulfur sensitization and selenium sensitization.

Various compounds or precursors thereof can be added for the purpose of preventing fogging under the manufacturing process of a photosensitive material, conservation, or photographic processing to silver halide emulsion, or stabilizing photograph performance. The concrete examples of these compounds are preferably those described in pages 39 to 72 of JP-A No. 62-215272. 5-aryl amino 1,2,3,4-thiatriazole compound in which at least one electron-accepting group in this aryl residue, which is disclosed in EP No. 0447647, is also preferably used.

In order to raise the preservability of silver halide emulsion, the following compounds are preferably used for silver halide emulsion: a hydroxamic acid derivative disclosed in JP-A No. 11-109576, annular ketone having a double bound in which both ends are substituted with amino groups or hydroxyl group adjacent to a carbonyl group disclosed in JP-A No. 11-327094 (in particular, one represented by general formula (S1), the description in the paragraph numbers 0036 to 0071 can be incorporated herein by reference), catechol and hydroquinones of sulfonation disclosed in JP-A No. 11-143011, (for example, 4,5-dihydroxy-1,3-benzene sulfonic acid, 2,5-dihydroxy-1,4-benzene disulfonic acid, 3,4-dihydroxybenzen sulfonic acid, 2,3-dihydroxy benzenesulfonic acid, 2,5-dihydroxy benzenesulfonic acid, 3,4,5-trihydroxybenzene sulfonic acid, and salts thereof), hydroxylamines represented by general formula (A) in U.S. Pat. No. 5,556,741 (the description from lines 56 of the fourth paragraph to lines 22 of the 11th paragraph is preferably applicable to the present application, so that it is incorporated as a part of the specification of the present invention), and water soluble reducing agents represented by general formulae (I) to (III) of JP-A No. 11-102045 is preferably used in the invention.

Silver halide emulsion may contain spectral sensitization coloring matters in order to give the so-called spectral responsivity which shows photosensitivity to a desired light wave length region. The exemplified spectral sensitization coloring matters used for the spectral sensitization of blue, green, and red regions are those disclosed in "*Heterocyclic compounds-Cyanine dyes and related compound*" written by F. M. Harmer (John Wiley & Sons (New York, London, published in 1964). The concrete examples and concrete spectral sensitization method are preferably described in the right upper column of page 22 to page 38 in JP-A No. 62-215272 previously mentioned. As a red photosensitivity spectral sensitization coloring matter of a silver halide emulsion particle especially with high silver chloride content, the spectral sensitization coloring matter indicated by JP-A No. 3-123340 is dramatically preferred in terms of, such as stability, strength of adsorption, and the temperature dependency of exposure.

The addition amounts of these spectral sensitization coloring matters depend on cases and extend in broad ranges, such that the amount of each of the coloring matters is in the range from preferably $0.5\times10^{-6}$ moles to $1.0\times10^{-2}$ moles, more preferably 1.0 to $10^{-6}$ moles to $5.0\times10^{-3}$ moles.

Hereafter, a preferable embodiment of the invention to be applied to the photosensitive material will be described. The well-known material for photographs and a well-known additive can be conventionally used for the photosensitive material. For example, as a support medium for photographs, a transmission type support medium and a reflected type support medium can be used. As a transmission type support medium, preferable is an information recording layer having a magnetic layer or the like formed on a transparent film such as a cellulose nitrate film or a polyethylene telephthalate, polyester of 2,6-naphthalene dicarboxylic acid (NDCA) and ethylene glycol (EG), or polyester of NDCA, telephtalate, and EG. As a reflective support medium, it is preferably laminated with a plurality of polyethylene layers or polyester layers, wherein at least one such water-proof resin layers (laminate layers) contains a white pigments such as titanium oxide.

In this invention, a still more desirable reflective support medium is a reflective support medium which has a polyolefin layer with a minute hole on the paper base of the side on which a silver halide emulsion layer is formed.

The polyolefin layer may comprise the multilayer. In this case, the polyolefin layer, which adjoins the gelatin layer by the side of a silver halide emulsion layer does not have a minute hole (for example, polypropylene, polyethylene), but preferably, the polyolefin (for example, polypropylene, polyethylene) in a side near on a paper base has a minute hole. The density of polyolefin multilayer or single layer that are located between a paper base and a photograph constitution layer is preferably in the range from 0.40 to 1.0 g/ml, more preferably 0.50 to 0.70 g/ml. The thickness of polyolefin layer multilayer or single layer that are located between a paper base and a photograph constitution layer is preferably in the range from 10 to 100 μm, more preferably in the range from 15 to 70 μm. The thickness ratio between the polyolefin layer and the paper base is preferably in the range from 0.05 to 0.2, more preferably 0.1 to 0.15.

With the photograph constitution layer of the above-mentioned paper base, a polyolefin layer may be provided in the reverse side (back). This is preferred from the point which raises the rigidity of a reflective support medium. In this case, a polyolefin layer on the back has preferred polyethylene or polypropylene with which the surface was frosted. Polypropylene is more preferred. As for a polyolefin layer on the back, 5 to 50 μm is preferred, 10-30 μm is more preferred, and it is preferred that densities are 0.7 to 1.1 g/ml further. In the desirable embodiment about the polyolefin layer provided on a paper base in the reflective support medium in this invention, examples are described in JP-A Nos. 10-333277, 10-333278, 11-52513, 11-65024, EP No. 0880065, and EP No. 0880066.

It is further preferred to contain an fluorescent whitening agent in the water-proof resin layer. In addition, a hydrophilic colloid layer dispersedly containing said fluorescent whitening agent may be formed separately. The fluorescent whitening agent may be preferably a benzo oxazole system, coumarin or pyrazoline, and it is the fluorescent whitening agent of a benzoxazolyl naphthalene and benzoxazolyle stilbene still more preferably. Although the amount used is not limited in particular, it is preferably in the range from 1 to 100 mg/m$^2$. The mixing ratio in the case of mixing to water-proof resin is 0.0005 to 3% by weight, more preferably 0.001 to 0.5% by weight.

A reflected type support medium is a transparent type support medium, or a support medium which is covered with a hydrophilic colloid layer that contains a white pigment. The reflected type support medium may be a support medium with the surface of metal of mirror reflectivity or the second type diffusion reflectivity.

The support medium used for a photosensitive material may be a support medium where a layer containing a white polyester support medium or a white pigment for a display is provided on the side having a silver halide emulsion layer.

In order to improve sharpness, it is preferred to coat an anti halation layer on the silver halide emulsion layer-applied side of the support medium or the back thereof. It is preferred to set the transmission density of a support medium so as to be in the range from 0.35 to 0.8 so that a display can be viewed particularly under reflective light or transmission light.

The photosensitive material may be prepared by the addition of decolarizable dye (particularly, oxonol dye) such that the optical reflective density of the photosensitive material at 680 nm becomes 0.70 or more, as described in pages 27 to 76 of the specification of EP No. 0,337,490 A2, or by incorporating titanium oxide surface-treated with divalent, trivalent, or tetravalent alcohols (for example, trimethylol ethane) in a water-proof resin layer of the support medium at a concentration of 12% by weight or more (more preferably 14% by more), into a hydrophilic colloid layer for improving a sharpness and so on of an image.

In the photosensitive material, it is preferred to add decolorizable dye (even inside oxonol dye, cyanine dye) in a hydrophilic colloid layer by the process as described in pages 27 to 76 of the specification of EP No. 0,337,490 A2 for preventing the generation of irradiation and halation and improving safelight safety and so on. Furthermore, a dye disclosed in EP No. 0,819,977 may be preferably included in the invention. Some of these water-soluble dyes get worse color isolation and safe light safety when the amount used is increased. As the dye which can be used without worsening color isolation, it is preferable to use water soluble dyes disclosed in JP-A Nos. 5-127324, 5-127325, and 5-216185, respectively.

In the photosensitive material, the coloring layer which can be decolorized by the processing used together with the water soluble dye instead of water soluble dye is used.

The coloring layer which can be decolorized by the processing used directly may touch an emulsion layer, and it may be arranged so that it may touch through an intermediate layer containing processing color mixture inhibitor, such as gelatin and hydroquinone. As for this coloring layer, it is preferred to be installed in the lower layer (support-medium side) of the emulsion layer which colors in the colored color and color primaries of the same kind. It is also possible to arrange separately all the coloring layers that correspond for every color primary. Among them, only a part thereof may be selected arbitrarily and arranged. It is also possible to install the coloring layer which performed coloring corresponding to two or more color-primaries regions. As for the optical reflection density of a coloring layer, in the wavelength band (wave length of the scan exposure luminous source which is used in the usual printer exposure in a 400 nm to 700 nm visible light area and scan exposure) used for exposure, it is preferred that the optical density value in wave length with the highest optical density is 0.2 or more and 3.0 or less. It is more preferably in the range from 0.5 to 2.5, particularly preferable in the range from 0.8 to 2.0.

In order to form a coloring layer, a well-known method is conventionally applicable. For example, there is a method in which, like a dye described in JP-A No. 2-282244 (from page 3, upper right column to page 8), or a dye described in JP-A No. 3-7931 (page 3, upper right column to page 11, left lower column), the dye is contained in a hydrophilic colloid layer while being in the state of a solid fine particle dispersing element, a method of treating cation polymers with a mordant of anionic pigments, a method of making coloring matter stick to molecules, such as a silver halide, and fixing in a layer, a method of using a colloid silver as described in JP-A No. 1-239544, or the like. As a method of distributing the fine powders of coloring matter by the shape of a solid body, at least, although it is water insoluble substantially, the method of incorporating fine powder dye is described in pages 4 to 13 of JP-A No. 2-308244, where the dye becomes substantially water-insoluble at least pH6 or less or becomes substantially water-soluble at least pH 8 or more. For example, as a method of mordanting anion coloring matter to cation polymer, it is described in pages 18 to 26 in JP-A No. 2-84637. The method of preparation of the colloidal silver as an optical absorption agent is shown in the U.S. Pat. Nos. 2,688,601 and 3,459,563. Among these methods, a method of incorporating fine particle dye, a method of using colloidal silver, or the like may be preferable.

Although a photosensitive material is used for a negative color film, a color positive film, a color reversal film, color inversion printing paper, color-printing paper, and so on, it is preferable to be used as color-printing paper. The color-printing paper preferably includes at least one yellow coloring silver halide emulsion layer, at least one magenta coloring silver halide emulsion layer, and at least one cyan coloring silver halide emulsion layer at a time, respectively. Generally, these silver halide emulsion layers are a yellow coloring silver halide emulsion layer, a magenta coloring silver halide emulsion layer, and a cyan coloring silver halide emulsion layer in order of nearness from a support medium.

However, different lamination from this may be taken. The silver halide emulsion layer containing a yellow coupler may be arranged in any location on a support medium. However, when it contains a silver halide monotonous particle in this yellow coupler content layer, the silver halide emulsion layer containing a yellow coupler is preferably coated at the location which is further distant from a support medium with respect to at least one of a magenta coupler content silver halide emulsion layer or a cyan coupler content silver halide emulsion layer. As for a yellow coupler content silver halide emulsion layer, from a viewpoint of color development acceleration, desilverization acceleration, and abatement of remaining color by sensitizing dye, it is preferably coated at the most distant location from the support medium with respect to other silver halide emulsion layers. The cyan coupler content silver halide emulsion layer from a viewpoint of abatement of Blix fading has the preferred layer of the center of other silver halide emulsion layers, and a cyan coupler content silver halide emulsion layer has the preferred lowest layer from a viewpoint of abatement of photo fading. Each coloring layer of yellow, magenta, and cyan may consist of two layers or three layers. For example, as is described in JP-A Nos. 4-75055, 9-114035, and 10-246940 and U.S. Pat. No. 5,576,159, it is also preferable to provide a copular layer that does not contain a sliver halide emulsion such that the coupler layer adjoins the silver halide emulsion layer, as a coloring layer.

The silver halide emulsion and other raw materials (additives and so on) and the photographic constitution layer (layer arrangement and so on), to be applied in the invention, and also the processing method to be used for treating the photosensitive material and additives for the processing are described in the documents such as JP-A Nos. 62-215272 and 2-33144, EP No. 0,355,660 A2. In particular, one described in EP No. 0,355,660 A2 is preferable. Further, the silver halide color photosensitive materials and the processing methods thereof are preferably indicated by the following references: JP-A Nos. 5-34889, 4-359249, 4-313753, 4-270344, 5-66527, 4-34548, 4-145433, 2-854, 1-158431, 2-90145, 3-194539, and 2-93641, and EP No. 0,520,457 A2.

Especially, in this invention, reflected type support medium, silver halide emulsion, dissimilar metal ion species doped in a silver halide particle, conservation stabilizer or fogging inhibitor of silver halide emulsion, chemical sensitization method (sensitizer), spectral sensitization method (spectral sensitization agent), cyan, magenta, and yellow coupler and the method of emulsifying and dispersing thereof, a color-image preservability improving agent (stain inhibitor and fading inhibitor), dye (coloring layer), gelatin species, the layer constitution of photosensitive material, and the coating pH of photosensitive material are preferably applied. These materials are described in the patent documents listed in Table 1 below.

TABLE 1

| Elements | JP-A No. 7-104448 | JP-A No. 7-77775 | JP-A No. 7-301895 |
|---|---|---|---|
| Reflected type support medium | cl. 7 ln. 12-cl. 12 ln. 19 | cl. 35 ln. 43-cl. 44 ln. 1 | cl. 5 ln. 40-cl. 9 ln. 26 |
| Silver halide emulsion | cl. 72 ln. 29-cl. 74 ln. 18 | cl. 44 ln. 36-cl. 46 ln. 29 | cl. 77 ln. 48-cl. 80 ln. 28 |
| Dissimilar metal ion species | cl. 74 ln. 19-cl. 74 ln. 44 | cl. 46 ln. 30-cl. 47 ln. 5 | cl. 80 ln. 29-cl. 81 ln. 6 |
| Conservation stabilizer or fogging inhibitor | cl. 75 ln. 9-cl. 75 ln. 18 | cl. 47 ln. 20-cl. 47 ln. 29 | cl. 18 ln. 11-cl. 31 ln. 37 (Particularly, mercaptohetero ring compound) |
| Chemical sensitization method (chemical sensitizer) | cl. 74 ln.45-cl. 75 ln. 6 | cl. 47 ln. 7-cl. 47 ln. 17 | cl. 81 ln. 9-cl. 81 ln. 17 |

TABLE 1-continued

| Elements | JP-A No. 7-104448 | JP-A No. 7-77775 | JP-A No. 7-301895 |
|---|---|---|---|
| Spectral sensitization method (spectral sensitization agent) | cl. 75 ln. 19-cl. 76 ln. 45 | cl. 47 ln. 30-cl. 49 ln. 6 | cl. 81 ln.21-cl. 82 ln. 48 |
| Cyan coupler | cl. 12 ln. 20-cl. 39 ln. 49 | cl. 62 ln. 50-cl. 63 ln. 16 | cl. 88 ln. 49-cl. 89 ln. 16 |
| Yellow coupler | cl. 87 ln. 40-cl. 88 ln. 3 | cl. 63 ln. 17-cl. 63 ln. 30 | cl. 89 ln. 17-cl. 89 ln. 30 |
| Magenta coupler | cl. 88 ln. 4-cl. 88 ln. 18 | cl. 63 ln. 3-cl. 64 ln. 11 | cl. 31 ln. 34-cl. 77 ln. 44 and cl. 88 ln. 32-cl. 88 ln. 46 |
| The emulsification dispersion method of a coupler | cl. 71 ln. 3-cl. 72 ln. 11 | cl. 61 ln. 36-cl. 61 ln. 49 | cl. 87 ln. 35-cl. 87 ln. 48 |
| color-sensitizing preservability amelioration agent (stain inhibitor) | cl. 39 ln. 50-cl. 70 ln. 9 | cl. 61 ln. 50-cl. 62 ln. 49 | cl. 87 ln. 49-cl. 88 ln. 48 |
| Brown inhibitor | cl. 70 ln. 10-cl. 71 ln. 2 | | |
| Dye (coloring agent) | cl. 77 ln. 42-cl. 78 ln. 41 | cl. 7 ln. 14-cl. 19 ln. 42 and cl. 50 ln. 3-cl. 51 ln. 14 | cl. 9 ln. 27-cl. 18 ln. 10 |
| Gelatin species | cl. 78 ln. 42-cl. 78 ln. 48 | cl. 51 ln. 15-cl. 51 ln. 20 | cl. 83 ln. 13-cl. 83 ln. 19 |
| Lamination of an admiration agent | cl. 39 ln. 11-cl. 39 ln. 26 | cl. 44 ln. 2-cl. 44 ln. 35 | cl. 31 ln. 38-cl. 32 ln. 33 |
| The tunic pH of an admiration agent | cl. 72 ln. 12-cl. 72 ln. 28 | | |
| Scan exposure | cl. 76 ln. 6-cl. 77 ln. 41 | cl. 49 ln. 7-cl. 50 ln. 2 | cl. 82 ln. 49-cl. 83 ln. 12 |
| Stability in a developing solution | cl. 88 ln. 19-cl. 89 ln. 22 | | |

Furthermore, preferable cyan, magenta, and yellow couplers to be used in the invention are further described in right upper column, line 4 to left upper column, line 6 of page 91 JP-A No. 62-215272, right upper column, line 14 of page 3 to left upper column, last line of page 18 and right upper column, line 6 of page 30 to right lower column, line 11 of page 35 of JP-A No. 2-33144, and lines 15 to 27 of page 4, line 30 of page 5 to last line of page 28, lines 29 to 31 of page 45, and line 23 of page 47 to line 50 of page 63 of EP No. 0,355,660 A2.

Furthermore, in the invention, the compounds represented by general formulae (II) and (III) of WO 98/33760 and the general formula (D) of JP-A No. 10-221825 may be preferably added. An available cyan dye-forming coupler (it may only be called a "cyan coupler") to be used in the present invention is preferably a pyrrolo triazole coupler. In particular, a coupler represented by general formula (I) or (II) of JP-A No. 5-313324 and a coupler represented in the general formula (I) by JP-A No. 6-347960, and the exemplified couplers described in these patent documents are preferable. The phenol and naphtol cyan couplers are also preferred, for example, the cyan coupler represented by general formula (ADF) of the publication of JP-A No. 10-333297. As cyan couplers other than the above, there is a pyrrolo azole type cyan coupler disclosed in the EP No. 0,488,248 and EP No. 0,491,197 A1, and also there is 2,5-diacyl aminophenol coupler disclsoed in U.S. Pat. No. 5,888,716. Furthermore, pyllozoloazole type cyan coupler having an electron-accepting group and a hydrogen-binding group at 6-position thereof discribed in U.S. Pat. Nos. 4,873,183 and 4,916,051. In particular, the pyllazoloazole type cyan coupler having a carbamoyl group in the 6 position disclosed in JP-A Nos. 8-171185, 8-311360, and 8-339060 are also preferred.

In addition to a diphenyl imidazole cyan coupler disclosed in JP-A No. 2-33144, 3-hydroxypyridine cyan coupler disclosed in EP No. 0,333,185 A2 is also preferred (among them, the fourth equivalent coupler of the coupler (42) listed as a concrete example is modified to the second equivalent coupler by providing it with a chlorine leaving group. Especially a coupler (6) and (9) are preferred.) The cyclic active methylene cyan coupler indicated by JP-A 64-32260 is also preferred (among them, the examples 3, 8, and 34 of a coupler listed as concrete examples are especially preferred). The pyrrolo pyrazole type cyan coupler described in EP No. 0,456,226 A1 and the pyrrolo imidazole type cyan coupler described in EP No. 0484909 are also used in the invention.

Among them, the pyrroloazole cyan coupler represented by general formula (I) described in JP-A No. 11-282138 is particularly preferred. The description in the column numbers 0012 to 0059 of this patent in addition to the exemplified cyan couplers (1) to (47) may be directly applied to the present invention and will be favorably incorporated herein as a part of the specification of the present application.

As a magenta dye-forming coupler (it may also be referred to as a "magenta coupler") used for this invention, 5-pyrazolone magenta coupler and apyrazolo azole magenta coupler indicated by the well-known reference of the above-mentioned table are used. Among them, pyrazolotriazole coupler in which secondary or tertially alkyl group is coupled with 2, 3, or 6 positions of the pyrazorotriazole ring is preferable in terms of color hue, image stability, coloring properties, and so on as described in JP-A No. 61-65245.

The pyrazolo azole coupler which contains the sulfonamide group in its molecule thereof described in JP-A No. 61-65246 is also preferred. Apyrazolo azole coupler with an alkoxy phenyl sulfonamide ballast group described in JP-A No. 61-147254 is also preferred. Pyrazolo azole coupler having an alkoxy group and an aryl oxy-group in the 6th position which was indicated by EP Nos. 226,849A and 294,785A is preferred.

The pyrazolo azole coupler represented by general formula (M-1) of a publication to JP-A No. 8-122984 as a magenta coupler is especially preferred. The paragraph numbers 0009 to 0026 of this patent are incorporated herein by referece as a part of the specification of the present invention.

In addition, the pyrazolo azole coupler having a steric hindrance group is also preferably used for both the 3rd position and the 6th position described in EP Nos. 854384 and 884640.

As a yellow dye-forming coupler (it may be also referred to as "a yellow coupler"), in addition to the compouonds described in the above table, an acyl acetamide type yellow coupler having the ring structure of 3 to 5 members at an acyl group disclosed in EP No. 0447969 A1, malone dianilide type yellow coupler having the ring structure disclosed in EP No. 0,482,552 A1, pyrrole-2- or 3-il or indole-2 or 3-il carbonyl acetate anilide coupler disclosed in EP Nos. 0,953,870A1, 0,953,871 A1, 0,953872 A1, 0,953,873 A1, 0,953,874A1, and 0,953,875A1, acyl acetamide type yellow coupler having the dioxane construction described in U.S. Pat. No. 5,118,599 are preferably used. Among them, acylacetoaminde yellow coupler in which an acyl group is 1-alkyl cyclopropane-1-carbonyl group, and malone dianilide type yellow coupler with which one side of anilide constitutes an indorine ring is especially preferred. These couplers may be used independently or in combination.

The coupler used for this invention is immigrated in loader bull latex polymer (for example, U.S. Pat. No. 4,203,716) is infiltrated in the presence (or absence) of the high boiling point organic solvent described in the above table. Alternatively, it melts with a water-insoluble and organic solvent-soluble polymer, so that the coupler can be preferably emulsified and dispersed in a hydrophilic colloid aqueous solution. The water-insoluble and organic solvent-soluble polymer may be a single monomer or a copolymer described in columns 7 to 15 of U.S. Pat. No. 4,857,449 and pages 12 to 30 of WO88/00723. More preferably, a methacrylate or acrylamide polymer, particularly acrylamide polymer is more preferably for providing a color image stability or the like.

The well-known color mixture inhibitors can be used for a sensitive material, among which those given in the patent and listed below are preferred. For example, the redox compound of the amount of macromolecules described in JP-A No. 5-333501, phenidone and a hydrazine compounds described in WO No. 98/33760, U.S. Pat. No. 4,923,787, and so on, and white coupler disclosed in JP-A Nos. 5-249637, 10-282615, and GP No. 19,629,142 A1, and so on. Especially when raising pH of developing solution and rapidening development, it is also preferred to use the redox compound disclosed in GP No. 19,618,786 A1, EP Nos. 839,623 A1, 842,975 A1, GP No. 19,806,846 A1, FP No. 2,760,460 A1, and so on.

It is preferable to use a compound having triazine skeleton with a molar absorptivity high as a UV absorber as a photosensitive material. For example, those described in the following patent documents may be used.

These are preferably added in a photosensitive layer or/and a non-photosensitive layer. For example, the compounds described in JP-A Nos. 46-3335, 55-152776, 5-197074, 5-232630, 5-307232, 6-211813, 8-53427, 8-234364, 8-239368, 9-31067, 10-115898, 10-147577, 10-182621, GP No. 19,739,797 A, EP No. 0,711,804 A, JP-W No. 8-501291, and so on can be used.

It is advantageous to use gelatin as a binder which can be used for a photosensitive material, or protective colloid. However, it may be used independently or in combination with gelatin. As desirable gelatin, heavy metals contained as impurities, such as iron, copper, zinc, and manganese may be preferably 5 ppm or less, further preferable 3 ppm or less.

The content of calcium in the photosensitive material is preferably 20 mg/m$^2$ or less, more preferably 10 mg/m$^2$ or less, most preferably 5 mg/m$^2$ or less.

In order to prevent the growth of various kinds of microorganisms and bacteria in the hydrophilic colloid layer, the photosensitive material may preferably contain any fungicide or bactericide as described in JP-A No. 63-271247. Furthermore, the coating-film pH of the photosensitive material is preferably 4.0 to 7.0, more preferably 4.0 to 6.5.

The total amount of coating gelatin in the photograph constitution layer in photosensitive material is preferably in the range from 3 g/m$^2$ to 6 g/m$^2$, more preferably in the range from 3 g/m$^2$ to 5 g/m$^2$. Even when ultra-rapid processing is carried out, in order to satisfy development progressiveness and fixing bleaching, and remaining color, it is preferred that the thickness of the whole photograph constitution layer is 3 μm to 7.5 μm, more preferably 3 μm to 6.5 μm. The valuation method of desiccation thickness can be measured by the variation of the thickness before and after desiccation film exfoliation, or observation with the optical microscope and electron microscope of a cross section. In this invention, since it is compatible in gathering development progressiveness and a drying rate, it is preferred that swelling thickness is 8 μm to 19 μm, more preferably 9 μm to 18 μm. Measurement of swelling thickness can be performed by the RBI method. That is, the dried photosensitive material is dipped into an aqueous solution at 35° C. and the RBI method is performed in a state of being swelled and sufficiently reached at equilibrium. The total amount of the silver in the photograph constitution layer in photosensitive material, it is preferably in the range from 0.2 g/m$^2$ to 0.5 g/m$^2$, more preferably in the range from 0.2 g/m$^2$ to 0.45 g/m$^2$, most preferably in the range from 0.2 g/m$^2$ to 0.40 g/m$^2$.

In the photosensitive material, a surfactant may be added for improving a coating stability, preventing the generation of static electricity, regulating electrification, and so on. The surfactant is selected from anion surfactants, cation surfactants, betaine surfactants, and nonion surfactants, for example those described in JP-A No. 5-333492. The surfactant to be used in the present invention is preferably one that contains fluorine atoms. In particular, such a fluorine-containing surfactant can be used preferably. Furthermore, the fluorine-containing surfactant may be used alone or in combination with other surfactant well known in the art. Preferably it is used in combination with other surfactant well known in the art. The addition amount of the conventional surfactant into the photosensitive material is not limited in particular. However, in general, it is $1\times10^{-5}$ to 1 g/m$^2$, preferably $1\times10^{-4}$ to $1\times10^{-1}$ g/m$^2$, more preferably $1\times10^{-3}$ to $1\times10^{-2}$ g/m$^2$.

Hereinafter, the image formation method using the above silver halide photosensitive material for color photograph will be described. The image formation method using a sensitive material comprises the exposure production process in which light is irradiated on the photosensitive material according to image information, and the developing process in which the light-irradiated photosensitive material is developed. Especially this invention has rapid treatment aptitude, i.e., the aptitude over the treatment which starts color development in nine or less seconds after image-like exposure to perform image formation. In the present invention (particularly in the aspects (a) and (c) of the present invention), there is provided, advantageously, a rapid processivity in that the color development is completed within 28 seconds.

The present invention is suitable for a scanning exposure system using a cathode ray (CRT) in addition to be used in a print system using a usual negative printer. A cathode electrode exposing device is simple and compact, compared with a device using a laser, so that it will be provided at reductive cost.

In addition, adjustment of an optical axis or a color are also easy. The various luminous bodies which show luminescence to a spectral region if needed are used for the cathode-ray tube used for image exposure. For example, any one or two or more of a red luminous body, a green luminous body, and a blue luminous body are used alone or in combination. A spectral region is not limited to the above red, green, and blue, but an additional luminous body that emits light to yellow, orange, or purple, or an infrared region is also used. Especially, the cathode-ray tube which mixes these luminous bodies and emits light white is often used.

When the photosensitive material has a plurality of photosensitive layers having different spectral response distribution and the cathode ray tube also has luminous bodies that show exposure in a plurality of spectrum regions, a plurality of colors can be exposed at once, i.e., image signals corresponding to a plurality of colors may be transferred into the cathode electrode tube to allow the exposure from the tube surface. Furthermore, the picture signal for every color is inputted one by one, and each color is made to emit light one by one. The method of exposing through the film which cuts colors other than the desired color may be adopted (field sequential exposure). Generally, field sequential exposure can use the cathode-ray tube of high resolution. Therefore, it is desirable for obtaining a high image quality.

In this invention, the digital scanning exposure method using monochrome high-density light, such as a gas laser, a light emitting diode, a semiconductor laser, or a second harmonic luminescence light source (SHG) that combines a semiconductor laser, or a solid state laser using a semiconductor laser as an excitation light source, and a nonlinear optics crystal, is used preferably. In this case, may be a semiconductor laser. In order to make a system compact and cost reductive, it is preferred to use the second harmonic generation light source (SHG) which combines the semiconductor laser, the semiconductor laser or the solid laser, and the nonlinear optics crystal. It is especially compact, in order to design cost reductive and an extremely stable device with still longer life time, the use of a semiconductor laser is preferred, and as for at least one of the exposure light sources, it is preferred to use a semiconductor laser.

When using such a scan exposure luminous source, the spectral responsivity maximum wave length of the photosensitive material of this invention can set up arbitrarily with the wave length of the luminous source for scan exposure to be used. In the SHG light source acquired by combining the solid state laser which uses the semiconductor laser for the excitation light source, or the semiconductor laser, and a nonlinear optics crystal, since oscillation wavelength of a laser is made half, blue light and green light are obtained.

Therefore, the spectral reactivity maximum of photosensitive material can give the usual three wave length areas, blue, green, and red. When the exposure time in such scanning exposure is defined as time to expose the pixel size at the time of setting a pixel density to 400 dpi, it is preferably $10^{-4}$ or less seconds, more preferably $10^{-6}$ or less seconds as the desirable exposure time.

In the present invention, it is preferred to image-like expose the photosensitive material by the coherent light of the blue laser with a light-emitting wave length of 420 nm to 460 nm. Among the blue lasers, a blue semiconductor laser will be particularly preferred.

As the concrete examples of the laser source preferably used are a blue semiconductor laser with a light-emitting wave length of 430 to 450 nm (announced by Nichia Corporation on the 48th Spring Meeting of the Japan Society of Applied Physics and Related Societies held on March, 2001), a blue laser at a wavelength of about 470 nm pulled out by performing a wavelength conversion of a semiconductor laser (an oscillation wavelength of about 940 nm) using a SHG crystal of $LiNbO_3$ having a waveguide-like reverse domain structure, a green laser at a wavelength of about 530 nm pulled out by performing a wavelength conversion of a semiconductor laser (an oscillation wavelength of about 1060 nm) using a SHG crystal of $LiNbO_3$ having a waveguide-like reverse domain structure, a red semiconductor laser at a wave length of about 685 nm (Hitachi Type No. HL6738MG), a red semiconductor laser at a wavelength of about 650 nm (Hitachi Type No. HL6501MG), and so on.

In this invention, the semiconductor layer optical source can be used in combination with an exposure system and a developing system such as those described below. As a developing system, automatic print and developing system disclosed in JP-A No. 10-333253, a photosensitive material transfer system disclosed in JP-A No. 2000-10206, a recording system having an image reader disclosed in JP-A No. 11-215312, an exposure system based on a color image recording system described in JP-A Nos.11-88619 10-202950, a digital photo print system including a remote diagnostic system disclosed in JP-A No. 10-210206, and a photo print system including an image recording device disclosed in JP-A No. 10-159187.

Here, according to the aspect (b) of the present invention, it is preferable that the above photosensitive material is used and is then subjected to a scan exposure with exposure light sources, where at least one of the exposure light source is a blue laser at a light-emitting wavelength of 420 nm to 460 nm. In this case, an image-like exposure is performed by coherent light of the blue laser, so that the effects of the present application can be effectively generated at the time of exposing with the above light-emitting wavelength. In the present invention, among the blue lasers, it is particularly preferable to use a blue semiconductor laser. Furthermore, in the aspect (b) of the present invention, the light-emitting wavelength is in the range from 430 to 450 nm for emphasizing the effects of the present invention.

In this invention, the above-mentioned photosensitive materials are used, and color development is started within 9 seconds after exposing as mentioned above.

In the above, the time (the so-called latent image time) from exposure to initiation of color development is 9 seconds or less (preferably in the range from 0.1 to 9 seconds), and when the color development is carried out in such a short time, the effects of this invention can be generated. More preferably, more effective results can be obtained within a time of 6 seconds or less (in the range from 0.1 to 6 seconds). The system in which the exposure device and the processing device are isolated from each other does not exert the effects of the present invention because the latent image time becomes long. On the hand, the system, in which a total time period required for printing is shortened using a printer having an integrated combination of an exposure device and a processing device, exerts the effects of the present invention.

The photosensitive material may be preferably used in combination with the exposure and developing systems disclosed in the following publications. As the developing system, an automatic print and developing system disclosed in JP-A No. 10-333253, a photosensitive material transfer device disclosed in JP-A No. 2000-10206, a recording system having an image reader disclosed in JP-A No. 11-215312, an exposure system based on a color image recording system described in JP-A Nos. 11-88619 10-202950, a digital photo print system including a remote diagnostic system disclosed in JP-A No. 10-210206, and a photo print system including an image recording device disclosed in Japanese Patent Application Laid-Open (JP-A) No. 2000-310822.

A preferable scan exposure system to be applied in the present invention is described in detail in the patents listed in the table described above.

In the present invention, as disclosed in EP No. 0,789,270 A1 and EP No. 0,789,480 A1, before providing an image information, the copy restriction may be performed by pre-exposing a yellow micro dot pattern.

As a process for processing a photosensitive material, raw materials and method for the processing described in JP-A 2-207250 (right lower column, 1st line of page 26 to right upper column, line 9 of page 34 in the specification) and JP-A-4-97355 (left upper column, line 17 of page 5 to right lower column of page 18 in the specification) are preferably used. In addition, a stabilizer to be used in this developer is preferably selected from those described in the patents listed in the table described above.

The present invention is also applied as a photosensitive material having rapid processivity. As stated above, the color developing time is preferably 28 seconds or less (preferably in the range from 6 to 28 seconds), more preferably in the range from 6 to 25 seconds, still more preferably in the range from 6 to 20 seconds. After the color development, it is preferable to perform washing with water or stabilization, and drying steps after bleach-fixation (or bleaching and fixing). Here, the time required for bleach-fixation is preferably 30 seconds or less (preferably in the range from 6 to 30 seconds), more preferably in the range from 6 to 25 seconds, still more preferably in the range from 6 to 20 seconds. Furthermore, the washing or stabilization time is preferably 60 seconds or less (preferably in the range from 6 to 60 seconds) more preferably in the range from 6 to 40 seconds. Here, the term "color developing time" means a time period after the photosensitive material enters into a color development liquid until the photosensitive material is brought into a bleach-fixation bath in the following processing process. For example, when the processing is performed in the automatic developing device or the like, the color developing time is a total of the time period when the photosensitive material is immersed in a color development liquid (i.e., the time period of being in the liquid) and the time period when the photosensitive material is in the air after pulling out of the color development liquid until being immersed in the bleaching fixation bath in the following processing step (i.e., the time period of being in the air). Similarly, the term "bleach-fixation time" means time after photosensitive materials enter into a bleach-fixation bath until it goes into a next flush or a next stable bath. Furthermore, the term "washing or stabilizing time" means a time period of being placed in the liquid for washing or stabilizing the photosensitive material before the drying step (i.e., the time period of being in the liquid).

As methods for developing photosensitive materials after exposure, wet methods such as a developing method using a developer which contains an alkali agent and a developing agent (preferably, p-phenylenediamine developing agent) and a developing method using an activator solution such as an alkali solution that does not contain a developing agent while a developing agent being contained in a photosensitive material applied thereto, thermal developing methods, and the like are known in the art. The present invention is applied to the conventional method using a developer which contains an alkali agent and a developing agent. Preferable examples thereof include a method disclosed in line 1 in page 26, right lower column to line 9 in page 34, right upper column of JP-A No. 2-207250, that is preferably incorporated into the present application by reference.

Here, preferable embodiments of the aspects (a), (b), and (c) of the present invention will be described, respectively.

Preferable Examples of the Aspect (a)

(a-1): An image forming method comprising the steps of:

exposing a silver halide color photosensitive material;

beginning to subject the exposed silver halide color photosensitive material to a color development within nine seconds of the exposure; and completing the color development within 28 seconds, wherein the silver halide color photosensitive material comprises:

a support; and a photograph constitution layer provided on the support, and including at least one layer that comprises a yellow dye-forming coupler, at least one layer that comprises a magenta dye-forming coupler, at least one layer that comprises a cyan dye-forming coupler, and at least one non-photosensitive hydrophilic colloid layer, wherein the coupler-comprising layers respectively include silver halide emulsions, and at least one of the silver halide emulsions has the following characteristics:

(i) a silver chloride content of 90 mol % or more; and (ii) contains at least one metal complex represented by general formula (I).

(a-2): An image forming method comprising the steps of:

exposing a silver halide color photosensitive material;

beginning to subject the exposed silver halide color photosensitive material to a color development within nine seconds of the exposure; and completing the color development within 28 seconds, wherein the silver halide color photosensitive material comprises:

a support; and a photograph constitution layer provided on the support, and including at least one layer that comprises a yellow dye-forming coupler, at least one layer that comprises a magenta dye-forming coupler, at least one layer that comprises a cyan dye-forming coupler, and at least one non-photosensitive hydrophilic colloid layer, wherein the coupler-comprising layers respectively include silver halide emulsions, and at least one of the silver halide emulsions has the following characteristics:

(i) a silver chloride content of 90 mol % or more; and (ii) contains at least one metal complex represented by general formula (II).

(a-3): An image forming method comprising the steps of:

exposing a silver halide color photosensitive material;

beginning to subject the exposed silver halide color photosensitive material to a color development within nine seconds of the exposure; and completing the color development within 28 seconds, wherein the silver halide color photosensitive material comprises:

a support; and a photograph constitution layer provided on the support, and including at least one layer that comprises a yellow dye-forming coupler, at least one layer that comprises a magenta dye-forming coupler, at least one layer that comprises a cyan dye-forming coupler, and at least one non-photosensitive hydrophilic colloid layer, wherein the coupler-comprising layers respectively include silver halide emulsions, and at least one of the silver halide emulsions has the following characteristics:

(i) a silver chloride content of 90 mol % or more; and (ii) contains at least one metal complex represented by general formula (I)and at least one metal complex represented by general formula (II).

(a-4): A silver halide color photosensitive material for being subjected to color development within nine seconds of being exposed and being completed the color development within 28 seconds, the material comprising:

a support; and a photograph constitution layer provided on the support, and including at least one layer that comprises a yellow dye-forming coupler, at least one layer that comprises a magenta dye-forming coupler, at least one layer that comprises a cyan dye-forming coupler, and at least one non-photosensitive hydrophilic colloid layer, wherein the coupler-comprising layers respectively include silver halide emulsions, and at least one of the silver halide emulsions has the following characteristics:

(i) a silver chloride content of 90 mol % or more; and (ii) contains at least one metal complex represented by general formula (II).

(a-5): A silver halide color photosensitive material for being subjected to color development within nine seconds of being exposed and being completed the color development within 28 seconds, the material comprising:

a support; and a photograph constitution layer provided on the support, and including at least one layer that comprises a yellow dye-forming coupler, at least one layer that comprises a magenta dye-forming coupler, at least one layer that comprises a cyan dye-forming coupler, and at least one non-photosensitive hydrophilic colloid layer, wherein the coupler-comprising layers respectively include silver halide emulsions, and at least one of the silver halide emulsions has the following characteristics:

(i) a silver chloride content of 90 mol % or more; and (ii) contains at least one metal complex represented by general formula (II).

(a-6): A silver halide color photosensitive material for being subjected to color development within nine seconds of being exposed and being completed the color development within 28 seconds, the material comprising:

a support; and a photograph constitution layer provided on the support, and including at least one layer that comprises a yellow dye-forming coupler, at least one layer that comprises a magenta dye-forming coupler, at least one layer that comprises a cyan dye-forming coupler, and at least one non-photosensitive hydrophilic colloid layer, wherein the coupler-comprising layers respectively include silver halide emulsions, and at least one of the silver halide emulsions has the following characteristics:

(i) a silver chloride content of 90 mol % or more; and (ii) contains at least one metal complex represented by general formula (II).

(a-7) A silver halide color photosensitive material as described in (a-4) or (a-6), wherein the metal complex represented by general formula (I) is a metal complex represented by general formula (IA).

(a-8) A silver halide color photosensitive material as described in (a-4) or (a-6), wherein the metal complex represented by general formula (I) is a metal complex represented by general formula (IB).

(a-9) A silver halide color photosensitive material as described in (a-4) or (a-6), wherein the metal complex represented by general formula (I) is a metal complex represented by general formula (IC).

(a-10): A silver halide color photosensitive material as described in (a-4) or (a-6), wherein the metal complex represented by general formula (I) is a metal complex represented by general formula (ID).

(a-11): A silver halide color photosensitive material as described in (a-5) or (a-6), wherein the metal complex represented by general formula (II) is a metal complex represented by general formula (IIA).

(a-12): A silver halide color photosensitive material as described in (a-6), wherein the metal complex represented by general formula (I) is a metal complex represented by general formula (IA) and the metal complex represented by general formula (II) is a metal complex represented by general formula (IIA).

(a-13): A silver halide color photosensitive material as described in (a-6), wherein the metal complex represented by general formula (I) is a metal complex represented by general formula (IB) and the metal complex represented by general formula (II) is a metal complex represented by general formula (IIA).

(a-14): A silver halide color photosensitive material as described in (a-6), wherein the metal complex represented by general formula (I) is a metal complex represented by general formula (IC) and the metal complex represented by general formula (II) is a metal complex represented by general formula (IIA).

(a-15) A silver halide color photosensitive material as described in (a-6), wherein the metal complex represented by general formula (I) is a metal complex represented by general formula (ID) and the metal complex represented by general formula (II) is a metal complex represented by general formula (IIA).

(a-16) A silver halide color photosensitive material as described in any of (a-4) to (a-15), wherein the total amount of the silver contained in the photograph constitution layer is in a range from 0.2 $g/m^2$ to 0.5 $g/m^2$.

(a-17) A silver halide color photosensitive material as described in any of (a-4) to (a-16), wherein the total amount of the gelatin contained in the photograph constitution layer is in a range from 3 $g/m^2$ to 6 $g/m^2$.

(a-18) A silver halide color photosensitive material as described in any of (a-4) to (a-17), wherein the silver halide emulsion in the silver halide emulsion layer containing the yellow dye-forming coupler is a silver halide emulsion having a spherical equivalent diameter of 0.6 μm.

(a-19): A silver halide color photosensitive material as described in any of (a-4) to (a-18), wherein the silver halide emulsion in the silver halide emulsion layer further containing 0.1 to 7 mol % of silver bromide, and forming a silver bromide-containing phase having the concentration of silver bromide higher than that of its surroundings in a silver halide emulsion particle.

(a-20): A silver halide color photosensitive material as described in any of (a-4) to (a-19), wherein the silver halide emulsion in the silver halide emulsion layer containing 0.02 to 1 mol % of silver iodide, and forming a silver bromide-containing phase with the concentration of silver iodide higher than that of its surroundings in a silver halide emulsion particle.

(a-21) An image forming method, wherein a silver halide color photosensitive material described in any of (a-4) to (a-20) is subjected to an image-like exposure using a laser scanning exposure.

(a-22) An image forming method, wherein a silver halide color photosensitive material described in one of (a-4) to (a-20) is subjected to an image-like exposure using a scanning exposure with a blue semiconductor laser at a light-emitting wavelength of 420 nm to 460 nm.

Preferable Examples of the Aspect (b)

(b-1): An image forming method comprising the steps of:

exposing a silver halide color photosensitive material; and beginning to subject the exposed silver halide color photosensitive material to a color development within nine seconds of the exposure, wherein the exposing step is a scanning exposure step conducted by using exposure sources including at least one blue laser having a wavelength from 420 nm to 460 nm, and wherein the silver halide color photosensitive material comprises:

a support; and a photograph constitution layer provided on the support, and including at least one layer that comprises a yellow dye-forming coupler, at least one layer that comprises a magenta dye-forming coupler, at least one layer that comprises a cyan dye-forming coupler, and at least one non-photosensitive hydrophilic colloid layer, wherein the coupler-comprising layers respectively include silver halide emulsions, and at least one of the silver halide emulsions in at least one layer that comprises a yellow dye-forming coupler has the following characteristics:

(i) a silver chloride content of 90 mol % or more; and (ii) contains at least one metal complex represented by general formula (I).

(b-2): An image forming method comprising the steps of:

exposing a silver halide color photosensitive material; and beginning to subject the exposed silver halide color photosensitive material to a color development within nine seconds of the exposure, wherein the exposing step is a scanning exposure step conducted by using exposure sources including at least one blue laser having a wavelength from 420 nm to 460 nm, and wherein the silver halide color photosensitive material comprises:

a support; and a photograph constitution layer provided on the support, and including at least one layer that comprises a yellow dye-forming coupler, at least one layer that comprises a magenta dye-forming coupler, at least one layer that comprises a cyan dye-forming coupler, and at least one non-photosensitive hydrophilic colloid layer, wherein the coupler-comprising layers respectively include silver halide emulsions, and at least one of the silver halide emulsions in at least one layer that comprises a yellow dye-forming coupler has the following characteristics:

(i) a silver chloride content of 90 mol % or more; and (ii) contains at least one metal complex represented by general formula (II).

(b-3): An image forming method comprising the steps of:

exposing a silver halide color photosensitive material; and beginning to subject the exposed silver halide color photosensitive material to a color development within nine seconds of the exposure, wherein the exposing step is a scanning exposure step conducted by using exposure sources including at least one blue laser having a wavelength from 420 nm to 460 nm, and wherein the silver halide color photosensitive material comprises:

a support; and a photograph constitution layer provided on the support, and including at least one layer that comprises a yellow dye-forming coupler, at least one layer that comprises a magenta dye-forming coupler, at least one layer that comprises a cyan dye-forming coupler, and at least one non-photosensitive hydrophilic colloid layer, wherein the coupler-comprising layers respectively include silver halide emulsions, and at least one of the silver halide emulsions in at least one layer that comprises a yellow dye-forming coupler has the following characteristics:

(i) a silver halide content of 90 mol % or more; and (ii) contains at least one metal complex represented by general formula (I) and at least one metal complex represented by general formula (II).

(b-4): A silver halide color photosensitive material for being subjected to color development within nine seconds of being exposed by scanning exposure conducted by using exposure sources including at least one blue laser having a wavelength from 420 nm to 460 nm, the material comprising:

a support; and a photograph constitution layer provided on the support, and including at least one layer that comprises a yellow dye-forming coupler, at least one layer that comprises a magenta dye-forming coupler, at least one layer that comprises a cyan dye-forming coupler, and at least one non-photosensitive hydrophilic colloid layer, wherein the coupler-comprising layers respectively include silver halide emulsions, and at least one of the silver halide emulsions in at least one layer that comprises a yellow dye-forming coupler has the following characteristics:

(i) a silver chloride content of 90 mol % or more; and (ii) contains at least one metal complex represented by general formula (I).

(b-5): A silver halide color photosensitive material for being subjected to color development within nine seconds of being exposed by scanning exposure conducted by using exposure sources including at least one blue laser having a wavelength from 420 nm to 460 nm, the material comprising:

a support; and a photograph constitution layer provided on the support, and including at least one layer that comprises a yellow dye-forming coupler, at least one layer that comprises a magenta dye-forming coupler, at least one layer that comprises a cyan dye-forming coupler, and at least one non-photosensitive hydrophilic colloid layer, wherein the coupler-comprising layers respectively include silver halide emulsions, and at least one of the silver halide emulsions in at least one layer that comprises a yellow dye-forming coupler has the following characteristics:

(i) a silver chloride content of 90 mol % or more; and (ii) contains at least one metal complex represented by general formula (II).

(b-6): A silver halide color photosensitive material for being subjected to color development within nine seconds of being exposed by scanning exposure conducted by using exposure sources including at least one blue laser having a wavelength from 420 nm to 460 nm, the material comprising:

a support; and a photograph constitution layer provided on the support, and including at least one layer that comprises a yellow dye-forming coupler, at least one layer that comprises a magenta dye-forming coupler, at least one layer that comprises a cyan dye-forming coupler, and at least one non-photosensitive hydrophilic colloid layer, wherein the coupler-comprising layers respectively include silver halide emulsions, and at least one of the silver halide emulsions in at least one layer that comprises a yellow dye-forming coupler has the following characteristics:

(i) a silver chloride content of 90 mol % or more; and (ii) contains at least one metal complex represented by general formula (I) and at least one metal complex represented by general formula (II).

(b-7): A silver halide color photosensitive material as described in any of (b-4) to (b-6), wherein silver halide emulsion particles in the silver halide emulsions in at least one layer that comprises the yellow dye-forming coupler have a spherical equivalent diameter of 0.7 μm or less.

(b-8): A silver halide color photosensitive material as described in any of (b-4) to (b-7), wherein the silver halide emulsion of the silver halide emulsion layer containing a yellow dye-forming coupler has a silver iodide content of 0.02 to 1 mol %.

(b-9): A silver halide color photosensitive material as described in any of (b-4) to (b-8), wherein a total coating amount of silver in the silver halide emulsion layer containing a yellow dye-forming coupler is in the range from 0.1 g/m$^2$ to 0.23 g/m$^2$.

(b-10): A silver halide color photosensitive material as described in any of (b-4) to (b-9), wherein the color development is completed within 28 seconds.

(b-11): A silver halide color photosensitive material as described in any of (b-4) and (b-6) to (b-10), wherein the metal complex represented by general formula (I) is a metal complex represented by general formula (IA).

(b-12): A silver halide color photosensitive material as described in any of (b-4) and (b-6) to (b-10), wherein the metal complex represented by general formula (I) is a metal complex represented by general formula (IB).

(b-13): A silver halide color photosensitive material as described in one of (b-4) and (b-6) to (b-10), wherein the metal complex represented by general formula (I) is a metal complex represented by general formula (IC).

(b-14): A silver halide color photosensitive material as described in one of (b-4) and (b-6) to (b-10), wherein the metal complex represented by general formula (I) is a metal complex represented by general formula (ID).

(b-15): A silver halide color photosensitive material as described in one of (b-5) and (b-6) to (b-10), wherein the metal complex represented by general formula (II) is a metal complex represented by general formula (IIA).

(b-16): A silver halide color photosensitive material as described in any of (b-4) to (b-15), wherein the silver halide emulsion in the silver halide emulsion layer that contains the yellow dye-forming coupler further contains 0.1 to 7 mol % of silver bromide, and forms a silver bromide-containing phase having the concentration of silver bromide higher than that of its surroundings in a silver halide emulsion particle.

(b-17): A silver halide color photosensitive material as described in any of (b-4) to (a-16), wherein the silver halide emulsion in the silver halide emulsion layer containing a yellow dye-forming coupler contains 0.02 to 1 mol % of silver iodide, and forms a silver iodide-containing phase having the concentration of silver iodide higher than that of its surroundings in a silver halide emulsion particle.

Preferable Examples of the Aspect (C)

(c-1): An image forming method comprising the steps of:

exposing a silver halide color photosensitive material;

beginning to subject the exposed silver halide color photosensitive material to a color development within nine seconds of the exposure; and completing the color development within 28 seconds, wherein the silver halide color photosensitive material comprises:

a support; and a photograph constitution layer provided on the support, and including at least one layer that comprises a yellow dye-forming coupler, at least one layer that comprises a magenta dye-forming coupler, at least one layer that comprises a cyan dye-forming coupler, and at least one non-photosensitive hydrophilic colloid layer, wherein the coupler-comprising layers respectively include silver halide emulsions, and at least one of the silver halide emulsions has a silver chloride content of 90 mol % or more; and and wherein an average spherical equivalent diameter of the silver halide particles in the silver halide emulsion layer that contains the yellow dye-forming coupler is from 0.30 μm to 0.70 μm.

(c-2): An image forming method as described in (c-1), wherein the silver halide particles in the silver halide emulsion in the silver halide emulsion layer containing the magenta dye-forming coupler and the silver halide particles in the silver halide emulsion layer containing the cyan dye-forming coupler have an average spherical equivalent diameter of 0.40 μm to 0.20 μm, respectively.

(c-3): An image forming method as described in (c-1) or (c-2) wherein the total amount of the gelatin contained in the photograph constitution layer is in a range from 6.0 g/m$^2$ to 3.0 g/m$^2$.

(c-4): An image forming method as described in any of (c-1) to (c-3), wherein the total amount of silver contained in the photograph constitution layer is in a range from 0.50 g/m$^2$ to 0.20 g/m$^2$.

(c-5): An image forming method as described in any of (c-1) to (c-4), wherein the at least one silver halide emulsion layer comprises silver halide particles having a silver chloride content of 90 mol % or more in which a silver iodide-containing phases are arranged in a layers form.

(c-6): A silver halide color photosensitive material for being subjected to color development within nine seconds of being exposed and being completed the color development within 28 seconds, the material comprising:

a support; and a photograph constitution layer provided on the support, and including at least one layer that comprises a yellow dye-forming coupler, at least one layer that comprises a magenta dye-forming coupler, at least one layer that comprises a cyan dye-forming coupler, and at least one non-photosensitive hydrophilic colloid layer, wherein the coupler-comprising layers respectively include silver halide emulsions, and at least one of the silver halide emulsions has a silver chloride content of 90 mol % or more; and and wherein an average spherical equivalent diameter of the silver halide particles in the silver halide emulsion layer that contains the yellow dye-forming coupler is from 0.30 μm to 0.70 μm.

(c-7): A silver halide color photosensitive material as described in (c-6), wherein the silver halide particles in the silver halide emulsion in the silver halide emulsion layer containing the magenta dye-forming coupler and the silver halide particles in the silver halide emulsion layer containing the cyan dye-forming coupler have an average spherical equivalent diameter of 0.40 μm to 0.20 μm, respectively.

(c-8): A silver halide color photosensitive material as described in (c-6) or (c-7), wherein the total amount of the gelatin contained in the photograph constitution layer is in a range from 6.0 g/m$^2$ to 3.0 g/m$^2$.

(c-9) A silver halide color photosensitive material as described in any of (c-6) to (c-8), wherein the total amount of silver contained in the photograph constitution layer is in a range from 0.50 g/m$^2$ to 0.20 g/m$^2$.

(c-10): A silver halide color photosensitive material as described in any of (c-6) to (c-9), wherein the at least one silver halide emulsion layer comprises silver halide particles having a silver chloride content of 90 mol % or more in which a silver iodide-containing phases are arranged in a layers form.

(c-11): A silver halide color photosensitive material as described in any of (c-6) to (c-10), wherein at least one of the silver halide emulsion layers comprises silver halide particles having a silver chloride content of 90 mol % or more and containing a compound represented by general formula (I).

(c-12): A silver halide color photosensitive material as described in (c-11), wherein the compound represented by general formula (I) is a compound represented by general formula (IA).

(c-13): A silver halide color photosensitive material as described in (c-11), wherein the compound represented by general formula (I) is a compound represented by general formula (IB).

(c-14): A silver halide color photosensitive material as described in (c-11), wherein the compound represented by general formula (I) is a compound represented by general formula (IC).

(c-15): A silver halide color photosensitive material as described in (c-11), wherein the compound represented by general formula (I) is a compound represented by general formula (ID).

(c-16): A silver halide color photosensitive material as described in any of (c-6) to (c-15), wherein at least one of the silver halide emulsion layers comprises silver halide particles having a silver chloride content of 90 mol % or more and containing a compound represented by general formula (II).

(c-17) A silver halide color photosensitive material as described in (c-16), wherein the compound represented by general formula (II) is a compound represented by general formula (IIA).

(c-18): A silver halide color photosensitive material as described in any of (c-6) to (c-17), wherein at least one of the silver halide emulsion layers comprises silver halide particles having a silver chloride content of 90 mol % or more in which a silver bromide-containing phases are arranged in a layers form.

EXAMPLES

Hereinafter, the present invention is described in detail on the basis of the following examples. However, the invention is not limited to those examples.

Example (a)-1

Preparation of Emulsion (a)-B-1

A liming-gelatin 3% aqueous solution (1,000 ml) was adjusted to pH 5.5, pCl 1.7, and the aqueous solution containing 2.12 moles of silver nitrate and the aqueous solution containing 2.2 moles of sodium chloride were simultaneously added and mixed in the above solution at 50° C. while agitating vigorously. During the time period that the added amount of the silver nitrate being from 80% to 90%, potassium bromide was added such that it might become 3 moles per mol of total silver halide in the emulsion to be obtained. In addition, during the time period that the added amount of the silver nitrate being from 80% to 90%, a $K_4[Ru(CN)_6]$ aqueous solution was added such that a content of Ru might become $3\times10^{-5}$ moles per mole of total silver halide in the emulsion to be obtained. During the time period that the added amount of the silver nitrate being from 82% to 88%, a $K_2[IrCl_6]$ aqueous solution was added such that a content of Ir might become $5.3\times\mathbf{10}^{-8}$ moles per mole of total silver halide in the emulsion to be obtained. When the addition of 90% of total silver nitrate to be added was completed, the potassium iodide aqueous solution was added such that the content of I might become 0.3 mol % per mole of total silver halide in the emulsion to be obtained. After performing demineralization process at 40° C., the liming gelatin (168 g) was adjusted to pH 5.5, pCl 1.8. The resulting particles are a silver bromo-chloro-iodide cubic emulsion having a spherical equivalent diameter of 0.51 μm and a variation coefficient of 9%.

This emulsion was dissolved at 40° C. and sodium thiosulfonate was then added such that a content thereof might become $2\times10^{-5}$ moles per mole of silver halide. As a sulfur sensitizing agent, sodium thiosulfate 5-hydrate was used. As a gold sensitizer, bis(1,4,5-trimethyl-1,2,4-triazolium-3-thiolate)aurate (I) tetrafluoroborate was used. Subsequently, the mixture was matured at 60° C. so as to be optimized. After the mixture was cooled to 40° C., sensitizing dye A shown below ($2.7\times10^{-4}$ moles per mole of the silver halide), sensitizing dye B shown below ($1.4\times10^{-4}$ moles per mole of the silver halide), 1-phenyl-5-mercaptotetrazole ($2.7\times10^{-4}$ moles per mole of the silver halide), 1-(5-methylureide phenyl)-5-mercaptotetrazole ($2.7\times10^{-4}$ moles per mole of the silver halide), and potassium bromide ($2.7\times10^{-3}$ moles per mole of the silver halide) were added, respectively. The resulting emulsion was then provided as Emulsion (a)-B-1.

Sensitizing dye A

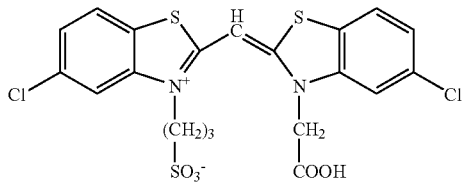

Sensitizing dye B

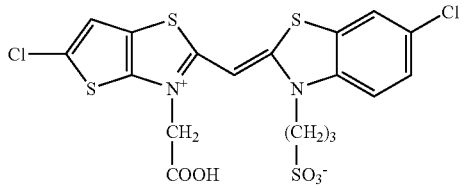

Preparation of Emulsion (a)-B-2

Emulsion (a)-B-2 was prepared in the same manner as that of Emulsion (a)-B-1, except that instead of the $K_4[Ru(CN)_6]$ aqueous solution to be added during the time period that the added amount of the silver nitrate being from 80% to 90%, the $K_4[Fe(CN)_6]$ aqueous solution was added such that the content of Fe might become $3\times10^{-5}$ moles per mole of total silver halide in the emulsion to be obtained.

Preparation of Emulsion (a)-B-3

Emulsion (a)-B-3 was prepared in the same manner as that of Emulsion (a)-B-1, except for the follows. That is, instead of the $K_4[Ru(CN)_6]$ aqueous solution to be added during the time period that the added amount of the silver nitrate being from 80% to 90%, the $K_4[Fe(CN)_6]$ aqueous solution was added such that the content of Fe might become $3\times10^{-5}$ moles per mole of total silver halide in the emulsion to be obtained. During the time period that the added amount of the silver nitrate being from 82% to 88%, a $K_2[IrCl_6]$ aqueous solution was added such that the content of Ir might become $3.6\times10^{-8}$ moles per mole of total silver halide in the emulsion to be obtained. In addition, during the time period that the added amount of the silver nitrate being from 82% to 88%, a $K_2[IrBr_6]$ aqueous solution was added such that the content of Ir might become $4.0\times10^{-8}$ moles per mole of total silver halide in the emulsion to be obtained.

Preparation of Emulsion (a)-B-4

Emulsion (a)-B-4 was prepared in the same manner as that of Emulsion (a)-B-1, except that during the time period that the added amount of the silver nitrate being from 82% to 88%, a $K_2[IrCl_6]$ aqueous solution was added such that the content of Ir might become $3.6\times10^{-8}$ moles per mole of total silver halide in the emulsion to be obtained. Furthermore, during the time period that the added amount of the silver nitrate being from 92% to 98%, a $K_2[Ir(H_2O)Cl_5]$ aqueous solution was added such that the content of Ir might become $1.6\times10^{-6}$ moles per mole of total silver halide in the emulsion to be obtained.

Preparation of Emulsion (a)-B-5

Emulsion (a)-B-5 was prepared in the same manner as that of Emulsion (a)-B-1, except for the follows. During the time period that the added amount of the silver nitrate being from 82% to 88%, a $K_2[IrCl_6]$ aqueous solution was added such that the content of Ir might become $1.2\times10^{-8}$ moles per mole of total silver halide in the emulsion to be obtained. Furthermore, during the time period that the added amount of the silver nitrate being from 92% to 98%, a $K_2[Ir(5\text{-methylthiazole})Cl_5]$ aqueous solution was added such that the content of Ir might become $1.0\times10^{-6}$ moles per mole of total silver halide in the emulsion to be obtained.

Preparation of Emulsion (a)-B-6

Emulsion (a)-B-6 was prepared in the same manner as that of Emulsion (a)-B-1, except for the follows. During the time period that the added amount of the silver nitrate being from 82% to 88%, a $K_2[IrCl_6]$ aqueous solution was added such that the content of Ir might become $8.0\times10^{-9}$ moles per mole of total silver halide in the emulsion to be obtained. Furthermore, during the time period that the added amount of the silver nitrate being from 92% to 98%, a $K_2[Ir(5\text{-methylthiazole})Cl_5]$ aqueous solution was added such that the content of Ir might become $8.0\times10^{-6}$ moles per mole of total silver halide in the emulsion to be obtained. In addition, a $K_2[Ir(H_2O)Cl_5]$ aqueous solution was added such that the content of Ir might become $1.0\times10^{-6}$ moles per mole of total silver halide in the emulsion to be obtained.

Preparation of Emulsion (a)-B-7

Emulsion (a)-B-7 was prepared in the same manner as that of Emulsion (a)-B-1, except for the follows. During the time period that the added amount of the silver nitrate being from 82% to 88%, a $K_2[IrCl_6]$ aqueous solution was added such that the content of Ir might become $1.0\times10^{-8}$ moles per mole of total silver halide in the emulsion to be obtained. Furthermore, during the time period that the added amount of the silver nitrate being from 82% to 88%, a $K_2[Ir(2\text{-chloro-5-fluorothiadiazole})Cl_5]$ aqueous solution was added such that the content of Ir might become $7.2\times10^{-7}$ moles per mole of total silver halide in the emulsion to be obtained.

Preparation of Emulsion (a)-B-8

Emulsion (a)-B-8 was prepared in the same manner as that of Emulsion (a)-B-1, except for the follows. During the time period that the added amount of the silver nitrate being from 60% to 80%, a $K_3[RhBr_6]$ aqueous solution was added such that the content of Rh might become $5.3\times10^{-9}$ moles per mole of total silver halide in the emulsion to be obtained. Furthermore, during the time period that the added amount of the silver nitrate being from 82% to 88%, a $K_2[IrCl_6]$ aqueous solution was added such that the content of Ir might become $3.6\times10^{-8}$ moles per mole of total silver halide in the emulsion to be obtained.

Preparation of Emulsion (a)-B-9

Emulsion (a)-B-9 was prepared in the same manner as that of Emulsion (a)-B-1, except for the follows. During the time period that the added amount of the silver nitrate being from 60% to 80%, a $Cs_2[OS(NO)Cl_5]$ aqueous solution was added such that the content of Os might become $4.1\times10^{-9}$ moles per mole of total silver halide in the emulsion to be obtained. Furthermore, during the time period that the added amount of the silver nitrate being from 82% to 88%, a $K_2[IrCl_6]$ aqueous solution was added such that the content of Ir might become $3.6\times10^{-8}$ moles per mole of total silver halide in the emulsion to be obtained.

Preparation of Emulsion (a)-B-10

Emulsion (a)-B-10 was prepared in the same manner as that of Emulsion (a)-B-1, except for the follows. During the time period that the added amount of the silver nitrate being from 60% to 80%, a $K_3[RhBr_6]$ aqueous solution was added such that the content of Rh might become $4.1\times10^{-9}$ moles per mole of total silver halide in the emulsion to be obtained. In addition, during the time period that the added amount of the silver nitrate being from 82% to 88%, a $K_2[IrCl_6]$ aqueous solution was added such that the content of Ir might become $8.0\times10^{-9}$ moles per mole of total silver halide in the emulsion to be obtained. Furthermore, during the time period that the added amount of the silver nitrate being from 92% to 98%, a $K_2[Ir(5\text{-methylthiazole})Cl_5]$ aqueous solution was added such that the content of Ir might become $7.0\times10^{-7}$ moles per mole of total silver halide in the emulsion to be obtained.

Preparation of Emulsion (a)-B-11

Emulsion (a)-B-11 was prepared in the same manner as that of Emulsion (a)-B-1, except for the follows. During the time period that the added amount of the silver nitrate being from 60% to 80%, a $K_3[RhBr_6]$ aqueous solution was added such that the content of Rh might become $5.3\times10^{-9}$ moles per mole of total silver halide in the emulsion to be obtained. Instead of the $K_4[Ru(CN)_6]$ aqueous solution, during the time period that the added amount of the silver nitrate being from 80% to 90%, a $K_4[Fe(CN)_6]$ aqueous solution was added such that the content of Fe might become $3\times10^{-5}$ moles per mole of total silver halide in the emulsion to be obtained. Furthermore, during the time period that the added amount of the silver nitrate being from 82% to 88%, $K_2[IrCl_6]$ aqueous solution was added such that the content of Ir might become $3.6\times10^{-8}$ moles per mole of total silver halide in the emulsion to be obtained.

Preparation of Emulsion (a)-B-12

Emulsion (a)-B-12 was prepared in the same manner as that of Emulsion (a)-B-1, except for the follows. During the time period that the added amount of the silver nitrate being from 60% to 80%, $K_3[RhBr_6]$ aqueous solution was added such that the content of Rh might become $5.3\times10^{-9}$ moles per mole of total silver halide in the emulsion to be obtained. Instead of the $K_4[Ru(CN)_6]$ aqueous solution, during the time period that the added amount of the silver nitrate being from 80% to 90%, $K_4[Fe(CN)_6]$ aqueous solution was added such that the content of Fe might become $3\times10^{-5}$ moles per mole of total silver halide in the emulsion to be obtained. Furthermore, during the time period that the added amount of the silver nitrate being from 82% to 88%, a $K_2[IrCl_6]$ aqueous solution was added such that the content of Ir might become $2.0\times10^{-8}$ moles per mole of total silver halide in the emulsion to be obtained. Likewise, during the time period that the added amount of the silver nitrate being from 82% to 88%, a $K_2[IrBr_6]$ aqueous solution was added such that the content of Ir might become $3.0\times10^{-8}$ moles per mole of total silver halide in the emulsion to be obtained.

Preparation of Emulsion (a)-B-13

Emulsion (a)-B-13 was prepared in the same manner as that of Emulsion (a)-B-1, except for the follows. During the time period that the added amount of the silver nitrate being from 60% to 80%, a $Cs_2[Os(NO)Cl_5]$ aqueous solution was added such that the content of Os might become $4.1\times10^{-9}$ moles per mole of total silver halide in the emulsion to be obtained. During the time period that the added amount of the silver nitrate being from 82% to 88%, a $K_2[IrCl_6]$ aqueous solution was added such that the content of Ir might become $8.0\times10^{-9}$ moles per mole of total silver halide in the emulsion to be obtained. Furthermore, during the time period that the added amount of the silver nitrate being from 92% to 98%, a $K_2[Ir(5\text{-methylthiazole})Cl_5]$ aqueous solution was added such that the content of Ir might become $7.2\times10^{-7}$ moles per mole of total silver halide in the emulsion to be obtained.

Preparation of Emulsion (a)-B-14

Emulsion (a)-B-14 was prepared in the same manner as that of Emulsion (a)-B-1, except for the follows. During the time period that the added amount of the silver nitrate being from 60% to 80%, a $K_3[RhBr_6]$ aqueous solution was added such that the content of Rh might become $5.3\times10^{-9}$ moles per mole of total silver halide in the emulsion to be obtained. Instead of the $K_4[Ru(CN)_6]$ aqueous solution, during the time period that the added amount of the silver nitrate being from 80% to 90%, a $K_4[Fe(CN)_6]$ aqueous solution was added such that the content of Fe might become $3\times10^{-5}$ moles per mole of total silver halide in the emulsion to be obtained. Furthermore, during the time period that the added amount of the silver nitrate being from 82% to 88%, a $K_2[IrCl_6]$ aqueous solution was added such that the content of Ir might become $6.0\times10^{-9}$ moles per mole of total silver halide in the emulsion to be obtained. Likewise, during the time period that the added amount of the silver nitrate being from 82% to 88%, a $K_2[Ir(2\text{-chloro-5-fluorothiadiazole})Cl_5]$ aqueous solution was added such that the content of Ir might become $5.2\times10^{-7}$ moles per mole of total silver halide in the emulsion to be obtained. Furthermore, during the time period that the added amount of the silver nitrate being from 92% to 98%, a $K_2[Ir(H_2O)Cl_5]$ aqueous solution was added such that the content of Ir might become $1.0\times10^{-6}$ moles per mole of total silver halide in the emulsion to be obtained.

Preparation of Emulsion (a)-G-1

A liming-gelatin 3% aqueous solution (1,000 ml) was adjusted to pH 5.5, pC11.7, and the aqueous solution containing 2.12 moles of silver nitrate and the aqueous solution containing 2.2 moles of sodium chloride were simultaneously added and mixed in the above solution at 40° C. while agitating vigorously. During the time period that the added amount of the silver nitrate being from 60% to 80%, a $K_3[RhBr_6]$ was added so that it might become $5.8\times10^{-9}$ moles per mol of total silver halide in the emulsion to be obtained. During the time period that the added amount of the silver nitrate being from 80% to 100%, potassium bromide was added and mixed vigorously so that it might become 4.3 moles per mol of total silver halide in the emulsion to be obtained. During the time period that the added amount of the silver nitrate being from 80% to 90%, a $K_4[Ru(CN)_6]$ aqueous solution was added such that the content of Ru might become $3.0\times10^{-5}$ moles per mole of total silver halide in the emulsion to be obtained. During the time period that the added amount of the silver nitrate being from 83% to 88%, a $K_2[IrCl_6]$ aqueous solution was added such that the content of Ir might become $5.0\times10^{-8}$ moles per mole of total silver halide in the emulsion to be obtained. When the addition of 90% of total silver silver nitrate was achieved, the potassium iodide aqueous solution was added and mixed vigorously such that I might become 0.15 mol % per mole of total silver halide in the emulsion to be obtained. During the time period that the added amount of the silver nitrate being from 92% to 95%, a $K_2[Ir(5\text{-methylthiazole})Cl_5]$ aqueous solution was added such that the content of Ir might become $5.0\times10^{-7}$ moles per mole of total silver halide in the emulsion to be obtained.

After performing demineralization process at 40° C., the liming gelatin (168 g) was added and adjusted to pH 5.5, pC 11.8. The resulting particles are a silver bromo-chloro-iodide cubic emulsion having a spherical equivalent diameter of 0.35 μm and a variation coefficient of 9%.

This emulsion was dissolved at 40° C. and sodium thiosulfonate was then added such that a content thereof might become $2\times10^{-5}$ moles per mole of silver halide. As a sulfur sensitizing agent, sodium thiosulfate 5-hydrate was used. As a gold sensitizer, gold thioglucose was used such that the mixture was matured at 60° C. so as to be optimized. After the mixture was cooled to 40° C., the sensitizing dye C ($6\times10^{-4}$ moles per mole of silver halide), 1-phenyl-5-mercaptotetrazole ($2\times10^{-4}$ moles per mole of silver halide), 1-(5-methylureide phenyl)-5-mercaptotetrazole (8×10 moles per mole of silver halide), and potassium bromide ($7\times10^{-3}$ moles per mole of silver halide) were added, respectively. The resulting emulsion was then provided as Emulsion (a)-G-1.

Sensitizing Dye C

Sensitizing dye C

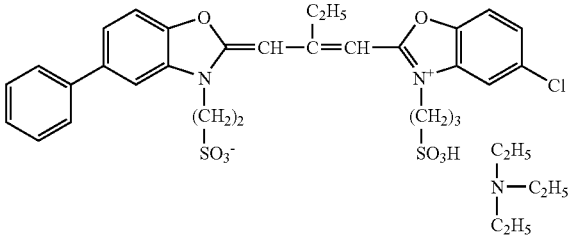

Preparation of Emulsion (a)-R-1

A liming-gelatin 3% aqueous solution (1,000 ml) was adjusted to pH 5.5, pC11.7, and the aqueous solution containing 2.12 moles of silver nitrate and the aqueous solution containing 2.2 moles of sodium chloride were simultaneously added and mixed in the above solution at 40° C. while agitating vigorously. During the time period that the added amount of the silver nitrate being from 60% to 80%, a $K_3[RhBr_6]$ was added so that it might become $5.8\times10^{-9}$ moles per mol of total silver halide in the emulsion to be obtained. During the time period that the added amount of the silver nitrate being from 80% to 100%, potassium bromide was added and mixed vigorously so that it might become 4.3 moles per mol of total silver halide in the emulsion to be obtained. During the time period that the added amount of the silver nitrate being from 80% to 90%, a $K_4[Ru(CN)_6]$ aqueous solution was added such that the content of Ru might become $3\times10^{-5}$ moles per mole of total silver halide in the emulsion to be obtained. During the time period that the added amount of the silver nitrate being from 83% to 88%, a $K_2[IrCl_6]$ aqueous solution was added such that the content of Ir might become $5\times10^{-9}$ moles per mole of total silver halide in the emulsion to be obtained. When the addition of 90% of total silver silver nitrate was achieved, the potassium iodide aqueous solution was added and mixed vigorously such that I might become 0.1 mol % per mole of total silver halide in the emulsion to be obtained. During the time period that the added amount of the silver nitrate being from 92% to 95%, a $K_2[Ir(5\text{-methylthiazole})Cl_5]$ aqueous solution was added such that the content of Ir might become $5\times10^{-7}$ moles per mole of total silver halide in the emulsion to be obtained. Furthermore, during the time period that the added amount of the silver nitrate being from 95% to 98%, a $K_2[Ir(H_2O)Cl_5]$ aqueous solution was added such that the content of Ir might become $5\times10^{-7}$ moles per mole of total silver halide in the emulsion to be obtained. After performing demineralization process at 40° C., the liming gelatin (168 g) was added and adjusted to pH 5.5, pCl 1.8. The resulting particles are a silver bromo-chloro-iodide cubic emulsion having a spherical equivalent diameter of 0.35 μm and a variation coefficient of 9%.

This emulsion was dissolved at 40° C. and sodium thiosulfonate was then added such that a content thereof might become $2\times10^{-5}$ moles per mole of silver halide. As a sulfur sensitizing agent, sodium thiosulfate 5-hydrate was used. As a gold sensitizer, bis(1,4,5-trimethyl-1,2,4-triazolium-3-thiolate)aurate (I) tetrafluoroborate was used. Subsequently, the mixture was matured at 60° C. so as to be optimized. After the mixture was cooled to 40° C., the sensitizing dye H ($2\times10^{-4}$ moles per mole of silver halide), 1-phenyl-5-mercaptotetrazole ($2\times10^{-4}$ moles per mole of silver halide), 1-(5-methylureide phenyl)-5-mercaptotetrazole ($8\times10^{-4}$ moles per mole of silver halide), the compound I ($1\times10^{-3}$ moles per mole of silver halide), and potassium bromide ($7\times10^{-3}$ moles per mole of silver halide) were added, respectively. The resulting emulsion was then provided as Emulsion (a)-R-1.

Sensitizing dye H

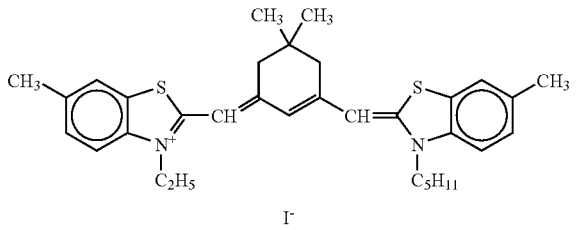

-continued

Compound I

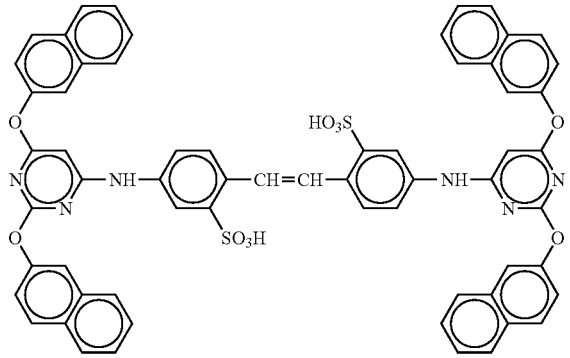

Samples

The gelatin undercoat which contains sodium dodecylbenzenesulfonate was formed after performing corona discharge treatment on the surface of the support medium prepared by coating both sides of paper with polyethylene resin. Furthermore, the first to seventh layers were coated on the photograph constitution layer one by one to form a sample of silver halide color photosensitive material having the following layer constitution. Furthermore, a coating solution of each photograph constitution layer was prepared as follows.

Preparation of First Layer Coating Solution

In 21 g of a solvent (Solv-1) and 80 ml of ethyl acetate, 57 g of yellow coupler (ExY), 7 g (Cpd-1) of color image stabilizer, 4 g (Cpd-2) of color image stabilizer, 7 g (Cpd-3) of color image stabilizer, and 2 g (Cpd-8) of color stabilizer were dissolved. Then, using a high-speed stirring emulsifier (Dissolber), the resulting solution was dispersed and emulsified in 220 g of a gelatin aqueous solution (23.5% by weight) that contains 4 g of sodium dodecyl benzenesulfonate. Subsequently, a emulsified dispersant A (900 g) was prepared by adding water into the emulsion. On the other hand, the emulsified dispersant A and the emulsion (a)-B-1 were mixed and dissolved together. As shown in the composition described later, a first layer coating solution was prepared. The coating amount of the emulsion was represented as the coating amount equivalent to the silver content.

Preparation of Second to Seventh Layer Coating Solutions

The second to seventh coating solutions were prepared by the same method as that of the first layer coating solution. As a gelatin hardener, 1-oxy-3,5-dichloro-s-triazine sodium salt (H-1), (H-2), and (H-3) were used. In addition, for each layer, Ab-1, Ab-2, Ab-3, and Ab-4 were added such that their respective total amount might become 15.0 mg/m$^2$, 60.0 mg/m$^2$, 5.0 mg/m$^2$, and 10.0 mg/m$^2$, respectively.

(H-1) Hardener

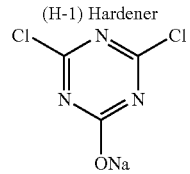

(added 1.4% by weight per gelatin)

(H-2) Hardener

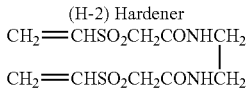

-continued (H-2) Hardener

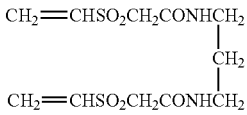

(Ab-1) Antiseptic agent

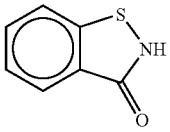

(Ab-2) Antiseptic agent

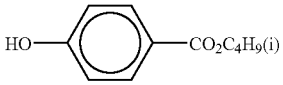

(Ab-3) Antiseptic agent

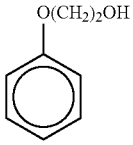

(Ab-4) Antiseptic agent: Mixture of a, b, c, and d (a:b:c:d = 1:1:1:1, mole ratio)

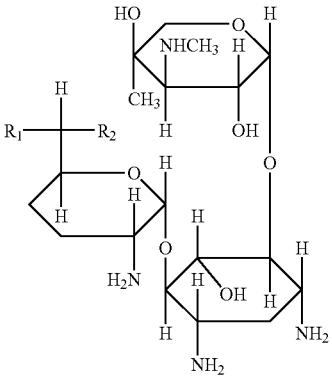

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

Furthermore, $1.0\times10^{-3}$ moles and $5.9\times10^{-4}$ moles of 1-phenyl-5-mercaptotetrazole per mole of silver halide were added in green and red sensitive emulsion layers, respectively. Furthermore, 0.2 mg/m$^2$, 0.2 mg/m$^2$, and 0.6 mg/m$^2$ of 1-phenyl-5-mercaptotetrazole were added in the second, fourth, and sixth layers, respectively.

The copolymer latex (a weight ratio 1:1, average molecular weight of 200000 to 400000) of methacrylic acid and butyl acrylate was added 0.05 g/m$^2$ in the red-sensitive emulsion layer. To the second layer, the fourth layer, and the sixth layer, catechol 3,5-disodium disulfonate was added so as to become 6 mg/m$^2$, 6 mg/m$^2$, and 18 mg/m$^2$, respectively. The following dyes (the inside of a parenthesis represents the coating amount) were added for irradiation prevention, respectively.

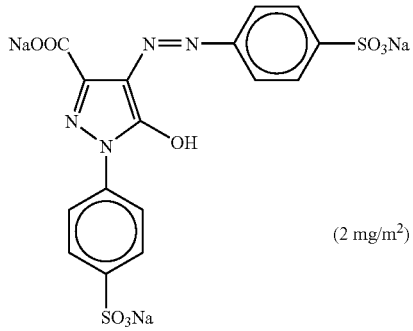

(2 mg/m$^2$)

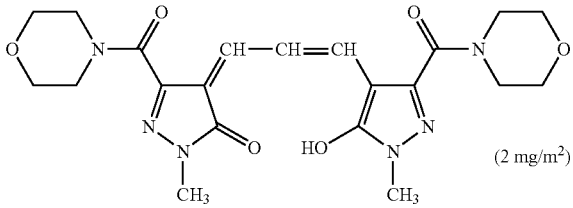

(2 mg/m$^2$)

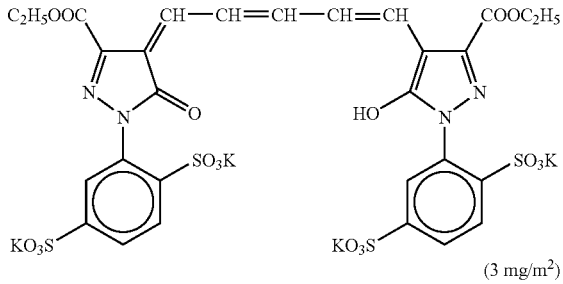

(3 mg/m$^2$)

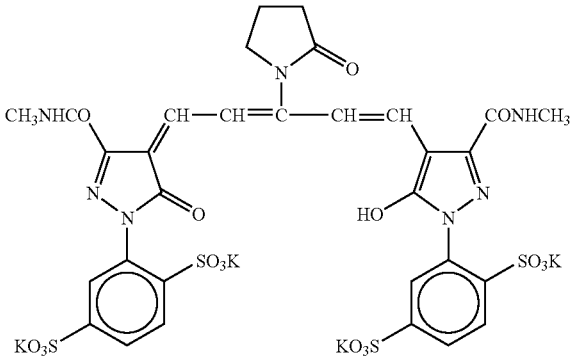

(7 mg/m$^2$)

Layer Constitution

Hereinafter, the constitution of each layer will be described. A numeric character represents the coating amount (g/m$^2$) Silver halide emulsion represents the coating amount equal to the silver content.

Support Medium

Polyethylene Resin Laminated Paper

[White pigment ($Tio_2$; 16% by weight in content, ZnO: 4% by weight in content) and an fluorescent whitening agent (4,4'-bis (5-methylbenzoxylazoly) stilbene, 0.03% by weight in content), bluness dye (ultramarine blue) were added in a polyethylene resin on the first layer side]

| | |
|---|---|
| The first layer (Blue-sensitive emulsion layer) | |
| Emulsion (a) B-1 | 0.19 |
| Gelatin | 1.00 |
| Yellow coupler (ExY) | 0.46 |
| Color image stabilizer (Cpd-1) | 0.06 |
| Color image stabilizer (Cpd-2) | 0.03 |
| Color image stabilizer (Cpd-3) | 0.06 |
| Color image stabilizer (Cpd-8) | 0.02 |
| Solvent (Solv-1) | 0.17 |
| The second layer (color mixing-contamination prevention layer) | |
| Gelatin | 0.50 |
| Color mixture inhibitor (Cpd-4) | 0.05 |
| Color image stabilizer (Cpd-5) | 0.01 |
| Color image stabilizer (Cpd-6) | 0.06 |
| Color image stabilizer (Cpd-7) | 0.01 |
| Solvent (Solv-1) | 0.03 |
| Solvent (Solv-2) | 0.11 |
| The third layer (green sensitive emulsion layer) | |
| Emulsion (a)-G-1 | 0.12 |
| Gelatin | 1.36 |
| Magenta coupler (ExM) | 0.15 |
| UV absorber (UV-A) | 0.14 |
| Color image stabilizer (Cpd-2) | 0.02 |
| Color image stabilizer (Cpd-4) | 0.002 |
| Color image stabilizer (Cpd-6) | 0.09 |
| Color image stabilizer (Cpd-8) | 0.02 |
| Color image stabilizer (Cpd-9) | 0.03 |
| Color image stabilizer (Cpd-10) | 0.01 |
| Color image stabilizer (Cpd-11) | 0.0001 |
| Solvent (Solv-3) | 0.11 |
| Solvent (Solv-4) | 0.22 |
| Solvent (Solv-5) | 0.20 |
| The fourth layer (color mixing-contamination prevention layer) | |
| Gelatin | 0.36 |
| Color mixing-contamination prevention layer (Cpd-4) | 0.03 |
| Color image stabilizer (Cpd-5) | 0.006 |
| Color image stabilizer (Cpd-6) | 0.05 |
| Color image stabilizer (Cpd-7) | 0.004 |
| Solvent (Solv-1) | 0.02 |
| Solvent (Solv-2) | 0.08 |
| The fifth layer (red-sensitive emulsion layer) | |
| Emulsion (a)-R-1 | 0.10 |
| Gelatin | 1.11 |
| Cyan coupler (ExC-2) | 0.13 |
| Cyan coupler (ExC-3) | 0.03 |
| Color image stabilizer (Cpd-1) | 0.05 |
| Color image stabilizer (Cpd-6) | 0.06 |
| Color image stabilizer (Cpd-7) | 0.02 |
| Color image stabilizer (Cpd-9) | 0.04 |
| Color image stabilizer (Cpd-10) | 0.01 |
| Color image stabilizer (Cpd-14) | 0.01 |
| Color image stabilizer (Cpd-15) | 0.12 |
| Color image stabilizer (Cpd-16) | 0.03 |
| Color image stabilizer (Cpd-17) | 0.09 |
| Color image stabilizer (Cpd-18) | 0.07 |
| Solvent (Solv-5) | 0.15 |
| Solvent (Solv-8) | 0.05 |
| The sixth layer (ultraviolet absorption layer) | |
| Gelatin | 0.46 |
| UV absorber (UV-B) | 0.45 |
| Compound (Sl-4) | 0.0015 |
| Solvent (Solv-7) | 0.25 |
| The seventh layer (protective layer) | |
| Gelatin | 1.00 |
| The acrylics denaturation copolymer of polyvinyl alcohol (Degree of denaturation 17%) | 0.04 |
| Liquid-paraffin | 0.02 |
| Surfactant (Cpd-13) | 0.01 |

-continued
(ExY-1) Yellow coupler: mixture (70:30, mole ratio) of
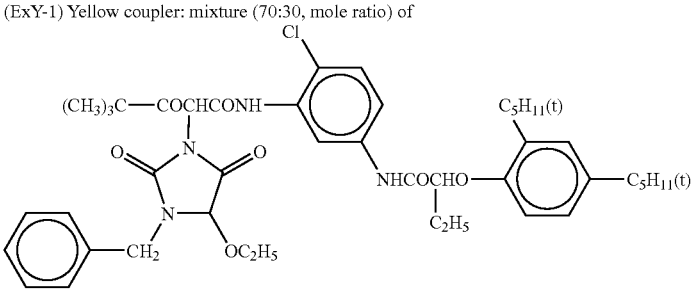
and
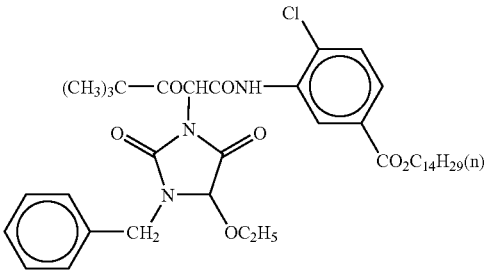
(ExM) Magenta coupler: mixture (40:40:20, mole ratio) of
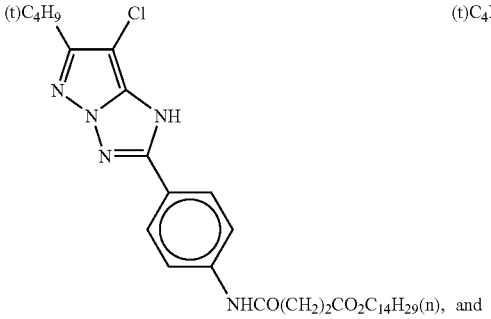
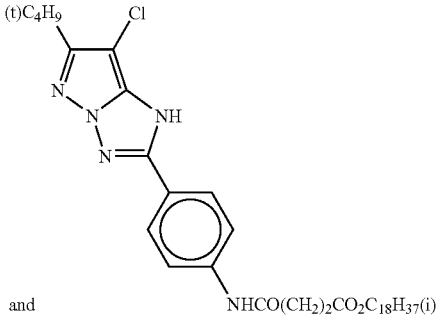
, and
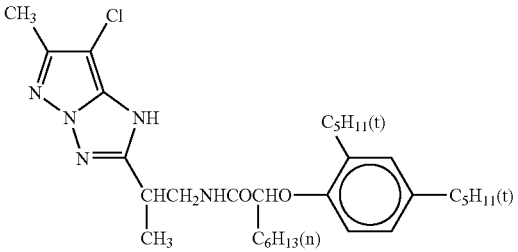
(ExC-2) Cyan coupler
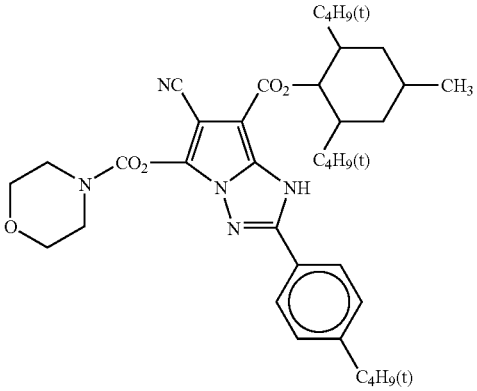
(ExC-3) Cyan coupler: mixture (50:25:25, mole ratio) of -continued
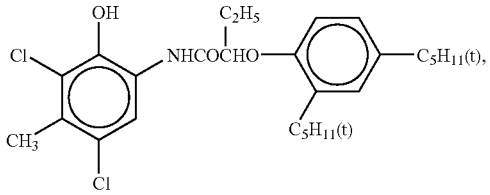
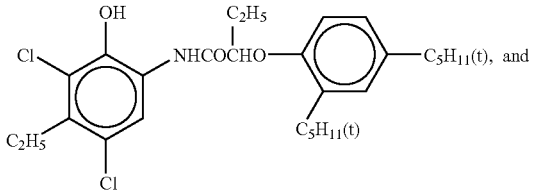
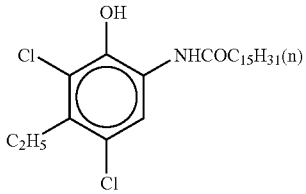
(Cpd-1) Color image stabilizer
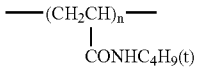
Number average molecular weight: 60,000
(Cpd-2) Color image stabilizer
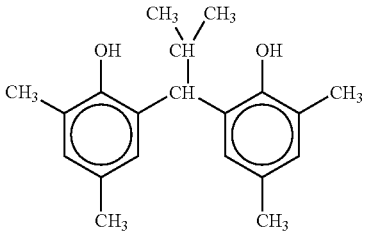
(Cpd-3) color image stabilizer
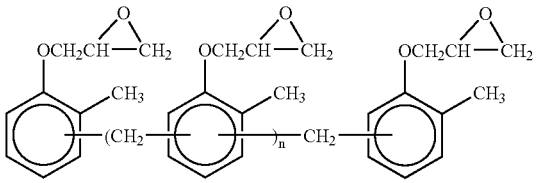
n = 7 to 8 (average)
(Cpd-4) Color mixture inhibitor
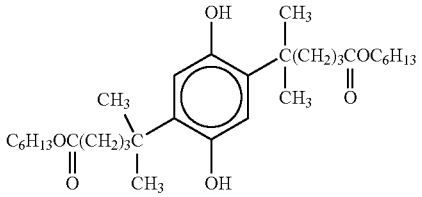
(Cpd-5) Color image stabilizer
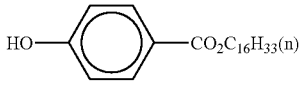
(Cpd-6) Color image stabilizer
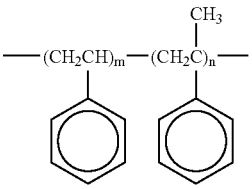
Number average molecular weight: 600, m/n = 10/90
(Cpd-7) Color image stabilizer (Cpd-8) Color image stabilizer -continued
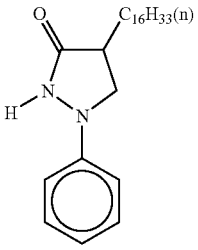
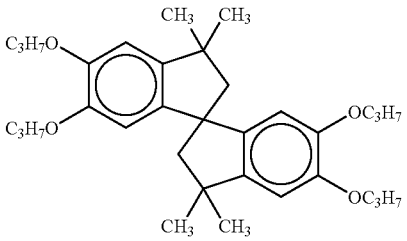
(Cpd-9) Color image stabilizer
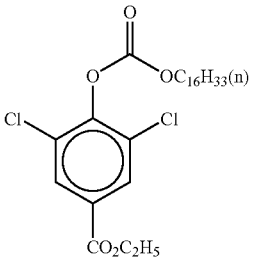
(Cpd-10) Color image stabilizer
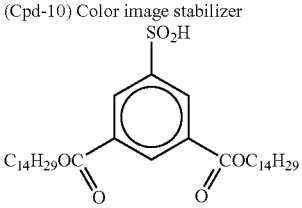
(Cpd-11)
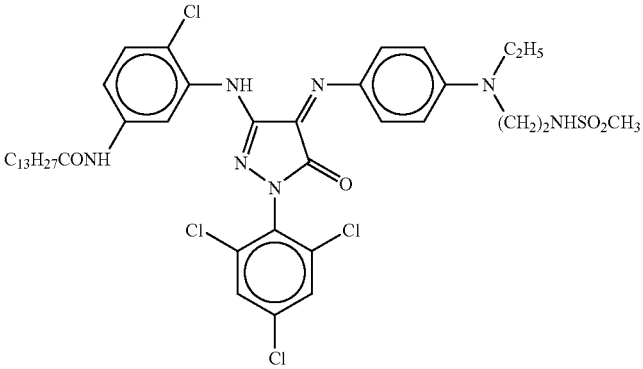
(Cpd-13) Surfactant: mixture (7:3, mole ratio) of
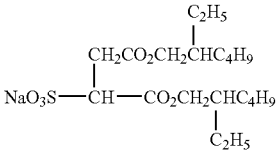
and
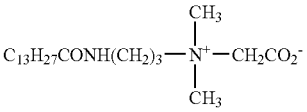
(Cpd-14)
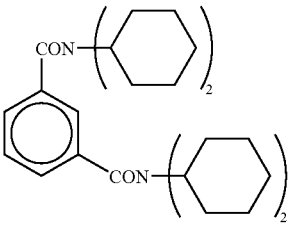
(Cpd-15)
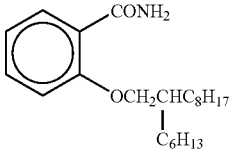
(Cpd-16)
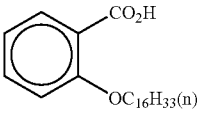
(Cpd-17)
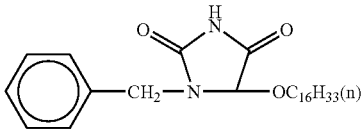
(Cpd-18)

-continued
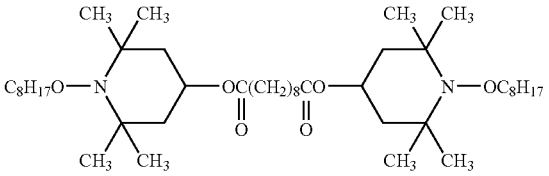
(Cpd-19) Color mixing-contamination prevention agent
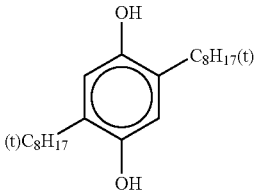
(UV-1) UV absorber
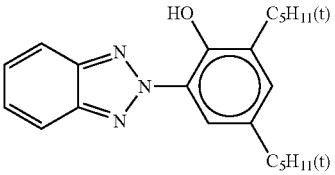
(UV-2) UV absorber
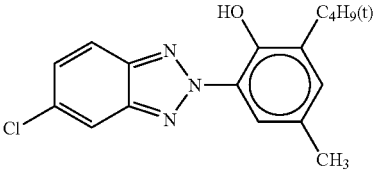
(UV-3) UV absorber
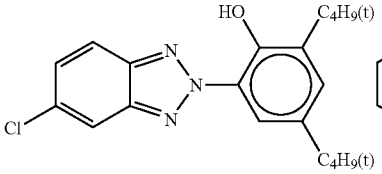
(UV-4) UV absorber
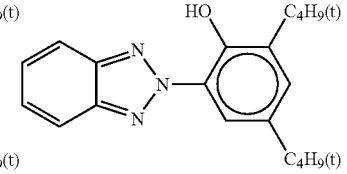
(UV-5) UV absorber
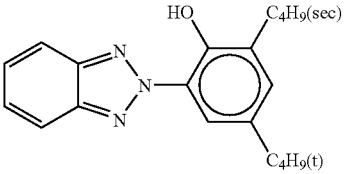
(UV-6) UV absorber
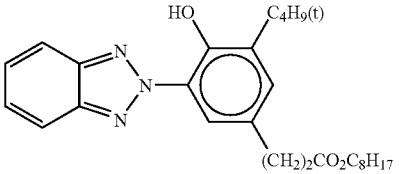
(UV-7) UV absorber
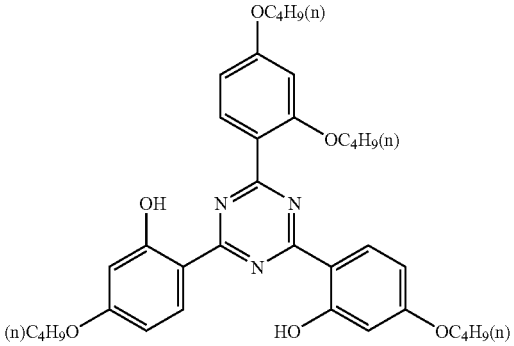

-continued

UV-A: mixture of UV-1/UV-2/UV-3/UV-4 = 4/2/2/3 (Weight ratio)
UV-B: mixture of UV-1/UV-2/UV-3/UV-4/UV-5/UV-6 = 9/3/3/4/5/3 (Weight ratio)
UV-C: mixture of UV-2/UV-3/UV-6/UV-7 = 1/1/1/2 (Weight ratio)

(Solv-1)

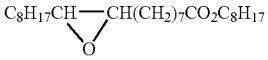

(Solv-2)

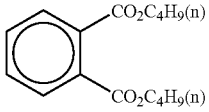

(Solv-3)

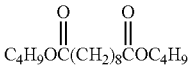

(Solv-4)

$O{=}P(OC_6H_{13}(n))_3$ (Solv-5)

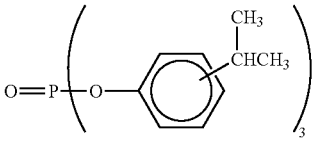

(Solv-7)

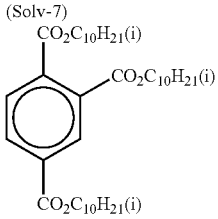

(Solv-8)

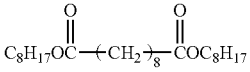

(S1-4)

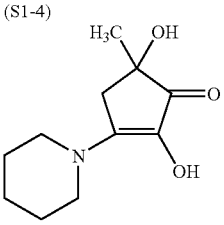

The sample obtained as mentioned above was provided as a sample (a)-101. Furthermore, samples (a)-102 to (a)-114 were prepared in the same manner as that of the sample (a)-101, except that the emulsion of their respective blue sensitive emulsion layers were prepared as shown in Table 2.

The following experiments were performed for investigating the photographic properties of these samples, respectively.

Each coating sample was placed under the atmosphere of 10° C. and 30% RH, and was then provided with an exposure

TABLE 2

| | Emulsion of blue sensitive emulsion layer | |
|---|---|---|
| Sample | Emulsion | Metal Complex contained in emulsion |
| (a)-101 | (a)-B-1 | $[Ru(CN_6)]^{-2}$, $[IrCl_6]^{-2}$ |
| (a)-102 | (a)-B-2 | $[Fe(CN)_6]^{-2}$, $[IrCl_6]^{-2}$ |
| (a)-103 | (a)-B-3 | $[Fe(CN)_6]^{-4}$, $[IrCl_6]^{-2}$, $[IrBr_6]^{-2}$ |
| (a)-104 | (a)-B-4 | $[Ru(CN_6)]^{-4}$, $[IrCl_6]^{-2}$, $[Ir(H_2O)Cl_6]^{-2}$ |
| (a)-105 | (a)-B-5 | $[Ru(CN_6)]^{-4}$, $[IrCl_6]^{-2}$, $[Ir(5\text{-me-thia})Cl_5]^{-2}$ |
| (a)-106 | (a)-B-6 | $[Ru(CN_6)]^{-4}$, $[IrCl_6]^{-2}$, $[Ir(5\text{-me-thia})Cl_5]^{-2}$, $[Ir(H_2O)Cl_6]^{-2}$ |
| (a)-107 | (a)-B-7 | $[Ru(CN_6)]^{-4}$, $[IrCl_6]^{-2}$, $[Ir(2\text{-Cl-5-F-tda})Cl_5]^{-2}$ |
| (a)-108 | (a)-B-8 | $[Ru(CN_6)]^{-4}$, $[IrCl_6]^{-2}$, $[RhBr_6]^{-3}$ |
| (a)-109 | (a)-B-9 | $[Ru(CN_6)]^{-4}$, $[IrCl_6]^{-2}$, $[Os(NO)Cl_5]^{-2}$ |
| (a)-110 | (a)-B-10 | $[Ru(CN_6)]^{-4}$, $[IrCl_6]^{-2}$, $[RhBr_6]^{-3}$, $[Ir(5\text{-me-thia})Cl_5]^{-2}$, $[Ir(H_2O)Cl_6]^{-2}$ |
| (a)-111 | (a)-B-11 | $[Fe(CN)_6]^{-4}$, $[IrCl_6]^{-2}$, $[RhBr_6]^{-3}$ |
| (a)-112 | (a)-B-12 | $[Fe(CN)_6]^{-4}$, $[IrCl_6]^{-2}$, $[IrBr_6]^{-2}$, $[RhBr_6]^{-3}$, |
| (a)-113 | (a)-B-13 | $[Ru(CN_6)]^{-4}$, $[IrCl_6]^{-2}$, $[Os(NO)Cl_5]^{-2}$, $[Ir(5\text{-me-thia})Cl_5]^{-2}$ |
| (a)-114 | (a)-B-14 | $[Fe(CN)_6]^{-4}$, $[IrCl_6]^{-2}$, $[RhBr_6]^{-3}$, $[Ir(2\text{-Cl-5-F-tda})Cl_6]^{-2}$, $[Ir(H_2O)Cl_6]^{-2}$ |

$[Ir(5\text{-me-thia})Cl_5]^{-2}$; $[Ir(5\text{-me-thiazole})Cl_5]^{-2}$
$[Ir(2\text{-Cl-5-F-tda})Cl_5]^{-2}$; $[Ir(2\text{-Cl-5-F-thiadiazole})Cl_5]^{-2}$ by a high luminance exposure (HIE type, manufactured by Yamashita Denso, Co.) with a $10^{-6}$ second high luminescence gradation exposure for gray color sensitometry was provided. The exposed sample was subjected to the color developing process 3, 9, or 30 seconds after exposure.

The processing process will be summarized below.

Processing

The sample (a)-110 was subjected to consecutive processing until the volume of color development replenisher used in the following processing steps became 0.5 times larger than the volume of a color development tank.

| Process steps | Temp. | Time | Replenishment quantity* |
|---|---|---|---|
| Color development | 45.0° C. | 16 sec. | 45 ml |
| Whitening Fixation | 40.0° C. | 16 sec. | 35 ml |
| Rinse (1) | 40.0° C. | 8 sec. | — |
| Rinse (2) | 40.0° C. | 8 sec. | — |
| Rinse (3)** | 40.0° C. | 8 sec. | — |
| Rinse (4)** | 38.0° C. | 8 sec. | 121 ml |
| Drying | 80.0° C. | 16 sec. | |

(Note)
*Replenishment quantity per square meter of the photosensitive material
A rinse screening system (trade name: RC50D, manufactured by Fuji Photo Film Co., Ltd.) was installed in the step of rinse (3). Rinse liquid is fed out the rinse (3), and is then fed to a reverse osmosis module (RC50D) with a pump while permeated water fed from the same tank is supplied to the rinse 4**. In addition, enrichment liquid was returned to the rinse (3), while feeding the permeated water from the tank to the rinse (4). The permeate flow rate to the reverse osmosis module adjusted the circulate pumping pressure so as to be kept at 50 to 300 ml/minute, and the temperature control circulation was performed for 10 hours per day. The rinse was designed as a 4-tank countercurrent method from the rinse (1) to (4).

The composition of each processing liquid is as follows.

-continued

| Process steps | Temp. | Time | Replenishment quantity* |
|---|---|---|---|

**A rinse screening system (trade name: RC50D, manufactured by Fuji Photo Film Co., Ltd.) was installed in the step of rinse (3). Rinse liquid is fed out of the rinse (3), and is then fed to a reverse osmosis module (RC50D) with a pump while permeated water fed from the same tank is suppliedto the rinse (4). In addition, enrichment liquid was returned to the rinse (3), while feeding the permeated water from the tank to rinse (4). The permeate flow to the reverse osmosis module adjusted the circulate pumping pressure so as to be kept at 50 to 300 ml/minute, and the temperaturecontrol circulation was performed for 10 hours per day. The rinse was designed as a 4 - tank countercurrent method from the rinse (1) to (4).

| | [Tank liquid] | [Replenisher] |
|---|---|---|
| [Color development liquid] | | |
| Water | 800 ml | 600 ml |
| Fluorescent whitening agent (FL-1) | 5.0 g | 8.5 g |
| Triisopropanol amine | 8.8 g | 8.8 g |
| p-toluenesulfonic-acid sodium | 20.0 g | 20.0 g |
| Ethylenediamine 4 acetic-acid | 4.0 g | 4.0 g |
| Sodium sulfite | 0.10 g | 0.50 g |
| Potassium chloride | 10.0 g | |
| 4,5-dihydroxy benzene-1,3-sodium disulfonate | 0.50 g | 0.50 g |
| Di-sodium-N,N-bis (sulfonate ethyl) hydroxylamine | 8.5 g | 14.5 g |
| 4-amino-3-methyl-N-ethyl-N-(β-methane sulfonamide ethyl)-aniline-3/2 sulfate-monochrome hydrate | 10.0 g | 22.0 g |
| Potassium carbonate | 26.3 g | 26.3 g |
| Add water to fill up to | 1000 mL | 1000 mL |
| pH (adjusted with sulfuric acid and KOH, 25° C.) | 10.35 | 12.6 |
| [Bleach fix bath] | | |
| Water | 800 mL | 800 mL |
| Ammonium thiosulfate (750 g/L) | 107 mL | 214 mL |
| Succinic acid | 29.5 g | 59.0 g |
| Ethylenediamine tetraacetic acid iron (III) ammonium | 47.0 g | 94.0 g |
| Ethylenediamine tetraacetic acid | 1.4 g | 2.8 g |
| Nitric acid (67%) | 17.5 g | 35.0 g |
| Imidazole | 14.6 g | 29.2 g |
| Ammonium sulfite | 16.0 g | 32.0 g |
| Potassium metabisulfite | 23.1 g | 46.2 g |
| Add water to fill up to | 1000 mL | 1000 mL |
| pH (adjusted with sulfuric acid and KOH, 25° C.) | 6.00 | 6.00 |
| [Rinse liquid] | | |
| Chlorinated isocyanuric acid Na | 0.02 g | 0.02 g |
| Deionized water (5 micro S/cm or less in electric conductivity) | 1000 ml | 100 ml |
| pH (25° C.) | 6.5 | 6.5 |

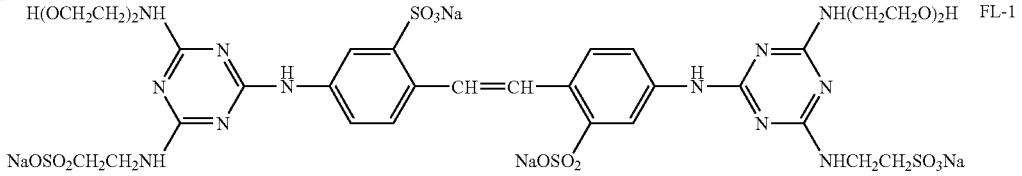

Likewise, for the exposed sample, after 3, 9, or 30 seconds passed from the exposure, the color development was performed in the same manner as described, except for changing the color development time to 30 seconds in the color developing process. Furthermore, each coated sample was placed under the atmosphere of 30° C. and 30% RH, and the same experiments were repeated.

The yellow coloring concentration of each sample after treatment was measured. The characteristic curve of quantity exposure exposure was acquired for $10^{-6}$ seconds. In the light exposure which gives a coloring concentration of 0.7 when the color development was carried out when the 16 second color development was performed after three seconds passed from the exposure under ambient atmosphere (10° C. and 30% RH), the concentration variations from 0.7 when the 16 second color development was performed after nine seconds passed from the exposure were defined as ΔD (10° C., 3"→9", 16"). In the light exposure which gives a coloring concentration of 0.7 when the color development was carried out when the 16 second color development was performed after nine seconds passed from the exposure under ambient atmosphere (10° C. and 30% RH), the concentration variations from 0.7 when the 16 second color development was performed after 30 seconds passed from the exposure were defined as ΔD (10° C., 9"→ 30", 16").

In the light exposure which gives a coloring concentration of 0.7 when the color development was carried out when the 30 second color development was performed after three seconds passed from the exposure under ambient atmosphere (10° C. and 30% RH), the concentration variations from 0.7 when the 30 second color development was performed after nine seconds passed from the exposure was defined as ΔD (10° C., 3"→9", 30"). In the light exposure which gives a coloring concentration of 0.7 when the color development was carried out when the 30 second color development was performed after nine seconds passed from the exposure under ambient atmosphere (10° C. and 30% RH), the concentration variations from 0.7 when the 30 second color development was performed after 30 seconds passed from the exposure was defined as ΔD (10° C., 9"→ 30", 30").

In the light exposure which gives a coloring concentration of 0.7 when the color development was carried out when the 16 second color development was performed after three seconds passed from the exposure under ambient atmosphere (10° C. and 30% RH), the concentration variations from 0.7 when the 16 second color development was performed after 3 seconds passed from the exposure under ambient atmosphere (30° C. and 30% RH) was defined as ΔD (10° C.→30° C., 3", 16"). In the light exposure which gives a coloring concentration of 0.7 when the color development was carried out when the 16 second color development was performed after 30 seconds passed from the exposure under ambient atmosphere (10° C. and 30% RH), the concentration variations from 0.7 when the 16 second color development was performed after 30 seconds passed from the exposure under ambient atmosphere (30° C. and 30% RH) was defined as ΔD (10° C. -> 30° C., 30", 16").

In the light exposure which gives a coloring concentration of 0.7 when the color development was carried out when the 30 second color development was performed after three seconds passed from the exposure under ambient atmosphere (10° C. and 30% RH), the concentration variations from 0.7 when the 30 second color development was performed after 3 seconds passed from the exposure under ambient atmosphere (30° C. and 30% RH) was defined as ΔD (10° C.→30° C., 3", 30"). In the light exposure which gives a coloring concentration of 0.7 when the color development was carried out when the 30 second color development was performed after 30 seconds passed from the exposure under ambient atmosphere (10° C. and 30% RH), the concentration variations from 0.7 when the 30 second color development was performed after 30 seconds passed from the exposure under ambient atmosphere (30° C. and 30% RH) was defined as ΔD (10° C.→30° C., 30", 30").

The results of these evaluations were listed in Table 3 and Table 4, respectively. It is preferable that print density is so stable as the value of each ΔD is small.

TABLE 3

| Sample | ΔD (10° C., 3"→9", 16") | ΔD (10° C., 9"→30", 16") | ΔD (10° C., 3"→9", 30") | ΔD (10° C., 9"→30", 30") | Remarks |
|---|---|---|---|---|---|
| (a)-101 | 0.18 | 0.06 | 0.03 | 0.06 | Comparative Example |
| (a)-102 | 0.20 | 0.07 | 0.04 | 0.06 | Comparative Example |
| (a)-103 | 0.19 | 0.06 | 0.05 | 0.07 | Comparative Example |
| (a)-104 | 0.10 | 0.05 | 0.04 | 0.06 | Invention |
| (a)-105 | 0.08 | 0.05 | 0.05 | 0.05 | Invention |
| (a)-106 | 0.06 | 0.06 | 0.04 | 0.07 | Invention |
| (a)-107 | 0.07 | 0.06 | 0.05 | 0.06 | Invention |
| (a)-108 | 0.09 | 0.06 | 0.04 | 0.05 | Invention |
| (a)-109 | 0.08 | 0.07 | 0.04 | 0.06 | Invention |
| (a)-110 | 0.04 | 0.05 | 0.05 | 0.05 | Invention |
| (a)-111 | 0.07 | 0.05 | 0.04 | 0.07 | Invention |
| (a)-112 | 0.08 | 0.05 | 0.04 | 0.06 | Invention |
| (a)-113 | 0.04 | 0.06 | 0.05 | 0.05 | Invention |
| (a)-114 | 0.04 | 0.05 | 0.05 | 0.05 | Invention |

The print density preferably becomes stable as each ΔD value becomes smaller.

TABLE 4

| Sample | ΔD (10° C.→ 30° C., 3", 16") | ΔD (10° C.→ 30° C., 30", 16") | ΔD (10° C.→ 30° C., 3", 30") | ΔD (10° C.→ 30° C., 30", 30") | Remarks |
|---|---|---|---|---|---|
| (a)-101 | 0.26 | 0.12 | 0.13 | 0.10 | Comparative Example |
| (a)-102 | 0.25 | 0.11 | 0.12 | 0.11 | Comparative Example |
| (a)-103 | 0.23 | 0.13 | 0.13 | 0.12 | Comparative Example |
| (a)-104 | 0.15 | 0.11 | 0.13 | 0.10 | Invention |
| (a)-105 | 0.13 | 0.13 | 0.13 | 0.12 | Invention |

TABLE 4-continued

| Sample | ΔD (10° C.→ 30° C., 3", 16") | ΔD (10° C.→ 30° C., 30", 16") | ΔD (10° C.→ 30° C., 3", 30") | ΔD (10° C.→ 30° C., 30", 30") | Remarks |
|---|---|---|---|---|---|
| (a)-106 | 0.12 | 0.11 | 0.12 | 0.10 | Invention |
| (a)-107 | 0.12 | 0.12 | 0.13 | 0.11 | Invention |
| (a)-108 | 0.13 | 0.12 | 0.12 | 0.10 | Invention |
| (a)-109 | 0.13 | 0.11 | 0.14 | 0.11 | Invention |
| (a)-110 | 0.11 | 0.11 | 0.13 | 0.12 | Invention |
| (a)-111 | 0.13 | 0.11 | 0.12 | 0.11 | Invention |
| (a)-112 | 0.13 | 0.12 | 0.13 | 0.10 | Invention |
| (a)-113 | 0.11 | 0.12 | 0.12 | 0.11 | Invention |
| (a)-114 | 0.11 | 0.11 | 0.12 | 0.11 | Invention |

The print density preferably becomes stable as each ΔD value becomes smaller.

As is evident from the results shown in Tables 3 and 4, when the samples (a)-101 to (a)-103 were processed under the conditions of short time latent image and short time color development, the stable print density could not be obtained because of an extensive change in photographic density as a result of variations in latent image time and exposure environmental temperature (Comparative Example). However, when the samples (a)-104 to 114 were processed under the conditions of short time latent image and short time color development, the stable print density could be obtained because no substantial change in photographic density was not occurred even though latent image time and exposure environmental temperature occurred (The present invention).

Example (a)-2

The following experiments were performed in order to investigate the stability in laser scan exposure on each of these samples.

As a laser optical source, a blue semiconductor laser of 440 nm in wavelength (announced by Nichia Corporation on the 48th Spring Meeting of the Japan Society of Applied Physics and Related Societies, March, 2001), a green laser of 530 nm in wavelength, pulled out of a semiconductor laser (an oscillation wavelength of about 1060 nm) by wavelength conversion using a SHG crystal of $LiNbO_3$ having a waveguide-like reverse domain structure, and a red semiconductor laser at a wavelength of abut 650 nm (trade name: Type No. HL6501 GM, manufactured by Hitachi Corporation.) were used. Each laser light of three colors moves perpendicularly to a scanning direction by a polygon mirror, and could be made to carry out sequential-scanning exposure on the sample. The quantity-of-light fluctuation by the temperature of a semiconductor laser is suppressed by temperature being kept constant using a Peltier component. An effectual beam diameter is 80 μm, a scanning pitch is 42.3 μm (600 dpi), and the average exposure time per pixel was $1.7\times10^{-7}$ seconds. Uniformal exposure of gray coloring from which the color densities of yellow, magenta, and cyan are set to about 0.7 in the sample of A4 size under the environment of 10° C. and 30% RH with this exposure method was given.

For each of the exposed samples, the color development process was performed in the same manner as that of Example (a)-1. The color development was initiated on the front end (head) of the A4 size sample being uniformly exposed at about three seconds after the exposure. For the back end portion, the color development is started at about nine seconds after exposure. The color development time was set to 16 seconds.

The yellow color densities of the head of each sample after processing and the rear end portion thereof were measured, and difference $\Delta D_Y$ was read. When the difference $\Delta D_Y$ is positive, there is a gradual increase in density from the head to the rear end (tail) of the sample. The results were shown in Table 5.

TABLE 5

| Sample | $\Delta D_Y$ | Remarks |
|---|---|---|
| (a)-101 | 0.25 | Comparative Example |
| (a)-102 | 0.23 | Comparative Example |
| (a)-103 | 0.24 | Comparative Example |
| (a)-104 | 0.12 | Invention |
| (a)-105 | 0.09 | Invention |
| (a)-106 | 0.09 | Invention |
| (a)-107 | 0.09 | Invention |
| (a)-108 | 0.10 | Invention |
| (a)-109 | 0.11 | Invention |
| (a)-110 | 0.08 | Invention |
| (a)-111 | 0.10 | Invention |
| (a)-112 | 0.10 | Invention |
| (a)-113 | 0.07 | Invention |
| (a)-114 | 0.08 | Invention |

The color difference between the head and tail of the print preferably becomes small as each $\Delta D_Y$ value becomes smaller.

As is evident from the results shown in Table 5, even though the laser scan exposure is carried out and rapid processing of a short time latent image period is performed on the samples (a)-104 to (a)-114, there is no substantial change in colors of the head and tail of the print, so that a stable quality can be obtained.

Example (a)-3

The thin-layered samples were prepared in the same manner as that of the sample (a)-101, except of configuring the photograph constitution layer as described below. The first layer (Blue-sensitive emulsion layer)

| | |
|---|---|
| The first layer (Blue-sensitive emulsion layer) | |
| Emulsion (a) B-1 | 0.14 |
| Gelatin | 0.75 |
| Yellow coupler (ExY-2) | 0.34 |
| Color image stabilizer (Cpd-1) | 0.04 |
| Color image stabilizer (Cpd-2) | 0.02 |
| Color image stabilizer (Cpd-3) | 0.04 |
| Color image stabilizer (Cpd-8) | 0.01 |
| Solvent (Solv-1) | 0.13 |
| The second layer (color mixing-contamination prevention layer) | |
| Gelatin | 0.60 |
| Color mixture inhibitor (Cpd-19) | 0.09 |
| Color image stabilizer (Cpd-5) | 0.007 |
| Color image stabilizer (Cpd-7) | 0.007 |
| UV absorber (UV-C) | 0.05 |
| Solvent (Solv-5) | 0.11 |
| The third layer (green sensitive emulsion layer) | |
| Emulsion (a)-G-1 | 0.12 |
| Gelatin | 0.73 |
| Magenta coupler (ExM) | 0.15 |
| UV absorber (UV-A) | 0.05 |
| Color image stabilizer (Cpd-2) | 0.02 |
| Color image stabilizer (Cpd-7) | 0.008 |
| Color image stabilizer (Cpd-8) | 0.07 |
| Color image stabilizer (Cpd-9) | 0.03 |
| Color image stabilizer (Cpd-10) | 0.009 |
| Color image stabilizer (Cpd-11) | 0.0001 |
| Solvent (Solv-3) | 0.06 |
| Solvent (Solv-4) | 0.11 |
| Solvent (Solv-5) | 0.06 |
| The fourth layer (color mixing-contamination prevention layer) | |
| Gelatin | 0.48 |
| Color mixing-contamination prevention layer (Cpd-4) | 0.07 |
| Color image stabilizer (Cpd-5) | 0.006 |
| Color image stabilizer (Cpd-7) | 0.006 |

-continued

| | |
|---|---|
| UV absorber (UV-C) | 0.04 |
| Solvent (Solv-5) | 0.09 |
| The fifth layer (red-sensitive emulsion layer) | |
| Emulsion (a)-R-1 | 0.10 |
| Gelatin | 0.59 |
| Cyan coupler (ExC-2) | 0.13 |
| Cyan coupler (ExC-3) | 0.03 |
| Color image stabilizer (Cpd-7) | 0.01 |

The sample obtained as described above was provided as the sample (a)-201. The samples (a)-202 to (a)-214 were also prepared in the same manner as that of the sample (a)-201, except of changing the emulsions of the blue sensitive emulsion layer as shown in Table 6. These samples were subjected to the same laser scanning exposure and processing as those of Example (a)-2 to read out $\Delta D_Y$. The results were listed in Table 6.

TABLE 6

| | Emulsion of blue sensitive emulsion layer | | | |
|---|---|---|---|---|
| Sample | Emulsion | Metal Complex contained in emulsion | $\Delta D_\gamma$ | Remarks |
| (a)-201 | (a)-B-1 | $[Ru(CN_6)]^{-2}$, $[IrCl_6]^{-2}$ | 0.22 | Comparative Example |
| (a)-202 | (a)-B-2 | $[Fe(CN)_6]^{-2}$, $[IrCl_6]^{-2}$ | 0.21 | Comparative Example |
| (a)-203 | (a)-B-3 | $[Fe(CN)_6]^{-4}$, $[IrCl_6]^{-2}$, $[IrBr_6]^{-2}$ | 0.21 | Comparative Example |
| (a)-204 | (a)-B-4 | $[Ru(CN_6)]^{-4}$, $[IrCl_6]^{-2}$, $[Ir(H_2O)Cl_6]^{-2}$ | 0.11 | Invention |
| (a)-205 | (a)-B-5 | $[Ru(CN_6)]^{-4}$, $[IrCl_6]^{-2}$, $[Ir(5\text{-me-thia})Cl_5]^{-2}$ | 0.08 | Invention |
| (a)-206 | (a)-B-6 | $[Ru(CN_6)]^{-4}$, $[IrCl_6]^{-2}$, $[Ir(5\text{-me-thia})Cl_5]^{-2}$, $[Ir(H_2O)Cl_6]^{-2}$ | 0.07 | Invention |
| (a)-207 | (a)-B-7 | $[Ru(CN_6)]^{-4}$, $[IrCl_6]^{-2}$, $[Ir(2\text{-Cl-5-F-tda})Cl_5]^{-2}$ | 0.09 | Invention |
| (a)-208 | (a)-B-8 | $[Ru(CN_6)]^{-4}$, $[IrCl_6]^{-2}$, $[RhBr_6]^{-3}$ | 0.10 | Invention |
| (a)-209 | (a)-B-9 | $[Ru(CN_6)]^{-4}$, $[IrCl_6]^{-2}$, $[Os(NO)Cl_5]^{-2}$ | 0.06 | Invention |
| (a)-210 | (a)-B-10 | $[Ru(CN_6)]^{-4}$, $[IrCl_6]^{-2}$, $[RhBr_6]^{-3}$, $[Ir(5\text{-me-thia})Cl_5]^{-2}$, $[Ir(H_2O)Cl_6]^{-2}$ | 0.09 | Invention |
| (a)-211 | (a)-B-11 | $[Fe(CN)_6]^{-4}$, $[IrCl_6]^{-2}$, $[RhBr_6]^{-3}$ | 0.09 | Invention |
| (a)-212 | (a)-B-12 | $[Fe(CN)_6]^{-4}$, $[IrCl_6]^{-2}$, $[IrBr_6]^{-2}$, $[RhBr_6]^{-3}$, | 0.09 | Invention |
| (a)-213 | (a)-B-13 | $[Ru(CN_6)]^{-4}$, $[IrCl_6]^{-2}$, $[Os(NO)Cl_5]^{-2}$, $[Ir(5\text{-me-thia})Cl_5]^{-2}$ | 0.05 | Invention |
| (a)-214 | (a)-B-14 | $[Fe(CN)_6]^{-4}$, $[IrCl_6]^{-2}$, $[RhBr_6]^{-3}$, $[Ir(2\text{-Cl-5-F-tda})Cl_6]^{-2}$, $[Ir(H_2O)Cl_6]^{-2}$ | 0.06 | Invention |

The color difference between the head and tail of the print preferably becomes small as each $\Delta D_\gamma$ value becomes smaller.

-continued

| | |
|---|---|
| Color image stabilizer (Cpd-9) | 0.04 |
| Color image stabilizer (Cpd-15) | 0.19 |
| Color image stabilizer (Cpd-18) | 0.04 |
| UV absorber (UV-7) | 0.02 |
| Solvent (Solv-5) | 0.09 |
| The sixth layer (ultraviolet absorption layer) | |
| Gelatin | 0.32 |
| UV absorber (UV-C) | 0.42 |
| Solvent (Solv-7) | 0.08 |
| The seventh layer (protective layer) | |
| Gelatin | 0.70 |
| The acrylics denaturation copolymer of polyvinyl alcohol (Degree of denaturation: 17%) | 0.04 |
| Liquid-paraffin | 0.01 |
| Surfactant (Cpd-13) | 0.01 |
| Polydimethylsilixane | 0.01 |
| Silicon dioxide | 0.003 |

(ExY-2)

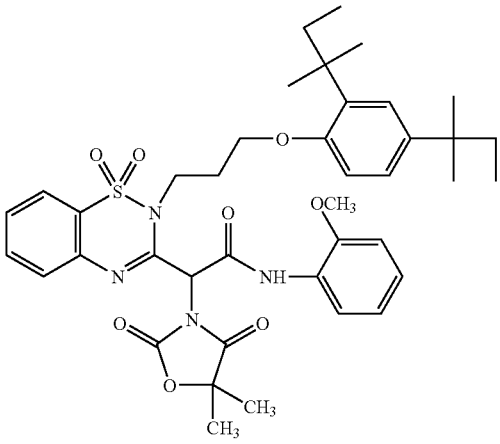

As is evident from Table 6, even though the laser scan exposure is carried out and rapid processing of a short time latent image period is performed on the samples (a)-204 to (a)-214, there is no substantial change in colors of the head and tail of the print, so that a stable quality can be obtained.

Example (b)-1

Preparation of Emulsion (b)-B-1

In the conventional method in which silver nitrate and sodium chloride were simultaneously added together in a gelatin aqueous solution being stirred, a high-silver chloride cubic emulsion having a spherical equivalent diameter of 0.54 μm and a variation coefficient of 10% was prepared. During the time period that the added amount of the silver nitrate being from 80% to 90%, potassium bromide and $K_4[Ru(CN)_6]$ were added, wherein potassium bromide was added such that the content thereof might become 2.5% by mole per mole of total silver halide in the emulsion to be obtained, and $K_4[Ru(CN)_6]$ was added so that the content of Ru might become $2\times10^{-5}$ moles per mol of total silver halide in the emulsion to be obtained, respectively. During the time period that the added amount of the silver nitrate being from 83% to 88%, a $K_2[IrCl_6]$ aqueous solution was added such that the content of Ir might become $4.8\times10^{-8}$ moles per mole of total silver halide in the emulsion to be obtained. When addition of 94% of the total amount of the silver nitrate was achieved, a potassium iodide was added (0.3% by mol per total silver halide in the emulsion to be obtained). The resulting emulsion was subjected to a demineralization treatment, followed by being dispersed with an addition of gelatin. In this emulsion, sodium benzene thiosulfonate, the sensitizing dye A, and the sensitizing dye B were added. Using the gold sulfide colloidal dispersion product as a sensitizer, the emulsion was matured so as to be optimized. Furthermore, 1-phenyl-5-mercaptotetrazole and 1-(5-methylureide phenyl)-5-mercaptotetrazole were added. The emulsion obtained as described above was defined as Emulsion (b)-B-1.

Preparation of Emulsion (b)-B-2

The emulsion (b)-B-2 was prepared in the same manner as that of the emulsion (b)-B-1, except of the follows. That is, instead of the $K_4[Ru(CN)_6]$ aqueous solution, during the time period that the added amount of the silver nitrate being from 80% to 90%, a $K_4[Fe(CN)_6]$ aqueous solution was added such that the content of Fe might become $2\times10^{-5}$ moles per mole of total silver halide in the emulsion to be obtained.

Preparation of Emulsion (b)-B-3

The emulsion (b)-B-3 was prepared in the same manner as that of the emulsion (b)-B-1 except of the follows. That is, instead of the $K_4[Ru(CN)_6]$ aqueous solution, during the time period that the added amount of the silver nitrate being from 80% to 90%, a $K_4[Fe(CN)_6]$ aqueous solution was added such that the content of Fe might become $2\times10^{-5}$ moles per mole of total silver halide in the emulsion to be obtained. During the time period that the added amount of the silver nitrate being from 82% to 88%, a $K_2[IrCl_6]$ aqueous solution was added such that the content of Ir might become $2.3\times10^{-8}$ moles per mole of total silver halide in the emulsion to be obtained. Furthermore, during the time period that the added amount of the silver nitrate being from 82% to 88%, a $K_2[IrBr_6]$ aqueous solution was added such that the content of Ir might become $3.6\times10^{-8}$ moles per mole of total silver halide in the emulsion to be obtained.

Preparation of Emulsion (b)-B-4

The emulsion (b)-B-4 was prepared in the same manner as that of the emulsion (b)-B-1 except of the follows. That is, during the time period that the added amount of the silver nitrate being from 82% to 88%, a $K_2[IrCl_6]$ aqueous solution was added such that the content of Ir might become $2.3\times10^{-8}$ moles per mole of total silver halide in the emulsion to be obtained. During the time period that the added amount of the silver nitrate being from 92% to 98%, a $K_2[Ir(H_2o)Cl_5]$ aqueous solution was added such that the content of Ir might become $3.2\times10^{-6}$ moles per mole of total silver halide in the emulsion to be obtained.

Preparation of Emulsion (b)-B-5

The emulsion (b)-B-5 was prepared in the same manner as that of the emulsion (b)-B-1 except of the follows. That is, during the time period that the added amount of the silver nitrate being from 82% to 88%, a $K_2[IrCl_6]$ aqueous solution was added such that the content of Ir might become $1.0\times10^{-8}$ moles per mole of total silver halide in the emulsion to be obtained. During the time period that the added amount of the silver nitrate being from 92% to 98%, a $K_2[Ir(5\text{-methylthiazole})Cl_5]$aqueous solution was added such that the content of Ir might become $6.7\times10^{-7}$ moles per mole of total silver halide in the emulsion to be obtained.

Preparation of Emulsion (b)-B-6

The emulsion (b)-B-6 was prepared in the same manner as that of the emulsion (b)-B-1 except of the follows. That is, during the time period that the added amount of the silver nitrate being from 82% to 88%, a $K_2[IrCl_6]$ aqueous solution was added such that the content of Ir might become $6.0\times10^{-9}$ moles per mole of total silver halide in the emulsion to be obtained. During the time period that the added amount of the silver nitrate being from 92% to 98%, a $K_2[Ir(5\text{-methylthiazole})Cl_5]$ aqueous solution was added such that the content of Ir might become $5.4\times10^{-7}$ moles per mole of total silver halide in the emulsion to be obtained and a $K_2[Ir(H_2O)Cl_5]$ aqueous solution was added such that the content of Ir might become $2.2\times10^{-6}$ moles per mole of total silver halide in the emulsion to be obtained.

Preparation of Emulsion (b)-B-7

The emulsion (b)-B-7 was prepared in the same manner as that of the emulsion (b)-B-1 except of the follows. That is, during the time period that the added amount of the silver nitrate being from 60% to 80%, a $K_3[RhBr_6]$ aqueous solution was added such that the content of Rh might become $3.2\times10^{-9}$ moles per mole of total silver halide in the emulsion to be obtained. During the time period that the added amount of the silver nitrate being from 82% to 88%, a $K_2[IrCl_6]$ aqueous solution was added such that the content of Ir might become $2.3\times10^{-8}$ moles per mole of total silver halide in the emulsion to be obtained.

Preparation of Emulsion (b)-B-8

The emulsion (b)-B-8 was prepared in the same manner as that of the emulsion (b)-B-1 except of the follows. That is, during the time period that the added amount of the silver nitrate being from 60% to 80%, a $Cs_2[Os(NO)Cl_5]$ aqueous solution was added such that the content of Os might become $3.1\times10^{-9}$ moles per mole of total silver halide in the emulsion to be obtained. During the time period that the added amount of the silver nitrate being from 82% to 88%, a $K_2[IrCl_6]$ aqueous solution was added such that the content of Ir might become $2.3\times10^{-8}$ moles per mole of total silver halide in the emulsion to be obtained.

Preparation of Emulsion (b)-B-9

The emulsion (b)-B-9 was prepared in the same manner as that of the emulsion (b)-B-1 except of the follows. That is, during the time period that the added, amount of the silver nitrate being from 60% to 80%, a $K_3[RhBr_6]$ aqueous solution was added such that the content of Rh might become $2.5\times10^{-9}$ moles per mole of total silver halide in the emulsion to be obtained. During the time period that the added amount of the silver nitrate being from 82% to 88%, a $K_2[IrCl_6]$ aqueous solution was added such that the content of Ir might become $6.0\times10^{-9}$ moles per mole of total silver halide in the emulsion to be obtained. Furthermore, during the time period that the added amount of the silver nitrate being from 92% to 98%, a $K_2[Ir(5\text{-methylthiazole})Cl_5]$ aqueous solution and a $K_2[Ir(H_2O)Cl_5]$ aqueous solution were added, wherein the $K_2[Ir(5\text{-methylthiazole})Cl_5]$ aqueous solution was added such that the content of Ir might become $5.4\times10^{-7}$ moles per mole of total silver halide in the emulsion to be obtained and the $K_2[Ir(H_2O)Cl_5]$ aqueous solution was added such that the content of Ir might become $2.2\times10^{-6}$ moles per mole of total silver halide in the emulsion to be obtained.

Preparation of Emulsion (b)-B-10

The emulsion (b)-B-10 was prepared in the same manner as that of the emulsion (b)-B-1 except of the follows. That is, during the time period that the added amount of the silver nitrate being from 60% to 80%, a $K_3[RhBr_6]$ aqueous solution was added such that the content of Rh might become $3.2\times10^{-9}$ moles per mole of total silver halide in the emulsion to be obtained. Instead of $K_4[Ru(CN)_6]$ aqueous solution, during the time period that the added amount of the silver nitrate being from 80% to 90%, a $K_2[Fe(CN)_6]$ aqueous solution was added such that the content of Fe might become $2\times10^{-5}$ moles per mole of total silver halide in the emulsion to be obtained. Furthermore, during the time period that the added amount of the silver nitrate being from 82% to 88%, a $K_2[IrCl_6]$ aqueous solution was added such that the content of Ir might become $2.3\times10^{-8}$ moles per mole of total silver halide in the emulsion to be obtained.

Preparation of Emulsion (b)-B-11

The emulsion (b)-B-11 was prepared in the same manner as that of the emulsion (b)-B-1 except of the follows. That is, during the time period that the added amount of the silver nitrate being from 60% to 80%, a $K_3[RhBr_6]$ aqueous solution was added such that the content of Rh might become $3.2\times10^{-9}$ moles per mole of total silver halide in the emulsion to be obtained. Instead of $K_4[RuCN)_6]$ aqueous solution, during the time period that the added amount of the silver nitrate being from 80% to 90%, a $K_4[Fe(CN)_6]$ aqueous solution was added such that the content of Fe might become $2\times10^{-5}$ moles per mole of total silver halide in the emulsion to be obtained. Furthermore, during the time period that the added amount of the silver nitrate being from 82% to 88%, a $K_2[IrCl_6]$ aqueous solution and a $K_2[IrBr_6]$ aqueous solution were added, wherein the $K_2[IrCl_6]$ aqueous solution was added such that the content of Ir might become $1.6\times10^{-8}$ moles per mole of total silver halide in the emulsion to be obtained and the $K_2[IrBr_6]$ aqueous solution was added such that the content of Ir might become $2.3\times10^{-8}$ moles per mole of total silver halide in the emulsion to be obtained.

Preparation of Emulsion (b)-B-12

The emulsion (b)-B-12 was prepared in the same manner as that of the emulsion (b)-B-1 except of the follows. That is, during the time period that the added amount of the silver nitrate being from 60% to 80%, a $Cs_2[Os(NO)Cl_5]$ aqueous solution was added such that the content of Os might become $3.1\times10^{-9}$ moles per mole of total silver halide in the emulsion to be obtained. During the time period that the added amount of the silver nitrate being from 82% to 88%, a $K_2[IrCl_6]$ aqueous solution was added such that the content of Ir might become $6\times10^{-9}$ moles per mole of total silver halide in the emulsion to be obtained. Furthermore, during the time period that the added amount of the silver nitrate being from 92% to 98%, a $K_2[Ir(5\text{-methylthiazole})Cl_5]$ aqueous solution was added such that the content of Ir might become $5.0\times10^{-7}$ moles per mole of total silver halide in the emulsion to be obtained.

Preparation of Emulsion (b)-G-1

In the conventional method in which silver nitrate and sodium chloride were simultaneously added together in a gelatin aqueous solution being stirred, a high-silver chloride cubic emulsion having a spherical equivalent diameter of 0.40 μm and a variation coefficient of 10% was prepared. During the time period that the added amount of the silver nitrate being from 80% to 90%, $K_4[Ru(CN)_6]$ was added so that the content of Ru might become $3.0\times10^{-5}$ moles per mol of total silver halide in the emulsion to be obtained. During the time period that the added amount of the silver nitrate being from 80% to 100%, potassium bromide (4% by mole per mole of total silver halide in the emulsion to be obtained) was added. During the time period that the added amount of the silver nitrate being from 83% to 88%, a $K_2[IrCl_6]$ was added such that a content of Ir might become $5.0\times10^{-8}$ moles per mole of total silver halide in the emulsion to be obtained. When the addition of 90% of total silver silver nitrate was achieved, the potassium iodide was added (0.2% by mole per mole of total silver halide in the emulsion to be obtained). The resulting emulsion was subjected to a demineralization treatment, followed by being dispersed with an addition of gelatin. In this emulsion, sodium benzene thiosulfonate was added. A gold sulfide colloidal dispersion product was added as a sensitizer, and then the emulsion was matured so as to be optimized. Furthermore, the sensitizing dye C, 1-phenyl-5-mercaptotetrazole and 1-(5-methylureide phenyl)-5-mercaptotetrazole and potassium bromide were added. The emulsion obtained as described above was defined as Emulsion (b)-G-1.

Preparation of Emulsion (b)-R-1

In the conventional method in which silver nitrate and sodium chloride were simultaneously added together in a gelatin aqueous solution being stirred, a high-silver chloride cubic emulsion having a spherical equivalent diameter of 0.35 μm and a variation coefficient of 10% was prepared. During the time period that the added amount of the silver nitrate being from 80% to 90%, $K_4[Ru(CN)_6]$ was added so that the content of Ru might become $3\times10^{-5}$ moles per mol of total silver halide in the emulsion to be obtained. During the time period that the added amount of the silver nitrate being from 80% to 100%, potassium bromide (4.3% by mole per silver halide) was added. During the time period that the added amount of the silver nitrate being from 83% to 88%, a $K_2[IrCl_6]$ was added such that a content of Ir might become $5.0\times10^{-9}$ moles per mole of total silver halide in the emulsion to be obtained. When the addition of 90% of total silver silver nitrate was achieved, the potassium iodide was added (0.15% by mole per mole of total silver halide in the emulsion to be obtained). The resulting emulsion was subjected to a demineralization treatment, followed by being dispersed with an addition of gelatin. In this emulsion, sodium benzene thiosulfonate was added. Further, using sodium thiosulfonate 5-hydride as a sulfur sensitizer, and using bis (1,2,4-triazolium-3-thiorate) olate (I) tetrafluoroborate as a gold sensitizer, the emulsion was matured so as to be optimized. Furthermore, the sensitizing dye H, 1-phenyl-5-mercaptotetrazole and 1-(5-methylureide phenyl)-5-mercaptotetrazole, the compound (I) and potassium bromide were added. The emulsion obtained as described above was defined as Emulsion (b)-R-1.

Samples

With respect to emulsion layers, the sample (b)-101 was prepared in the same manner and constitution as that of Example (a)-1, except that instead of the emulsion (a)B-1, the emulsion (a)-G-1, and the emulsion (a)-R-1, the emulsion (b)-B-1, the emulsion (b)-G-1, and the emulsion (b)-R-1 were used respectively. Furthermore, the samples (b)-102 to (b)-112 were also prepared in the same manner as that of the sample (b)-101, except that the emulsion of the blue sensitive emulsion layer was prepared as shown in FIG. 7.

TABLE 7

| | Emulsion of blue sensitive emulsion layer | |
|---|---|---|
| Sample | Emulsion | Metal Complex contained in emulsion |
| (b)-101 | (b)-B-1 | $[Ru(CN_6)]^{-2}$, $[IrCl_6]^{-2}$ |
| (b)-102 | (b)-B-2 | $[Fe(CN)_6]^{-2}$, $[IrCl_6]^{-2}$ |
| (b)-103 | (b)-B-3 | $[Fe(CN)_6]^{-4}$, $[IrCl_6]^{-2}$, $[IrBr_6]^{-2}$ |
| (b)-104 | (b)-B-4 | $[Ru(CN_6)]^{-4}$, $[IrCl_6]^{-2}$, $[Ir(H_2O)Cl_6]^{-2}$ |
| (b)-105 | (b)-B-5 | $[Ru(CN_6)]^{-4}$, $[IrCl_6]^{-2}$, $[Ir(5\text{-me-thia})Cl_5]^{-2}$ |

TABLE 7-continued

| | Emulsion of blue sensitive emulsion layer | |
|---|---|---|
| Sample | Emulsion | Metal Complex contained in emulsion |
| (b)-106 | (b)-B-6 | $[Ru(CN_6)]^{-4}$, $[IrCl_6]^{-2}$, $[Ir(5\text{-me-thia})Cl_5]^{-2}$, $[Ir(H_2O)Cl_6]^{-2}$ |
| (b)-107 | (b)-B-7 | $[Ru(CN_6)]^{-4}$, $[IrCl_6]^{-2}$, $[RhBr_6]^{-3}$ |
| (b)-108 | (b)-B-8 | $[Ru(CN_6)]^{-4}$, $[IrCl_6]^{-2}$, $[Os(NO)Cl_5]^{-2}$ |
| (b)-109 | (b)-B-9 | $[Ru(CN_6)]^{-4}$, $[IrCl_6]^{-2}$, $[RhBr_6]^{-3}$, $[Ir(5\text{-me-thia})Cl_5]^{-2}$, $[Ir(H_2O)Cl_6]^{-2}$ |
| (b)-110 | (b)-B-10 | $[Ru(CN_6)]^{-4}$, $[IrCl_6]^{-2}$, $[RhBr_6]^{-3}$ |
| (b)-111 | (b)-B-11 | $[Fe(CN)_6]^{-4}$, $[IrCl_6]^{-2}$, $[IrBr_6]^{-2}$, $[RhBr_6]^{-3}$ |
| (b)-112 | (b)-B-12 | $[Fe(CN)_6]^{-4}$, $[IrCl_6]^{-2}$, $[Os(NO)Cl_5]^{-2}$, $[Ir(5\text{-me-thia})Cl_5]^{-2}$ |

$[Ir(5\text{-me-thia})Cl_5]^{-2}$; $[Ir(5\text{-me-thiazole})Cl_5]^{-2}$

For investigating the stabilities of these samples for the laser scanning exposure, the following two kinds of the optical sources were examined.

Optical Source A

As a laser optical source, a blue laser of 470 nm in wavelength, pulled out of a semiconductor laser (an oscillation wavelength of about 940 nm) by wavelength conversion using a SHG crystal of $LiNbO_3$ having a waveguide-like reverse domain structure, a green laser of 530 nm in wavelength, pulled out of a semiconductor laser (having an oscillation wavelength of about 1060 nm) by wavelength conversion using a SHG crystal of $LiNbO_3$ having a waveguide-like reverse domain structure, and a red semiconductor laser at a wavelength of about 650 nm (trade name: Type No. HL6501 GM, manufactured by Hitachi Corporation.) were used. Each laser of three colors was set to be capable of moving perpendicularly to a scanning direction by a polygon mirror, and carrying out sequential-scanning exposure on the sample. Fluctuations of quantity of light according to the temperature of the semiconductor lasers were suppressed by keeping temperature thereof constant using a Peltier component. An effectual beam diameter was 80 μm and a scanning pitch was 42.3 μm (600 dpi). The average exposure time per pixel was $1.7\times10^{-7}$ seconds.

Optical Source B

The optical source B was the same one as that of the optical source A, except that instead of the blue laser of about 470 nm, a blue semiconductor laser with a wave length of about 440 nm (the blue semiconductor laser (announced by Nichia Corporation on the 48th Spring Meeting of the Japan Society of Applied Physics and Related Societies, March, 2001) was used.

Uniformal exposure for gray coloring in which the color densities of yellow, magenta, and of cyan are set to about 0.8 in the sample of A4 size under the conditions of 10° C. and 30% RH was given using the optical source A or the optical source B.

The following color development processing was performed to each exposed sample. As for the point of each exposed A4 size sample, color development was started at the head in about 4 seconds after exposure, and, as for the tail of each exposed A4 size sample, color development was started in about 9 seconds after exposure.

Continuous color development processing was performed on the same conditions as an embodiment (a)-1.

With respect to the exposed sample, likewise, the different color developing process was performed while changing the color developing time to 30 seconds in the above color developing process. Furthermore, each coating sample was placed under the ambient atmosphere condition of 30° C. and 30% RH, and the same experiment was repeated.

The yellow coloring concentration of the point and the back end section of each sample after processing was measured, and difference $\Delta D_Y$ was read.

When difference $\Delta D_Y$ is positive, it is shown that the concentration increases from the tail to the head. $\Delta D_Y$(A, 10° C., 16") showed the result at the time of carrying out in color development time 16 seconds under the ambient atmosphere of 10° C. and 30% RH using an optical source A. Likewise, $\Delta D_Y$(B, 10° C., 16"), $\Delta D_Y$(A, 30° C., 16"), $\Delta D_Y$(B, 30° C., 16"), $\Delta D_Y$(A, 10° C., 30"), $\Delta D_Y$(B, 10° C., 30"), $\Delta D_Y$(A, 30° C., 30"), and $\Delta D_Y$(B, 30° C., 30") were calculated, respectively. (Here, " means a "second.")

These results were shown in Table 8.

TABLE 8

| Sample | $\Delta D_Y$ (A, 10° C., 16") | $\Delta D_Y$ (B 10° C., 16") | $\Delta D_Y$ (A, 30° C., 16") | $\Delta D_Y$ (B, 30° C., 16") | $\Delta D_Y$ (A, 10° C., 30") | $\Delta D_Y$ (B 10° C., 30") | $\Delta D_Y$ (A, 30° C., 30") | $\Delta D_Y$ (B, 30° C., 30") | Remarks |
|---|---|---|---|---|---|---|---|---|---|
| (b)-101 | 0.06 | 0.18 | 0.04 | 0.14 | 0.07 | 0.10 | 0.06 | 0.09 | Comparative Example |
| (b)-102 | 0.07 | 0.16 | 0.03 | 0.15 | 0.06 | 0.11 | 0.05 | 0.09 | Comparative Example |
| (b)-103 | 0.07 | 0.17 | 0.05 | 0.14 | 0.05 | 0.11 | 0.06 | 0.10 | Comparative Example |
| (b)-104 | 0.06 | 0.09 | 0.04 | 0.07 | 0.06 | 0.08 | 0.04 | 0.07 | Invention |
| (b)-105 | 0.05 | 0.06 | 0.05 | 0.05 | 0.05 | 0.06 | 0.04 | 0.05 | Invention |
| (b)-106 | 0.06 | 0.06 | 0.06 | 0.06 | 0.07 | 0.06 | 0.05 | 0.06 | Invention |
| (b)-107 | 0.07 | 0.07 | 0.04 | 0.05 | 0.06 | 0.07 | 0.07 | 0.06 | Invention |
| (b)-108 | 0.05 | 0.07 | 0.03 | 0.07 | 0.05 | 0.06 | 0.04 | 0.05 | Invention |
| (b)-109 | 0.06 | 0.05 | 0.04 | 0.05 | 0.07 | 0.05 | 0.05 | 0.05 | Invention |
| (b)-110 | 0.07 | 0.07 | 0.04 | 0.06 | 0.06 | 0.06 | 0.05 | 0.06 | Invention |

TABLE 8-continued

| Sample | $\Delta D_Y$ (A, 10° C., 16") | $\Delta D_Y$ (B 10° C., 16") | $\Delta D_Y$ (A, 30° C., 16") | $\Delta D_Y$ (B, 30° C., 16") | $\Delta D_Y$ (A, 10° C., 30") | $\Delta D_Y$ (B 10° C., 30") | $\Delta D_Y$ (A, 30° C., 30") | $\Delta D_Y$ (B, 30° C., 30") | Remarks |
|---|---|---|---|---|---|---|---|---|---|
| (b)-111 | 0.06 | 0.07 | 0.06 | 0.07 | 0.05 | 0.07 | 0.04 | 0.07 | Invention |
| (b)-112 | 0.06 | 0.05 | 0.05 | 0.05 | 0.05 | 0.06 | 0.06 | 0.06 | Invention |

The color difference between the head and tail of the print preferably becomes small as each $\Delta D_Y$ value becomes smaller.

As is evident from the results shown in Table 8, when the samples (b)-101 to (b)-110 (Comparative Examples) were exposed using the optical source B, it was clear that the color difference of the head and tail of the paper is large, and the quality was not stabilized. On the other hand, in the case of exposing the samples (b)-104 to (b)-112 (the present invention) using the optical source B, there was no substantial difference between the head and tail of the paper with respect to color. Therefore, stable qualities can be obtained. This effect was remarkable when exposure was carried out with a blue laser having wavelength from 440 nm to 480 nm, and when color development time was short. When a time period from exposure to starting the color was enough as 10 seconds or more, only a little color difference was observed even in the samples (b)-101 to (b)-110.

Example (b)-2

Preparation of Emulsion (b)-B-H1

In the conventional method in which silver nitrate and sodium chloride were simultaneously added together in a gelatin aqueous solution being stirred, a high-silver chloride cubic emulsion having a spherical equivalent diameter of 0.53 μm and a variation coefficient of 10% was prepared. During the time period that the added amount of the silver nitrate being from 80% to 90%, potassium bromide (2 mol % per mole of total silver halide in the emulsion to be obtained) and $K_4[Ru(CN)_6]$ were added. During the time period that the added amount of the silver nitrate being from 83% to 88%, a $K_2[IrCl_6]$ was added. When the addition of 90% of total silver silver nitrate was achieved, the potassium iodide was added (0.23 mol % per total silver halide in the emulsion to be obtained). The resulting emulsion was subjected to a demineralization treatment, followed by being dispersed with an addition of gelatin. In this emulsion, sodium benzene thiosulfonate, the sensitizing dye A, and the sensitizing dye B were added, and thioglucose gold was used as a sensitizer so as to be matured to be optimal. Furthermore, 1-phenyl-5-mercaptotetrazole and 1-(5-methylureide phenyl)-5-mercaptotetrazole were added. The emulsion obtained as described above was defined as Emulsion (b)-B-H1.

Preparation of Emulsion (b)-B-L1

In the conventional method in which silver nitrate and sodium chloride were simultaneously added together in a gelatin aqueous solution being stirred, a high-silver chloride cubic emulsion having a spherical equivalent diameter of 0.43 μm and a variation coefficient of 10% was prepared. During the time period that the added amount of the silver nitrate being from 80% to 90%, potassium bromide (2 mol % per mole of total silver halide in the emulsion to be obtained) and $K_4[Ru(CN)_6]$ were added. During the time period that the added amount of the silver nitrate being from 83% to 88%, a $K_2[IrCl_6]$ was added. When the addition of 90% of total silver silver nitrate was achieved, the potassium iodide was added (0.23 mol % per total silver halide in the emulsion to be obtained). The resulting emulsion was subjected to a demineralization treatment, followed by being dispersed with an addition of gelatin. In this emulsion, sodium benzene thiosulfonate, the sensitizing dye A, and the sensitizing dye B were added, and thioglucose gold was used as a sensitizer so as to be matured to be optimal. Furthermore, 1-phenyl-5-mercaptotetrazole and 1-(5-methylureide phenyl)-5-mercaptotetrazole were added. The emulsion obtained as described above was defined as Emulsion (b)-B-L1.

Preparation of Emulsion (b)-B-H2

In the conventional method in which silver nitrate and sodium chloride were simultaneously added together in a gelatin aqueous solution being stirred, a high-silver chloride cubic emulsion having a spherical equivalent diameter of 0.55 μm and a variation coefficient of 10% was prepared. During the time period that the added amount of the silver nitrate being from 50% to 80%, $Cs_2[OsCl_5(NO)]$ were added so that the content of Os might become $2\times10^{-9}$ moles per mol of total silver halide in the emulsion to be obtained. During the time period that the added amount of the silver nitrate being from 80% to 90%, potassium bromide (3 mol % per mole of total silver halide in the emulsion to be obtained) and $K_4[Ru(CN)_6]$ were added. During the time period that the added amount of the silver nitrate being from 83% to 88%, a $K_2[IrCl_6]$ was added. When the addition of 90% of total silver silver nitrate was achieved, the potassium iodide was added (0.31 mol % per total silver halide in the emulsion to be obtained). During the time period that the added amount of the silver nitrate being from 92% to 98%, $K_2[Ir(5\text{-methylthiazole})Cl_5]$ was added such that a content of Ir might become $2\times10^{-7}$ moles per mole of total silver halide in the emulsion to be obtained. The resulting emulsion was subjected to a demineralization treatment, followed by being redispersed with the addition of gelatin. In this emulsion, sodium benzene thiosulfonate, the sensitizing dye A, and the sensitizing dye B were added, and thioglucose gold was used as a sensitizer so as to be matured to be optimal. Furthermore, 1-phenyl-5-mercaptotetrazole and 1-(5-methylureide phenyl)-5-mercaptotetrazole were added. The emulsion obtained as described above was defined as Emulsion (b)-B-H2.

Preparation of Emulsion (b)-B-L2

In the conventional method in which silver nitrate and sodium chloride were simultaneously added together in a gelatin aqueous solution being stirred, a high-silver chloride cubic emulsion having a spherical equivalent diameter of 0.45 μm and a variation coefficient of 10% was prepared. During the time period that the added amount of the silver nitrate being from 50% to 80%, $Cs_2[OsCl_5(NO)]$ were added so that the content of Os might become $5\times10^{-9}$ moles per mol of total silver halide in the emulsion to be obtained. During the time period that the added amount of the silver nitrate being from 80% to 90%, potassium bromide (3 mol % per mole of total silver halide in the emulsion to be obtained) and $K_4[Ru(CN)_6]$ were added. During the time period that the added amount of the silver nitrate being from 83% to 88%, a $K_2[IrCl_6]$ was added. When the addition of 90% of total silver silver nitrate was achieved, the potassium iodide was added (0.31 mol % per total silver halide in the emulsion to be obtained). During the time period that the added amount of the silver nitrate being from 92% to 98%, $K_2[Ir(5\text{-methylthiazole})Cl_5]$ was added such that a content of Ir might become $5\times10^{-7}$ moles per mole of total silver halide in the emulsion to be obtained. The resulting emulsion was subjected to a demineralization treatment, followed by being redispersed with the addition of gelatin. In this emulsion, sodium benzene thiosulfonate, the sensitizing dye A, and the sensitizing dye B were added, and thioglucose gold was used as a sensitizer so as to be matured in an optimum. Furthermore, 1-phenyl-5-mercaptotetrazole and 1-(5-methylureide phenyl)-5-mercaptotetrazole were added. Thus, the emulsion obtained as described above was defined as Emulsion (b)-B-L2.

Preparation of Emulsion (b)-G-H1

In the conventional method in which silver nitrate and sodium chloride were simultaneously added together in a gelatin aqueous solution being stirred, a high-silver chloride cubic emulsion having a spherical equivalent diameter of 0.38 μm and a variation coefficient of 10% was prepared. During the time period that the added amount of the silver nitrate being from 80% to 90%, $K_4[Ru(CN)_6]$ was added. During the time period that the added amount of the silver nitrate being from 80% to 100%, potassium bromide (3 mol % per mole of total silver halide in the emulsion to be obtained) was added. During the time period that the added amount of the silver nitrate being from 83% to 88%, a $K_2[IrCl_6]$ was added. When the addition of 90% of total silver silver nitrate was achieved, the potassium iodide (0.15 mol % per total silver halide in the emulsion to be obtained) was added. The resulting emulsion was subjected to a demineralization treatment, followed by being redispersed with the addition of gelatin. In this emulsion, sodium benzene thiosulfonate was added. In addition, sulfur gold colloid dispersed product was used as a sensitizer for maturation in an optimum manner. Furthermore, the sensitizing dye C, 1-phenyl-5-mercaptotetrazole, 1-(5-methylureide phenyl)-5-mercaptotetrazole, and potassium bromide were added. Thus, the emulsion obtained as described above was defined as Emulsion (b)-G-H1.

Preparation of Emulsion (b)-G-L1

In the conventional method in which silver nitrate and sodium chloride were simultaneously added together in a gelatin aqueous solution being stirred, a high-silver chloride cubic emulsion having a spherical equivalent diameter of 0.28 μm and a variation coefficient of 10% was prepared. During the time period that the added amount of the silver nitrate being from 80% to 90%, $K_4[Ru(CN)_6]$ was added. During the time period that the added amount of the silver nitrate being from 80% to 100%, potassium bromide (3 mol % per mole of total silver halide in the emulsion to be obtained) was added. During the time period that the added amount of the silver nitrate being from 83% to 88%, a $K_2[IrCl_6]$ was added. When the addition of 90% of total silver silver nitrate was achieved, the potassium iodide (0.15 mol % per total silver halide in the emulsion to be obtained) was added. The resulting emulsion was subjected to a demineralization treatment, followed by being redispersed with the addition of gelatin. In this emulsion, sodium benzene thiosulfonate was added. In addition, sulfur gold colloid dispersed product was used as a sensitizer for maturation in an optimum manner. Furthermore, the sensitizing dye C, 1-phenyl-5-mercaptotetrazole, 1-(5-methylureide phenyl)-5-mercaptotetrazole, and potassium bromide were added. Thus, the emulsion obtained as described above was defined as Emulsion (b)-G-L1.

Preparation of Emulsion (b)-G-H2

In the conventional method in which silver nitrate and sodium chloride were simultaneously added together in a gelatin aqueous solution being stirred, a high-silver chloride cubic emulsion having a spherical equivalent diameter of 0.39 μm and a variation coefficient of 10% was prepared. During the time period that the added amount of the silver nitrate being from 50% to 80%, $Cs_2[OsCl_5(NO)]$ were added so that the content of Os might become $2\times10^{-8}$ moles per mol of total silver halide in the emulsion to be obtained. During the time period that the added amount of the silver nitrate being from 80% to 90%, $K_4[Ru(CN)_6]$ was added. During the time period that the added amount of the silver nitrate being from 80% to 100%, potassium bromide (3 mol % per mole of total silver halide in the emulsion to be obtained) was added. During the time period that the added amount of the silver nitrate being from 83% to 88%, a $K_2[IrCl_6]$ was added. When the addition of 90% of total silver silver nitrate was achieved, the potassium iodide (0.2 mol % per total silver halide in the emulsion to be obtained) was added. Furthermore, during the time period that the added amount of the silver nitrate being from 92% to 98%, a $K_2[Ir(5\text{-methylthiazole})Cl_5]$ was added such that a content of Ir might become $4\times10^{-7}$ moles per mole of total silver halide in the emulsion to be obtained. The resulting emulsion was subjected to a demineralization treatment, followed by being redispersed with the addition of gelatin. In this emulsion, sodium benzene thiosulfonate was added. In addition, sulfur gold colloid dispersed product was used as a sensitizer for maturation in an optimum manner. Furthermore, the sensitizing dye C, 1-phenyl-5-mercaptotetrazole, 1-(5-methylureide phenyl)-5-mercaptotetrazole, and potassium bromide were added. Thus, the emulsion obtained as described above was defined as Emulsion (b)-G-H2.

Preparation of Emulsion (b)-G-L2

In the conventional method in which silver nitrate and sodium chloride were simultaneously added together in a gelatin aqueous solution being stirred, a high-silver chloride cubic emulsion having a spherical equivalent diameter of 0.29 μm and a variation coefficient of 10% was prepared. During the time period that the added amount of the silver nitrate being from 50% to 80%, $Cs_2[OsCl_5(NO)]$ were added so that the content of Os might become $6\times10^{-8}$ moles per mol of total silver halide in the emulsion to be obtained. During the time period that the added amount of the silver nitrate being from 80% to 90%, $K_4[Ru(CN)_6]$ was added. During the time period that the added amount of the silver nitrate being from 80% to 100%, potassium bromide (3 mol % per mole of total silver halide in the emulsion to be obtained) was added. During the time period that the added amount of the silver nitrate being from 83% to 88%, a $K_2[IrCl_6]$ was added. When the addition of 90% of total silver silver nitrate was achieved, the potassium iodide (0.2 mol % per total silver halide in the emulsion to be obtained) was added. Further-more, during the time period that the added amount of the silver nitrate being from 92% to 98%, a $K_2[Ir(5\text{-methylthiazole})Cl_5]$ aqueous solution was added such that the content of Ir might become $1.2\times10^{-6}$ moles per mole of total silver halide in the emulsion to be obtained. The resulting emulsion was subjected to a demineralization treatment, followed by being redispersed with the addition of gelatin. In this emulsion, sodium benzene thiosulfonate was added. In addition, sulfur gold colloid dispersed product was used as a sensitizer for maturation in an optimum manner. Furthermore, the sensitizing dye C, 1-phenyl-5-mercaptotetrazole, 1-(5-methylureide phenyl)-5-mercaptotetrazole, and potassium bromide were added. Thus, the emulsion obtained as described above was defined as Emulsion (b)-G-L2.

Preparation of Emulsion (b)-R-H1

In the conventional method in which silver nitrate and sodium chloride were simultaneously added together in a gelatin aqueous solution being stirred, a high-silver chloride cubic emulsion having a spherical equivalent diameter of 0.38 μm and a variation coefficient of 10% was prepared. During the time period that the added amount of the silver nitrate being from 80% to 90%, $K_4[Ru(CN)_6]$ was added. During the time period that the added amount of the silver nitrate being from 80% to 100%, potassium bromide (3 mol % per mole of total silver halide in the emulsion to be obtained) was added. During the time period that the added amount of the silver nitrate being from 83% to 88%, a $K_2[IrCl_6]$ was added. When the addition of 90% of total silver silver nitrate was achieved, the potassium iodide (0.15 mol % per total silver halide in the emulsion to be obtained) was added. The resulting emulsion was subjected to a demineralization treatment, followed by being redispersed with the addition of gelatin. In this emulsion, sodium benzene thiosulfonate was added. In addition, sodium thiosulfate 5-hydrate was added as a sulfur sensitizer, and bis(1,4,5-trimethyl-1,2,4-triazolium-3-thiorate)olate (I) tetrafluoroborate was used as a gold sentitizer for maturation in an optimizing manner. Furthermore, the sensitizing dye H, 1-phenyl-5-mercaptotetrazole, 1-(5-methylureide phenyl)-5-mercaptotetrazole, compound I, and potassium bromide were added. Thus, the emulsion obtained as described above was defined as Emulsion (b)-R-H1.

Preparation of Emulsion (b)-R-L1

In the conventional method in which silver nitrate and sodium chloride were simultaneously added together in a gelatin aqueous solution being stirred, a high-silver chloride cubic emulsion having a spherical equivalent diameter of 0.28 μm and a variation coefficient of 10% was prepared. During the time period that the added amount of the silver nitrate being from 80% to 90%, $K_4[Ru(CN)_6]$ was added. During the time period that the added amount of the silver nitrate being from 80% to 100%, potassium bromide (3 mol % per mole of total silver halide in the emulsion to be obtained) was added. During the time period that the added amount of the silver nitrate being from 83% to 88%, a $K_2[IrCl_6]$ was added. When the addition of 90% of total silver silver nitrate was achieved, the potassium iodide (0.15 mol % per total silver halide in the emulsion to be obtained) was added. The resulting emulsion was subjected to a demineralization treatment, followed by being redispersed with the addition of gelatin. In this emulsion, sodium benzene thiosulfonate was added. In addition, sodium thiosulfate 5-hydrate was added as a sulfur sensitizer, and bis(1,4,5-trimethyl-1,2,4-triazolium-3-thiorate)olate (I) tetrafluoroborate was used as a gold sensitizer for maturation in an optimizing manner. Furthermore, the sensitizing dye H, 1-phenyl-5-mercaptotetrazole, 1-(5-methylureide phenyl)-5-mercaptotetrazole, compound I, and potassium bromide were added. Thus, the emulsion obtained as described above was defined as Emulsion (b)-R-L1.

Preparation of Emulsion (b)-R-H2

In the conventional method in which silver nitrate and sodium chloride were simultaneously added together in a gelatin aqueous solution being stirred, a high silver chloride cubic emulsion having a spherical equivalent diameter of 0.39 μm and a variation coefficient of 10% was prepared. During the time period that the added amount of the silver nitrate being from 50% to 80%, $Cs_2[OsCl_5(NO)]$ were added so that the content of Os might become $2\times10^{-8}$ moles per mol of total silver halide in the emulsion to be obtained. During the time period that the added amount of the silver nitrate being from 80% to 90%, $K_4[Ru(CN)_6]$ was added. During the time period that the added amount of the silver nitrate being from 80% to 100%, potassium bromide (3 mol % per mole of total silver halide in the emulsion to be obtained) was added. During the time period that the added amount of the silver nitrate being from 83% to 88%, a $K_2[IrCl_6]$ was added. When the addition of 90% of total silver silver nitrate was achieved, the potassium iodide (0.2 mol % per total silver halide in the emulsion to be obtained) was added. Furthermore, during the time period that the added amount of the silver nitrate being from 92% to 98%, a $K_2$[Ir(5-methylthiazole)$Cl_5$] was added such that a content of Ir might become $4\times10^{-7}$ moles per mole of total silver halide in the emulsion to be obtained. The resulting emulsion was subjected to a demineralization treatment, followed by being redispersed with the addition of gelatin. In this emulsion, sodium benzene thiosulfonate was added. In addition, sodium thiosulfate 5-hydrate was added as a sulfur sensitizer, and bis(1,4,5-trimethyl-1,2,4-triazolium-3-thiorate)olate, (I) tetrafluoroborate was used as a gold sensitizer for maturation in an optimizing manner. Furthermore, the sensitizing dye H, 1-phenyl-5-mercaptotetrazole, 1-(5-methylureide phenyl)-5-mercaptotetrazole, compound I, and potassium bromide were added. Thus, the emulsion obtained as described above was defined as Emulsion (b)-R-H2.

Preparation of Emulsion (b)-R-L2

In the conventional method in which silver nitrate and sodium chloride were simultaneously added together in a gelatin aqueous solution being stirred, a high-silver chloride cubic emulsion having a spherical equivalent diameter of 0.29 μm and a variation coefficient of 10% was prepared. During the time period that the added amount of the silver nitrate being from 50% to 80%, $Cs_2$ $[OsCl_5(NO)]$ were added so that the content of Os might become $6\times10^{-8}$ moles per mol of total silver halide in the emulsion to be obtained. During the time period that the added amount of the silver nitrate being from 80% to 90%, $K_4[Ru(CN)_6]$ was added. During the time period that the added amount of the silver nitrate being from 80% to 100%, potassium bromide (3 mol % per mole of total silver halide in the emulsion to be obtained) was added. During the time period that the added amount of the silver nitrate being from 83% to 88%, a $K_2[IrCl_6]$ aqueous solution was added. When the addition of 90% of total silver silver nitrate was achieved, the potassium iodide (0.2 mol % per total silver halide in the emulsion to be obtained) was added. Furthermore, during the time period that the added amount of the silver nitrate being from 92% to 98%, a $K_2$[Ir(5-methylthiazole)$Cl_5$] was added such that a content of Ir might become $1.2\times10^{-6}$ moles per mole of total silver halide in the emulsion to be obtained. The resulting emulsion was subjected to a demineralization treatment, followed by being redispersed with the addition of gelatin. In this emulsion, sodium benzene thiosulfonate was added. In addition, sodium thiosulfate 5-hydrate was added as a sulfur sensitizer, and bis(1,4,5-trimethyl-1,2,4-triazolium-3-thiorate)olate (I) tetrafluoroborate was used as a gold sensitizer for maturation in an optimizing manner. Furthermore, and the sensitizing dye H, 1-phenyl-5-mercaptotetrazole, 1-(5-methylureide phenyl)-5-mercaptotetrazole, compound I, and potassium bromide were added. Thus, the emulsion obtained as described above was defined as Emulsion (b)-R-L2.

The sample (b)-201 was prepared and in the same manner and constitution as those of the example (a)-3, except that 0.07 g of the emulsion (b)-B-H1 and 0.07 g of the emulsion (b)-B-L1 were used instead of using 0.14 g of the emulsion (a)-B-1, 0.06 g of the emulsion (b)-G-H1 and 0.06 g of the emulsion (b)-G-L1 were used instead of using 0.12 g of the emulsion (a)-G-1, and 0.05 g of the emulsion (b)-R-H1 and 0.05 g of the emulsion (b)-R-L1 were used instead of using 0.10 g of the emulsion (a)-R-1 in the respective emulsion layers.

The sample (b)-202 was prepared by replacing the emulsions (b)-B-H1, (b)-B-L1, (b)-G-H1, (b)-G-L1, (b)-R-H1, and (b)-R-L1 thereof with the (b)-B-H2, (b)-B-L2, (b)-G-H2, (b)-G-L2, (b)-R-H2, and (b)-R-L2, respectively.

These samples were subjected to laser scanning exposure using the optical sources A and B just as in the case of the example (b)-1. The values of $\Delta D_Y$ were read out and the results were listed in Table 9.

TABLE 9

| Sample | $\Delta D_Y$ (A, 10° C., 16") | $\Delta D_Y$ (B, 10° C., 16") | $\Delta D_Y$ (A, 30° C., 16") | $\Delta D_Y$ (B, 30° C., 16") | Remarks |
|---|---|---|---|---|---|
| (b)-201 | 0.08 | 0.23 | 0.07 | 0.18 | Comparative Example |
| (b)-202 | 0.07 | 0.07 | 0.06 | 0.09 | Invention |

The color difference between the head and tail of the print preferably becomes small as each $\Delta D_Y$ value becomes smaller.

As is evident from the results shown in Table 9, when the sample (b)-202 (the present invention) was exposed by the optical source B, stable qualities was obtained because of small color difference between the head and tail of the paper.

Example (c)-1

Preparation of Emulsion (c)-B-1

A liming-gelatin 3% aqueous solution (1,000 ml) was adjusted to pH 3.5, pCl 1.7, and the aqueous solution containing 2.12 moles of silver nitrate and the aqueous solution containing 2.2 moles of sodium chloride were simultaneously added and mixed in the above solution at 50° C. while being agitated vigorously. During the time period that the added amount of the silver nitrate being from 80% to 90%, potassium bromide was added so that potassium bromide might become 3% by moles per mole of total silver halide in the emulsion to be obtained. During the time period that the added amount of the silver nitrate being from 80% to 90%, a $K_4[Fe(CN)_6]$ aqueous solution was added so that Fe might become $2.5\times10^{-5}$ moles per mol of total silver halide in the emulsion to be obtained. During the time period that the added amount of the silver nitrate being from 82% to 88%, a $K_2[IrCl_6]$ aqueous solution was added such that the content of Ir might become $5.3\times10^{-8}$ moles per mole of total silver halide in the emulsion to be obtained. When the addition of 90% of total silver silver nitrate was achieved, the potassium iodide aqueous solution was added such that a content of I might become 0.25 mol % per mole of total silver halide in the emulsion to be obtained and a $K_2[Ir(H_2O)Cl_5]$ aqueous solution was added such that the content of Ir might become $8.0\times10^{-7}$ moles per mole of total silver halide in the emulsion to be obtained. After performing demineralization process at 40° C., the liming gelatin (150 g) was added to adjust to pH 5.5 and pCl 1.9. The resulting particles are a silver bromo-chloro-iodide cubic emulsion having a spherical equivalent diameter of 0.73 μm and a variation coefficient of 8.5%.

This emulsion was dissolved at 40° C. and sodium thiosulfonate was then added such that a content thereof might become $1.5\times10^{-5}$ moles per mole of silver halide. As a sulfur sensitizing agent, sodium thiosulfate 5-hydrate was used. As a gold sensitizer, bis(1,4,5-trimethyl-1,2,4-triazolium-3-thiolate)olate (I) tetrafluoroborate was used such that the mixture was matured at 60° C. so as to be optimized. After the mixture was cooled to 40° C., the sensitizing dye A ($1.9\times10^{-4}$ moles per mole of silver halide), the sensitizing dye B ($1.0\times10^{-4}$ moles per mole of silver halide), 1-phenyl-5-mercaptotetrazole ($2\times10^{-4}$ moles per mole of silver halide), 1-(5-methylureide phenyl)-5-mercaptotetrazole ($2.0\times10^{-4}$ moles per mole of silver halide), and potassium bromide ($1.8\times10^{-3}$ moles per mole of silver halide) were added, respectively. The resulting emulsion was then provided as Emulsion (c)-B-1.

Preparation of Emulsions (c)-B-2 to (c)-B-4

Emulsions (c)-B-2 to (c)-B-4 were prepared in the same manner as that of the emulsion (c)-B-1, except of variations in the addition rate of each of silver nitrate and sodium chloride concurrently added is changed, the amount of $K_4[Fe(CN)_6]$, $K_2[IrCl_6]$, and $K_2[Ir(H_2O)Cl_5]$, and the amounts of compounds to be added after the demineralization. The spherical equivalent diameters of the emulsions (c)-B-2, (c)-B-3, and (c)-B-4 were silver bromo-chloro-iodide cubic emulsions having spherical equivalent diameters of 0.68 μm, 0.33 μm, and 0.27 μm, respectively, and variation coefficients of 8.3%, 9.5%, and 10.3%, respectively.

Preparation of Emulsions (c)-G-1

For the emulsion (c)-B-1, the addition rate of silver nitrate, the addition rate of sodium chloride, and the temperature were changed, and the time of adding the $K_4[Fe(CN)_6]$ aqueous solution was changed so as to be added at the time of the addition amount of silver nitrate of 75% to 90%. In addition, the time of adding the $K_2[IrCl_6]$ aqueous solution was changed so as to be added at the time of the addition amount of silver nitrate of 77% to 88%. Furthermore, the addition amounts of the $K_4[Fe(CN)_6]$, $K_2[IrCl_6]$, and $K_2[Ir(H_2O)Cl_5]$ were also changed, respectively. Then, the compound was subjected to demineralization process at 40° C., followed by adding the liming gelatin (150 g) in the mixture and adjusting the mixture to pH 5.5 and pCl 1.9. The resulting particles are a silver bromo-chloro-iodide cubic emulsion having a spherical equivalent diameter of 0.44 μm and a variation coefficient of 9.3%. This emulsion was dissolved at 40° C. and sodium thiosulfonate was added such that a content thereof might become $1.5\times10^{-5}$ moles per mole of silver halide. In addition, as a sulfur sensitizer, sodium thiosulfate 5-hydride was used. As a gold sensitizer, bis(1,4,5-trimethyl-1,2,4-triazolium-3-thiorate) olate (I) tetrafluoroborate was used so as to be optimized at 60° C., such that it can be matured in an optimized manner. After the emulsion was cooled to 40° C., the sensitizing dye C was added such that a content thereof might become $7.2\times10^{-4}$ moles per mole of silver halide, 1-phenyl-5-mercapto tetrazole was added such that a content thereof might become $2.2\times10^{-4}$ moles per mole of silver halide, 1-(5-methylureide phenyl)-5-mercaptotetrazole was added such that a content thereof might become $9\times10^{-4}$ moles, and potassium bromide was added such that a content thereof might become $8\times10^{-3}$ moles per mole of silver halide, respectively. The resulting emulsion was provided as an emulsion (c)-G-1.

Preparation of Emulsions (c)-G-2 to (c)-G-4

The Emulsions (c)-G-2 to G-4 were prepared in the same manner as those of the preparation of the emulsion (c)-G-1, except that the addition rate of silver nitrate, the addition rate of sodium chloride, the addition amounts of the $K_4[Fe(CN)_6]$, $K_2[IrCl_6]$, and $K_2[Ir(H_2O)Cl_5]$ as well as the amounts of various compounds to be added after demineralization were changed, respectively. The resulted emulsions (c)-G-2, (c)-G-3, and (c)-G-4 were a silver bromo-chloro-iodide cubic emulsions having their respective spherical equivalent diameters of 0.39 μm, 0.22 μm, and 0.19 μm, and variation coefficients of 9.0%, 12.5%, and 11.0%, respectively.

Preparation of Emulsions (c)-R-1 to (c)-R-4

The emulsions (c)-R-1 to (c)-R-4 were obtained in the same manner as that of the emulsions (c)-G-1 to (c)-G-4, except that instead of the sensitizing dye C, the sensitizing dye H and the compound I were used, and the amounts of the sensitizing dye and the compound I were changed, respectively. The obtained emulsions (c)-R-1, (c)-R-2, (c)-R-3, and (c)-R-4 were silver bromo-chloro-iodide cubic emulsions having their respective spherical equivalent diameters of 0.43 μm, 0.38 μm, 0.23 μm, and 0.18 μm, and variation coefficients of 9.7%, 9.1%, 11.8%, and 12.5%, respectively.

Samples

In the respective emulsion layers, the sample (c)-101 was prepared in the same manners and the same constitutions as those of the example (a)-1, except that the types and/or the amounts of the emulsions and/or gelatins were changed as described below. Samples (c)-102 to (c)-106 in which the emulsions of yellow, magenta, and cyan image-forming layers were changed from the example (a)-1 as in the case with Table 10 were also prepared.

| | |
|---|---|
| First layer (Yellow-image forming blue sensitive emulsion layer) | |
| Emulsion (c)-B-1 | 0.24 |
| Gelatin | 1.08 |
| Second layer (color mixing-contamination prevention layer) | |
| Gelatin | 0.55 |
| Color-mixture preventing agent (Cpd-4) | 0.05 |
| Third layer (Magenta-image forming green sensitive emulsion layer) | |
| Emulsion (c)-G-1 | 0.15 |
| Gelatin | 1.42 |
| Fourth layer (Color mixing-contamination prevention layer) | |
| Gelatin | 0.40 |
| Fifth layer (Cyan Image-forming red sensitive emulsion layer) | |
| Emulsion (c)-R-1 | 0.13 |
| Gelatin | 1.20 |

TABLE 10

| | Emulsion used | | |
|---|---|---|---|
| Sample | Yellow image forming layer | Magenta image forming layer | Cyan image forming layer |
| (c)-101 | (c)-B-1 | (c)-G-1 | (c)-R-1 |
| (c)-102 | (c)-B-1 | (c)-G-2 | (c)-R-2 |
| (c)-103 | (c)-B-2 | (c)-G-1 | (c)-R-1 |
| (c)-104 | (c)-B-2 | (c)-G-2 | (c)-R-2 |
| (c)-105 | (c)-B-3 | (c)-G-3 | (c)-R-3 |
| (c)-106 | (c)-B-4 | (c)-G-4 | (c)-R-4 |

For investigating the rapid processivities of these samples in the digital exposures and the processing systems, following experiments were conducted.

The optical source for the exposure was a blue semiconductor laser of 440 nm in wavelength (announced by Nichia Corporation on the 48th Spring Meeting of the Japan Society of Applied Physics and Related Societies held on March, 2001), a green laser of about 530 nm in wavelength pulled out by performing a wavelength conversion of a semiconductor laser (an oscillation wavelength of about 1060 nm) using a SHG crystal of $LiNbO_3$ having a waveguide-like reverse domain structure, and a red semiconductor laser of 650 nm in wavelength (trade name: Type No. HL6501 GM, manufactured by Hitachi Corporation.). Each laser light of three colors moves perpendicularly to a scanning direction by a polygon mirror, and could be made to carry out sequential-scanning exposure on the sample. The quantity-of-light fluctuation by the temperature of a semiconductor laser is suppressed by temperature being kept constant using a Peltier component. An effectual beam diameter is 80 μm, a scanning pitch is 42.3 μm (600 dpi), and the average exposure time per pixel was $1.7\times10^{-7}$ seconds. Using this exposure system, the following developing processes A and B were performed by automatically transferring the samples after gray-colored gradation exposure was applyed on the samples of 12 cm in length×8.9 cm in width in which the color densities of yellow, magenta, and cyan were almost equal.

Process A

Regarding the above samples (c)-101 to (C)-106, the continuous processing (running test) was performed in the following processing steps until two folds of volume of the color developing tank was replenished.

| Process steps | Temp. (° C.) | Time (sec) | Refill amount (ml)* |
|---|---|---|---|
| Color development | 38.5 | 45 | 45 |
| Breacing fixation | 38.0 | 45 | 35 |
| Rinse 1 | 38.0 | 20 | — |
| Rinse 2 | 38.0 | 20 | — |
| Rinse 3** | 38.0 | 20 | — |
| Rinse 4** | 38.0 | 30 | 121 |

(Note)

*Refill amount per photosensitive material ($m^2$).

**A rinse screening system (trade name: RC50D, manufactured by Fuji Photo Film Co., Ltd.) was installed in the step of rinse (3). Rinse liquid was fed out of the rinse (3), and is then fed to a reverse osmosis module (RC50D) with a pump while permeated water fed from the same tank is supplied to the rinse (4). In addition, enrichment liquid was returned to the rinse (3). The permeate flow to the reverse osmosis module adjusted the circulate pumping pressure so as to be kept at 50 to 300 ml/minute, and the temperature control circulation was performed for 10 hours per day. The rinse was designed as a 4 - tank countercurrent method from the rinse (1) to (4).

The composition of each processing liquid is as follows.

| | [Tank liquid] | [Replenisher] |
|---|---|---|
| [Color development liquid] | | |
| Water | 800 ml | 800 ml |
| Dimethyl polysiloxance surfactant (trade name: Silicon KF351A, available from Shin-Etsu Chemical Co., Ltd.) | 0.1 g | 0.1 g |
| Tri(isopropanol)amine | 8.8 g | 8.8 g |
| Ethylenediamine 4 acetic-acid | 4.0 g | 4.0 g |
| Polyethylene glycol (molecular weight 300) | 10.0 g | 10.0 g |
| 4,5-dihydroxy benzene-1,3-sodium disulfonate | 0.50 g | 0.50 g |
| Pottasium chloride | 10.0 g | — |
| Pottasium bromide | 0.040 g | 0.010 g |
| Triazinylaminostilbene fluorescent whitening agent (Hakkol FWA-SA, manufactured by Showa Chemical Co.) | 2.5 g | 5.0 g |
| Sodium sulfite | 0.1 g | 0.1 g |
| Di-sodium-N,N-bis (sulfonate ethyl) hydroxylamine | 8.5 g | 11.1 g |
| N-ethyl-N-(β-methane sulfonamide ethyl)-3-methyl-4-amino 4-aminoaniline.3/2 sulfate.monochrome hydrate | 5.0 g | 15.7 g |
| Potassium carbonate | 26.3 g | 26.3 g |
| Add water to fill up to | 1000 mL | 1000 mL |
| pH (adjusted with potassium hydroxide and sulfuric acid, 25° C.) | 10.15 | 12.50 |
| [bleach fixing bath] | | |
| Water | 700 ml | 600 ml |
| Fe(III)-ethylendiaminetetraacetic acid, ammonium | 47.0 g | 94.0 g |
| Ethylendiaminetetraacetic acid | 1.4 g | 2.8 g |
| m-carboxybenzene sulfinate | 8.3 g | 16.5 g |
| Nitric acid (67%) | 16.5 g | 33.0 g |
| Imidazol | 14.6 g | 29.2 g |
| Ammonium thiosulfate (750 g/l) | 107.0 ml | 214.0 ml |
| Ammonium sulfite | 16.0 g | 32.0 g |
| Ammonium bisulfate | 23.1 g | 46.2 g |
| Add water to fill up to | 1000 ml | 1000 ml |
| pH (adjusted with acetic acid and ammonium, 25° C.) | 6.00 | 6.00 |
| [Rinse] | | |
| Chlorinated isocyanuric acid | 0.02 g | 0.02 g |
| Deionized water (Conductivity 5 μS/cm or less) | 1000 ml | 1000 ml |
| pH (25° C.) | 6.5 | 6.5 |

Hereinafter, the process B will be described.

Process B

Regarding the above samples (c)-101 to (C)-106, the continuous processing (running test) was performed until the volume of the color developing tank was replenished with 0.5 folds of volume in the following processing steps.

| Process steps | Tempe. (° C.) | Time (sec.) | Refill amount (ml)* |
|---|---|---|---|
| Color development | 42.0 | 27 | 45 |

(Note)

*Replenishment quantity per square meter of the photosensitive material

**A rinse in screening system (trade name: RC50D, manufactured by Fuji Photo Film Co., Ltd.) was installed in the step of rinse (3). Rinse liquid is fed out of the rinse (3), and is then fed to a reverse osmosis module (RC50D) with a pump while permeated water fed from the same tank is supplied to the rinse (4). In addition, enrichment liquid was returned to the rinse (3). The permeate flow rate to the reverse osmosis module adjusted the circulate pumping pressure so as to be kept at 50 to 300 ml/ minute, and the temperature control circulation was performed for 10 hours per day. The rinse was designed as a tank countercurrent method from the rinse (1) to (4).

Here, the bleaching fixation step and following steps thereof were similar to those of the process A including the composition of the processing liquid, temperature, time, and refill amount.

The composition of each processing liquid is as follows.

| [Color development liquid] | [Tank liquid] | [Replenisher] |
|---|---|---|
| Water | 800 ml | 600 ml |
| Fluorescent whitening agent (FL-1) | 4.0 g | 6.8 g |
| Triisopropanol amine | 8.8 g | 8.8 g |
| Sodium p-toluenesulfonate | 20.0 g | 20.0 g |
| Ethylenediamine tetraacetate | 4.0 g | 4.0 g |
| Sodium sulfite | 0.10 g | 0.50 g |
| Potassium chloride | 8.0 g | |
| Sodium 4,5-dihydroxybenzene-1,3-disulfonate | 0.50 g | 0.50 g |
| Di-sodium-N,N-bis(sulfonate ethyl) hydroxylamine | 8.5 g | 14.5 g |
| 4-amino-3-methyl-N-ethyl-N-(β-methane sulfonamide ethyl) aniline.3/2 sulfate.monohydrate | 7.5 g | 16.5 g |
| Potassium carbonate | 26.3 g | 26.3 g |
| Add water to fill up to | 1000 mL | 1000 mL |
| pH (adjusted with sulfuric acid and KOH, 25° C.) | 10.35 | 12.6 |

Evaluation

For evaluating photographic properties of these samples, the following experiments were conduced. Here, each time period from transferring each exposed sample to the processing solution was set to 60 seconds, 9 seconds, and 3 seconds by changing the velocity of transferring the sample after the exposure.

Color Density

The densities of each colors of yellow, magenta, and cyan of each sample after the processing were measured and represented by characteristic curves. The amount of exposure (E1) that provides a color density of 0.7 was estimated for each sample. In addition, the color density (D2) for the amount of exposure (E2), which is 10 times higher than E1, was obtained for each sample. In each of the process A and the process B, 0.3 ml of the breach fixing agent was added per 1000 ml of the color developing liquid, followed by performing similar exposure and development. Then, the color density (D1) corresponding to the previously-obtained exposure amount (E1) was obtained. The density difference ((D1)—0.7) was obtained at the time of the breaching fixing solution was included in the color developing solution. The processing stability increases as such the value of the density difference is smaller.

Streaked Unevenness

Using the digital information recorded by a digital camera, a color print was obtained by condicting the development with the above digital exposing device, the process A, and the process B. The time period from the end of the exposure to the entry to the processing liquid were defined to 3 seconds, 9 seconds, and 60 seconds as described above. For each condition, 10 color prints were produced. Then, visual observations were conducted on these prints to find streaked unevenness to evaluate the image quality as follows.

A: Extremely excellent because of substantially no streak;

B: 1 to 3 prints in 10 prints have a little streaked unevenness which can be visually observed:

C: 1 to 3 prints in 10 prints have a significant streaked unevenness which can be clearly observed, so that the print quality of such a print is not favorable.

D: Distinct streaked unevenness can be found in almost all of the prints, so that the print quality of such a print is not allowable.

The above results are listed in Table 11 and Table 12, respectively.

TABLE 11

| Sample | Process | Time period from exposure to development | (D-1) − 0.7 Y | (D-1) − 0.7 M | (D-1) − 0.7 C | D2 Y | D2 M | D2 C | Evaluation of unevenness | Remarks |
|---|---|---|---|---|---|---|---|---|---|---|
| (c)-101 | A | 60" | 0.04 | −0.05 | 0.03 | 2.33 | 2.30 | 2.28 | A | Comparative Example |
| | | 9" | 0.04 | 0.06 | 0.01 | 2.30 | 2.30 | 2.30 | C | Comparative Example |
| | | 3" | 0.04 | 0.02 | 0.04 | 2.21 | 2.27 | 2.25 | C | Comparative Example |
| | B | 60" | 0.03 | 0.01 | 0.04 | 2.00 | 2.15 | 2.31 | B | Comparative Example |
| | | 9" | 0.04 | −0.02 | 0.03 | 2.05 | 2.08 | 2.27 | D | Comparative Example |
| | | 3" | 0.02 | 0.05 | 0.04 | 1.93 | 2.05 | 2.30 | D | Comparative Example |
| (c)-102 | A | 60" | 0.08 | 0.28 | 0.12 | 2.31 | 2.33 | 2.25 | A | Comparative Example |
| | | 9" | 0.09 | 0.35 | 0.14 | 2.29 | 2.30 | 2.30 | A | Comparative Example |
| | | 3" | 0.08 | 0.40 | 0.11 | 2.31 | 2.31 | 2.27 | B | Comparative Example |
| | B | 60" | 0.02 | 0.07 | 0.07 | 1.75 | 2.28 | 2.31 | B | Comparative Example |
| | | 9" | 0.04 | 0.02 | 0.07 | 1.95 | 2.30 | 2.28 | D | Comparative Example |
| | | 3" | 0.02 | 0.08 | 0.06 | 1.89 | 2.30 | 2.31 | D | Comparative Example |
| (c)-103 | A | 60" | 0.15 | −0.02 | 0.07 | 2.30 | 2.25 | 2.26 | A | Comparative Example |
| | | 9" | 0.11 | 0 | 0.05 | 2.28 | 2.29 | 2.25 | A | Comparative Example |
| | | 3" | 0.25 | −0.02 | 0.05 | 2.31 | 2.30 | 2.27 | B | Comparative Example |
| | B | 60" | 0.15 | 0.10 | 0.04 | 2.10 | 2.11 | 2.29 | A | Comparative Example |
| | | 9" | 0.05 | 0.04 | 0.04 | 2.25 | 2.17 | 2.33 | B | Invention |
| | | 3" | 0.06 | 0.04 | 0.03 | 2.25 | 2.10 | 2.30 | B | Invention |

TABLE 12

| Sample | Process | Time period from exposure to development | (D-1) – 0.7 Y | M | C | D2 Y | M | C | Evaluation of unevenness | Remarks |
|---|---|---|---|---|---|---|---|---|---|---|
| (c)-104 | A | 60" | 0.21 | 0.27 | 0.14 | 2.31 | 2.30 | 2.28 | A | Comparative Example |
| | | 9" | 0.18 | 0.30 | 0.16 | 2.30 | 2.34 | 2.30 | A | Comparative Example |
| | | 93" | 0.20 | 0.25 | 0.14 | 2.30 | 2.28 | 2.29 | A | Comparative Example |
| | B | 60" | 0.14 | 0.11 | 0.12 | 2.15 | 2.32 | 2.31 | A | Comparative Example |
| | | 99" | 0.04 | 0.04 | 0.03 | 2.28 | 2.28 | 2.29 | A | Invention |
| | | 93" | 0.04 | 0.02 | 0.03 | 2.31 | 2.30 | 2.30 | B | Invention |
| (c)-105 | A | 60" | 0.37 | 0.41 | 0.22 | 2.30 | 2.33 | 2.28 | A | Comparative Example |
| | | 99" | 0.30 | 0.33 | 0.30 | 2.28 | 2.28 | 2.31 | A | Comparative Example |
| | | 93" | 0.31 | 0.40 | 0.28 | 2.28 | 2.30 | 2.29 | A | Comparative Example |
| | B | 60" | 0.08 | 0.10 | 0.11 | 2.30 | 2.28 | 2.29 | A | Comparative Example |
| | | 99" | 0.03 | 0.06 | 0.04 | 2.31 | 2.31 | 2.30 | A | Invention |
| | | 93" | 0.03 | 0.06 | 0.03 | 2.27 | 2.30 | 2.30 | A | Invention |
| (c)-106 | A | 60" | 0.41 | 0.48 | 0.34 | 2.30 | 2.29 | 2.30 | A | Comparative Example |
| | | 99" | 0.43 | 0.44 | 0.30 | 2.27 | 2.30 | 2.28 | A | Comparative Example |
| | | 93" | 0.38 | 0.51 | 0.28 | 2.27 | 2.31 | 2.30 | A | Comparative Example |
| | B | 60" | 0.18 | 0.29 | 0.18 | 2.30 | 2.30 | 2.31 | A | Comparative Example |
| | | 99" | 0.17 | 0.30 | 0.19 | 2.27 | 2.31 | 2.29 | A | Comparative Example |
| | | 93" | 0.15 | 0.28 | 0.16 | 2.20 | 2.29 | 2.30 | A | Comparative Example |

As is evident from Tables 11 and 12, from the test results using the sample (c)-101, shortening the time period from the exposure to the development facilitates the generation of streaked unevenness. From the test results using the other samples, in order to preventing the generation of streaked unevenness, while keeping stability in processing and color density in a high concentration portion, it was found that the particle sizes of silver halide, the time period from the exposure to the color development, and the color developing time sould be within the scope of the invention in order to achieve the object of the present invention. It was unexpectedly found that the process of the present invention, wherein times for coloring and developing were shorter than conventional process, was in fact superior in the processing stabilities.

Example (c)-2

The sample (c)-201 was prepared in the same manner as that of the sample (c)-101, except that the emulsion (c)-B-1 in the first layer was replaced with a mixture of (c)-B-2 and (c)-B-3 (mixture ratio; (c)-B-2:(c)-B-3=4:6 with respect to the respective amount of the silver halide), the emulsion (c)-G-1 in the third layer was replaced with a mixture of the a mixture of the samples (c)-G-2 and (c)-G-3 (mixture ratio; (c) G-2: (c) G-3=3:7 with respect to the respective amount of the silver halide), and the emulsion (c)-R-1 in the fifth layer was replaced with a mixture of (c)-R-2 and (c)-R-3 (mixture ratio; (c)-R-2:(c)-R-3=7:3 with respect to the respective amount of the silver halide). Samples (c)-202 and (c)-203 were prepared by changing the amount of gelatin and the amount of coating silver in the sample (c)-201 as shown in Table 13. In addition, the sample (c)-204 was prepared by changing the amount of gelatin and the amount of coating silver in the sample (c)-101 as shown in Table 13.

TABLE 13

| Sample | Gelatin-coating amount 1st Layer | 2st Layer | 3rd Layer | 4rh Layer | 5th Layer | 6th Layer | 7th Layer | Total | Silver-coating amount 1st Layer | 3rd Layer | 5th Layer | Total |
|---|---|---|---|---|---|---|---|---|---|---|---|---|
| (c)-201 | 1.08 | 0.55 | 1.42 | 0.40 | 1.20 | 0.46 | 1.00 | 6.11 | 0.24 | 0.15 | 0.13 | 0.52 |
| (c)-202 | 0.95 | 0.50 | 1.36 | 0.36 | 1.11 | 0.46 | 1.00 | 5.74 | 0.24 | 0.15 | 0.13 | 0.52 |
| (c)-203 | 0.95 | 0.50 | 1.36 | 0.36 | 1.11 | 0.46 | 1.00 | 5.74 | 0.19 | 0.12 | 0.10 | 0.41 |

TABLE 13-continued

| | Gelatin-coating amount | | | | | | | | Silver-coating amount | | | |
|---|---|---|---|---|---|---|---|---|---|---|---|---|
| Sample | 1st Layer | 2st Layer | 3rd Layer | 4rh Layer | 5th Layer | 6th Layer | 7th Layer | Total | 1st Layer | 3rd Layer | 5th Layer | Total |
| (c)-101 | 1.08 | 0.55 | 1.42 | 0.40 | 1.20 | 0.46 | 1.00 | 6.11 | 0.24 | 0.15 | 0.13 | 0.52 |
| (c)-204 | 0.95 | 0.50 | 1.36 | 0.36 | 1.11 | 0.46 | 1.00 | 5.74 | 0.19 | 0.12 | 0.10 | 0.41 |

*The samples 201 to 203 used the same silver halide emulsion. The samples 101 and 204 used the same silver halide emulsion.

With respect to the samples listed in Table 13, the same experimental conditions (i.e., the exposure, the time period from the exposure to the color development, and the evaluation method) for the example (c)-1 were applied, except for modifying the process into the following process (c).

Here, the processing steps will be described below.

Process C

For the samples (c)-201 to (c)-204 and (c)-101, a continuous processing (running test) was performed in the following processing steps until the volume of the color developing tank was replenished with 0.5 folds of the volume.

| Process steps | Tempe. (° C.) | Time (sec) | Refill amount (ml)* |
|---|---|---|---|
| Color development | 45.0 | 16 | 45 |
| Breachin fixation | 40.0 | 16 | 35 |
| Rinse 1 | 40.0 | 8 | — |
| Rinse 2 | 40.0 | 8 | — |
| Rinse 3** | 40.0 | 8 | — |
| Rinse 4** | 38.0 | 8 | 121 |
| Drying | 80.8 | 16 | |

(Note)

*Refill amount per one square meter photosensitive material.

**A rinse screening system (trade name: RC50D, manufactured by Fuji Photo Film Co., Ltd.) was installed in the step of rinse (3). Rinse liquid is fed out of the rinse (3), and is then fed to a reverse osmosis module (RC50D) with a pump while permeated water fed from the same tank is supplied tothe rinse (4). In addition, enrichment liquid was returned to the rinse (3). The permeate flow to the reverse osmosis module adjusted the circulate pumping pressure so as to be kept at 50 to 300 ml/minute, and the temperature control circulation was performed for 10 hours per day. The rinse wasdesigned as a 4 - tank countercurrent method from the rinse (1) to (4).

The composition of each processing liquid is as follows.

| | [Tank liquid] | [Replenisher] |
|---|---|---|
| [Color development liquid] | | |
| Water | 800 ml | 600 ml |
| Fluorescent whitening agent (FL-1) | 5.0 g | 8.5 g |
| Triisopropanol amine | 8.8 g | 8.8 g |
| Sodium p-toluenesulfonate | 20.0 g | 20.0 g |
| Ethylenediamine tetraacetate | 4.0 g | 4.0 g |
| Sodium sulfite | 0.10 g | 0.50 g |
| Potassium chloride | 10.0 g | — |
| Sodium 4,5-dihydroxy benzene-1,3-disulfonate | 0.50 g | 0.50 g |
| Di-sodium-N,N-bis (sulfonate ethyl) hydroxylamine | 8.5 g | 14.5 g |
| 4-amino-3-methyl-N-ethyl-N-(β-methane sulfonamide ethyl) aniline.3/2 sulfate.monohydrate | 10.0 g | 22.0 g |
| Potassium carbonate | 26.3 g | 26.3 g |
| Add water to fill up to | 1000 mL | 1000 mL |
| pH (adjusted with sulfuric acid and KOH, 25° C.) | 10.35 | 12.6 |
| [Bleach fix bath] | | |
| Water | 800 mL | 800 mL |
| Ammonium thiosulfate (750 g/L) | 107 mL | 214 mL |
| Succinic acid | 29.5 g | 59.0 g |
| Iron (III) ammonium ethylenediamine tetraacetate | 47.0 g | 94.0 g |
| Ethylenediamine tetraacetate | 1.4 g | 2.8 g |
| Nitric acid (67%) | 17.5 g | 35.0 g |
| Imidazole | 14.6 g | 32.0 g |
| Ammonium sulfite | 16.0 g | 32.0 g |
| Potassium metabisulfite | 23.1 g | 46.2 g |
| Add water to fill up to | 1000 mL | 1000 mL |
| pH (adjusted with nitric acid and ammonia water, 25° C.) | 6.00 | 6.00 |
| [Rinse liquid] | | |
| Chlorinated sodium isocyanurate | 0.02 g | 0.02 g |
| Deionized water (5 μS/cm or less in electric conductivity) | 1000 ml | 1000 ml |
| pH (25° C.) | 6.5 | 6.5 |

The above results were listed in Table 14.

TABLE 14

| Sample | Process | Time period from exposure to development | (D-1) – 0.7 Y | M | C | D2 Y | M | C | Evaluation of unevenness | Remarks |
|---|---|---|---|---|---|---|---|---|---|---|
| (c)-201 | C | 60" | 0.06 | 0.11 | 0.04 | 2.08 | 2.20 | 2.35 | A | Comparative Example |
| | | 9" | 0.04 | 0.06 | 0.05 | 2.21 | 2.31 | 2.37 | A | Invention |
| | | 3" | 0.04 | 0.04 | 0.04 | 2.30 | 2.29 | 2.33 | A | Invention |
| (c)-202 | C | 60" | 0.03 | 0.10 | 0.05 | 2.25 | 2.28 | 2.32 | A | Comparative Example |
| | | 9" | 0.05 | 0.05 | 0.04 | 2.30 | 2.33 | 2.30 | B | Invention |
| | | 3" | 0.04 | 0.05 | 0.05 | 2.31 | 2.30 | 2.30 | B | Invention |

TABLE 14-continued

| Sample | Process | Time period from exposure to development | (D-1) – 0.7 Y | M | C | D2 Y | M | C | Evaluation of unevenness | Remarks |
|---|---|---|---|---|---|---|---|---|---|---|
| (c)-203 | C | 60" | 0.03 | 0.08 | 0.04 | 2.09 | 2.21 | 2.33 | A | Comparative Example |
| | | 9" | 0 | 0.02 | 0.03 | 2.29 | 2.31 | 2.29 | A | Invention |
| | | 3" | 0.01 | −0.01 | 0.03 | 2.31 | 2.30 | 2.30 | A | Invention |
| (c)-204 | C | 60" | 0.01 | −0.02 | 0.01 | 1.17 | 1.87 | 2.05 | C | Comparative Example |
| | | 9" | 0 | 0.07 | 0.02 | 1.25 | 1.80 | 2.11 | D | Comparative Example |
| | | 3" | 0.01 | 0.11 | 0.02 | 1.21 | 1.80 | 2.02 | D | Comparative Example |
| (c)-101 | C | 60" | 0.02 | −0.06 | 0.01 | 1.75 | 1.95 | 2.18 | C | Comparative Example |
| | | 9" | 0.01 | 0.08 | 0.03 | 1.70 | 1.89 | 2.20 | D | Comparative Example |
| | | 3" | 0.01 | 0.10 | 0.04 | 1.66 | 1.93 | 2.09 | D | Comparative Example |

As is evident from the results listed in Table 14, the samples (c)-201 to (c)-203 that contain silver halide emulsion having particle sizes of the present invention showed excellent performances even when the time period from the exposure to the color development was short as in the process C having a short color-developing time period.

Furthermore, comparing with the samples (c)-201 to (c)-203, it was found that excellent performances in cost effectiveness could be obtained even though a smaller amount of the gelatin and silver were coated on the samples.

Furthermore, the samples (c)-101 and (c)-204, in which the particle sizes of the silver halide emulsions were out of the scope of the invention, the effects of the invention described above could not be attained. Therefore, the favorable performance can be specifically obtained when the particle size of the silver halide emulsion is within the scope of the invention.

According to the present invention, it becomes possible to provide an image forming method capable of obtaining an stable photographic performance even when a color developing process with a shorter latent image time period after exposure was used, and a silver halide color photosensitive material to be applied for such a method, and specifically a silver halide color photosensitive material suitable for color printing.

What is claimed is:

1. A silver halide color photosensitive material for being subjected to color development within nine seconds of being exposed, the material comprising:

a support; and a photograph constitution layer provided on the support, and including at least one layer that comprises a yellow dye-forming coupler, at least one layer that comprises a magenta dye-forming coupler, at least one layer that comprises a cyan dye-forming coupler, and at least one non-photosensitive hydrophilic colloid layer, wherein the coupler-comprising layers respectively include silver halide emulsions, and at least one of the silver halide emulsions has the following characteristics:

(i) a silver chloride content of 90 mol % or more, wherein a silver iodide content of 0.02 to 1 mol % and a silver iodide-containing phase is formed in each of 85 to 100% of locations of the volume of a silver halide particle in the silver halide emulsion; and (ii) contains at least one metal complex represented by general formulae (IB) or (II):

$$[IrX^{IB}_{n}L^{IB}_{(6-n)}]^{m} \quad \text{(IB)}$$

wherein $X^{IB}$ represents a halogen ion or a pseudo-halogen ion; $L^{IB}$ represents a heterocyclic compound; n represents 3, 4, or 5; and m represents 5−, 4−, 3−, 2−, 1−, 0, or 1+;

$$[MX^{II}_{n}L^{II}_{(6-n)}]^{m} \quad \text{(II)}$$

wherein M represents Cr, Mo, Re, Fe, Ru, Os, Co, Rh, Pd, or Pt; $X^{II}$ represents a halogen ion; $L^{II}$ represents an arbitrary ligand which is different from $X^{II}$; n represents 3, 4, 5, or 6; and m represents 4−, 3−, 2−, 1−, 0, or 1+, wherein at least one of the silver halide emulsions in the at least one silver halide emulsion layer that contains the yellow dye-forming coupler comprises a metal complex represented by general formula (IB) and a metal complex represented by general formula (II), wherein at least one of the silver halide emulsions contained in the at least one layer containing the yellow dye-forming coupler has the features (i) and (ii);

wherein the total amount of silver in the photograph constitution layer in the photosensitive material is in the range from 0.2 g/m$^2$ to 0.45 g/m$^2$.

2. A silver halide color photosensitive material according to claim 1, wherein an average spherical equivalent diameter of the silver halide particles in the silver halide emulsion layer that contains the yellow dye-forming coupler is from 0.30 μm to 0.70 μm.

3. A silver halide color photosensitive material according to claim 1, wherein the silver halide color photosensitive material is applicable to scanning exposure conducted by using exposure sources including at least one blue laser having a wavelength from 420 nm to 460 nm.

4. A silver halide color photosensitive material according to claim 1, wherein the silver halide color photosensitive material is applicable to rapid processing wherein a color development is completed within 28 seconds.

5. A silver halide color photosensitive material according to claim 1, wherein the metal complex represented by general formula (II) is comprised in the silver iodide-containing phase.

6. A silver halide color photosensitive material according to claim 1, wherein the silver halide emulsion further comprises an iridium complex in which all of six ligands consist of Cl, Br, or I.

7. A silver halide color photosensitive material for being subjected to color development within nine seconds of being exposed, the material comprising:

a support; and a photograph constitution layer provided on the support, and including at least one layer that comprises a yellow dye-forming coupler, at least one layer that comprises a magenta dye-forming coupler, at least one layer that comprises a cyan dye-forming coupler, and at least one non-photosensitive hydrophilic colloid layer, wherein the coupler-comprising layers respectively include silver halide emulsions, and at least one of the silver halide emulsions has the following characteristics:

(i) a silver chloride content of 90 mol % or more, a silver iodide content of 0.02 to 1 mol %, a silver bromide content of 0.1 to 7 mol %, a silver bromide-containing phase is formed in each of 50 to 100% of locations of the volume of a silver halide particle in the silver halide emulsion, and the silver bromide-containing phase is formed further inside of the silver halide particle compared to a silver iodide-containing phase; and (ii) at least one metal complex represented by general formulae (IB) or (II) is contained therein:

$$[IrX^{IB}_{n}L^{IB}_{(6-n)}]^{m} \quad \text{(IB)}$$

wherein $X^{IB}$ represents a halogen ion or a pseudo-halogen ion; $L^{IB}$ represents a heterocyclic compound; n represents 3, 4, or 5; and m represents 5−, 4−, 3−, 2−, 1−, 0, or 1+:

$$[MX^{II}_{n}L^{II}_{(6-n)}]^{m} \quad \text{(II)}$$

wherein M represents Cr, Mo, Re, Fe, Ru, Os, Co, Rh, Pd, or Pt; $X^{II}$ represents a halogen ion; $L^{II}$ represents an arbitrary ligand which is different from $X^{II}$; n represents 3, 4, 5, or 6; and m represents 4−, 3−,2−, 1−, 0, or 1+, wherein at least one of the silver halide emulsions in the at least one silver halide emulsion layer that contains the yellow dye-forming coupler comprises a metal complex represented by general formula (IB) and a metal complex represented by general formula (II), wherein at least one of the silver halide emulsions contained in the at least one layer containing the yellow dye-forming coupler has the features (i) and (ii);

wherein the total amount of silver in the photograph constitution layer in the photosensitive material is in the range from 0.2 g/m$^2$ to 0.45 g/m$^2$.

8. A silver halide color photosensitive material for being subjected to color development within nine seconds of being exposed according to claim 7, wherein the metal complex represented by general formula (II) is comprised in the silver iodide-containing phase.

9. A silver halide color photosensitive material for being subjected to color development within nine seconds of being exposed according to claim 7, wherein the silver halide emulsion further comprises an iridium complex in which all of six ligands consist of Cl, Br, or I.

10. An image forming method comprising the steps of:

exposing a silver halide color photosensitive material; and beginning to subject the exposed silver halide color photosensitive material to a color development within nine seconds of the exposure, wherein the silver halide color photosensitive material comprises:

a support; and a photograph constitution layer provided on the support, and including at least one layer that comprises a yellow dye-forming coupler, at least one layer that comprises a magenta dye-forming coupler, at least one layer that comprises a cyan dye-forming coupler, and at least one non-photosensitive hydrophilic colloid layer, wherein the coupler-comprising layers respectively include silver halide emulsions, and at least one of the silver halide emulsions has the following characteristics:

(i) a silver chloride content of 90 mol % or more, wherein a silver iodide content of 0.02 to 1 mol % and a silver iodide-containing phase is formed in each of 85 to 100 % of locations of the volume of a silver halide particle in the silver halide emulsion; and (ii) contains at least one metal complex represented by general formulae (IB) or (II):

$$[IrX^{IB}_{n}L^{IB}_{(6-n)}]^{m} \quad \text{(IB)}$$

wherein $X^{IB}$ represents a halogen ion or a pseudo-halogen ion; $L^{IB}$ represents a heterocyclic compound; n represents 3, 4, or 5; and m represents 5−, 4−, 3−, 2−, 1−, 0, or 1+;

$$[MX^{II}_{n}L^{II}_{(6-n)}]^{m} \quad \text{(II)}$$

wherein M represents Cr, Mo, Re, Fe, Ru, Os, Co, Rh, Pd, or Pt; $X^{II}$ represents a halogen ion; $L^{II}$ represents an arbitrary ligand which is different from $X^{II}$; n represents 3, 4, 5, or 6; and m represents 4−, 3−, 2−, 1−, 0, or 1+, wherein at least one of the silver halide emulsions in the at least one silver halide emulsion layer that contains the yellow dye-forming coupler comprises a metal complex represented by general formula (IB) and a metal complex represented by general formula (II), wherein at least one of the silver halide emulsions contained in the at least one layer containing the yellow dye-forming coupler has the features (i) and (ii);

wherein the total amount of silver in the photograph constitution layer in the photosensitive material is in the range from 0.2 g/m$^2$ to 0.45 g/m$^2$.

11. An image forming method according to claim 10, wherein the color development is completed within 28 seconds.

12. An image forming method according to claim 10, wherein the exposing step is a scanning exposure step conducted by using exposure sources including at least one blue laser having a wavelength from 420 nm to 460 nm.

13. An image forming method according to claim 12, wherein the color development is completed within 28 seconds.

14. An image forming method according to claim 10, wherein the color development is completed within 28 seconds, and an average spherical equivalent diameter of the silver halide particles in the silver halide emulsion layer that contains the yellow dye-forming coupler is from 0.30 μm to 0.70 μm.

15. An image forming method according to claim 10, wherein the metal complex represented by general formula (II) is comprised in the silver iodide-containing phase.

16. An image forming method according to claim 10, wherein the silver halide emulsion further comprises an iridium complex in which all of six ligands consist of Cl, Br, or I.

* * * * *